US012622521B2

(12) United States Patent
LaPointe et al.

(10) Patent No.: US 12,622,521 B2
(45) Date of Patent: May 12, 2026

(54) ROCKING AND RECLINING WALL PROXIMITY FURNITURE MEMBER

(71) Applicant: La-Z-Boy Incorporated, Monroe, MI (US)

(72) Inventors: Larry P. LaPointe, Temperance, MI (US); Chandrasekar Ramasubramanian, Dayton, TN (US); Jason D. Rains, Evensville, TN (US)

(73) Assignee: La-Z-Boy Incorporated, Monroe, MI (US)

( * ) Notice: Subject to any disclaimer, the term of this patent is extended or adjusted under 35 U.S.C. 154(b) by 92 days.

(21) Appl. No.: 18/521,132

(22) Filed: Nov. 28, 2023

(65) Prior Publication Data

US 2024/0180332 A1 Jun. 6, 2024

Related U.S. Application Data

(60) Provisional application No. 63/259,925, filed on Dec. 5, 2022.

(51) Int. Cl.
*A47C 1/0355* (2013.01)
*A47C 3/025* (2006.01)

(52) U.S. Cl.
CPC ..... *A47C 1/0355* (2013.01); *A47C 3/0251* (2018.08)

(58) Field of Classification Search
CPC ..... A47C 3/0251; A47C 1/0355
See application file for complete search history.

(56) References Cited

U.S. PATENT DOCUMENTS

| | | | |
|---|---|---|---|
| 203,602 | A | 5/1878 | Dietsch |
| 1,182,854 | A | 5/1916 | Poler |
| 1,414,637 | A | 5/1922 | Gell |
| 2,473,895 | A | 6/1949 | Mednick |
| 2,677,412 | A | 5/1954 | Thomas |
| 2,719,572 | A | 10/1955 | Goldberg |
| 2,772,723 | A | 12/1956 | Tunnell |
| 3,096,121 | A | 7/1963 | Knabusch et al. |
| 3,179,466 | A | 4/1965 | Garrett |
| 3,191,990 | A | 6/1965 | Rugg et al. |
| 3,302,969 | A | 2/1967 | Mizelle et al. |
| 3,339,971 | A | 9/1967 | Fletcher |

(Continued)

FOREIGN PATENT DOCUMENTS

| | | | |
|---|---|---|---|
| CA | 1316807 | C | 4/1993 |
| CN | 87203587 | U | 1/1988 |

(Continued)

OTHER PUBLICATIONS

Chinese Office Action regarding Application No. 202180065617X dated Jul. 31, 2025 [machine translation].

(Continued)

*Primary Examiner* — Anthony D Barfield
(74) *Attorney, Agent, or Firm* — Harness, Dickey & Pierce, P.L.C.

(57) ABSTRACT

A chair mechanism includes a frame structure with a seat bottom supported by the frame structure and a seat back supported by the frame structure and pivotable to a reclined position relative to the seat bottom. A leg rest assembly is supported by the seat bottom and movable between a stowed position and an extended position. A rocking support structure connects the seat frame to a base structure.

17 Claims, 51 Drawing Sheets

(56) References Cited

U.S. PATENT DOCUMENTS 3,352,601 A 11/1967 Cycowicz
3,567,280 A 3/1971 Bradshaw
3,637,255 A 1/1972 Re
3,638,995 A 2/1972 Flanagan et al.
3,758,151 A 9/1973 Re
3,815,954 A 6/1974 Rogers, Jr. et al.
3,865,432 A 2/1975 Rogers, Jr. et al.
3,880,462 A 4/1975 Mednick
3,926,472 A 12/1975 Evans
3,941,417 A 3/1976 Re
3,945,449 A 3/1976 Ostrow
4,077,663 A 3/1978 Cycowicz et al.
4,099,776 A 7/1978 Crum et al.
4,140,342 A 2/1979 Jones
4,179,157 A 12/1979 Shoemaker et al.
4,191,420 A 3/1980 Fassett et al.
4,212,494 A 7/1980 Dabney
4,212,495 A 7/1980 Gall
4,216,991 A 8/1980 Holobaugh
4,216,992 A 8/1980 Crum
4,226,468 A 10/1980 Johnson
4,226,473 A 10/1980 Johnson
4,244,620 A 1/1981 Harrison et al.
4,352,523 A 10/1982 Holobaugh, Jr.
4,364,603 A 12/1982 Johnson
4,367,895 A 1/1983 Pacitti et al.
4,373,602 A 2/1983 Tomita et al.
4,451,084 A 5/1984 Seeley
4,492,407 A 1/1985 Broadhead
4,519,647 A 5/1985 Rogers, Jr.
4,570,995 A 2/1986 Rogers, Jr.
4,570,996 A 2/1986 Rogers, Jr.
4,582,435 A 4/1986 Davis
4,586,749 A 5/1986 Nakatani
4,601,513 A 7/1986 Pine
4,650,211 A 3/1987 Tanahashi
4,662,597 A 5/1987 Uecker et al.
4,719,764 A 1/1988 Cook
4,740,031 A 4/1988 Rogers, Jr.
4,805,960 A 2/1989 Tacker
4,818,018 A 4/1989 Yamasaki
4,861,101 A 8/1989 Hartline
4,895,411 A 1/1990 Pine
4,915,444 A 4/1990 Rogers, Jr.
4,932,927 A 6/1990 Fillar
4,989,914 A 2/1991 Pine
5,011,220 A 4/1991 LaPointe
5,044,692 A 9/1991 Tidwell, Jr. et al.
5,054,850 A 10/1991 Pine
5,064,244 A 11/1991 Sproule
5,072,988 A 12/1991 Plunk
5,088,789 A 2/1992 LaPointe et al.
5,123,705 A 6/1992 Johnson
5,129,701 A 7/1992 Pine
5,141,284 A 8/1992 LaPointe
5,147,108 A 9/1992 LaPointe
5,156,441 A 10/1992 Byersmith et al.
5,171,000 A 12/1992 LaPointe et al.
5,215,351 A 6/1993 Lapointe
5,217,276 A 6/1993 LaPointe et al.
5,217,277 A 6/1993 Rasnick et al.
5,234,253 A 8/1993 LaPointe et al.
5,238,295 A 8/1993 Harrell
5,271,660 A 12/1993 LaPointe et al.
5,312,153 A 5/1994 Lin
5,314,238 A 5/1994 Komorowski et al.
5,323,526 A 6/1994 Saul et al.
5,328,235 A 7/1994 Saul et al.
5,348,367 A 9/1994 Mizelle
5,360,255 A 11/1994 Cook et al.
5,423,591 A 6/1995 LaPointe et al.
5,435,621 A 7/1995 Komorowski et al.
5,435,622 A 7/1995 Fay et al.
5,466,046 A 11/1995 Komorowski et al.
5,480,209 A 1/1996 May
5,480,213 A 1/1996 Sproule
5,503,453 A 4/1996 Saul et al.
5,527,095 A 6/1996 Marshall et al.
5,567,009 A 10/1996 Fay et al.
5,570,927 A 11/1996 LaPointe et al.
5,570,930 A 11/1996 LaPointe et al.
5,582,457 A 12/1996 Komorowski et al.
5,597,209 A 1/1997 Bart et al.
5,651,580 A 7/1997 LaPointe et al.
5,664,832 A 9/1997 Stevens et al.
5,730,494 A 3/1998 LaPointe et al.
5,765,913 A 6/1998 LaPointe et al.
5,772,278 A 6/1998 Kowalski
5,775,775 A 7/1998 Hoffman
5,806,920 A 9/1998 Blount
5,806,921 A 9/1998 LaPointe et al.
5,823,614 A 10/1998 Johnson et al.
5,838,808 A 11/1998 Prosser
5,857,739 A 1/1999 Smith
5,865,457 A 2/1999 Knabusch et al.
5,890,765 A 4/1999 LaPointe et al.
5,954,392 A 9/1999 Liss et al.
5,971,475 A 10/1999 Lawson et al.
5,975,627 A 11/1999 LaPointe et al.
5,992,930 A 11/1999 LaPointe et al.
5,992,931 A 11/1999 LaPointe et al.
6,000,754 A 12/1999 Lawson
6,030,033 A 2/2000 Schultz
6,106,058 A 8/2000 Sur et al.
6,145,924 A 11/2000 Mero, Jr. et al.
6,179,328 B1 1/2001 Kawagoe et al.
6,227,489 B1 5/2001 Kitamoto et al.
6,231,120 B1 5/2001 Wiecek
6,276,753 B1 8/2001 Sur et al.
6,309,015 B1 10/2001 Pine
6,330,995 B1 12/2001 Mangeiga et al.
6,409,262 B1 6/2002 LaPointe
6,467,845 B1 10/2002 Chen
6,488,332 B1 12/2002 Markwald
6,491,342 B1 12/2002 Smith
6,655,732 B1 12/2003 LaPointe
6,827,401 B2 12/2004 Marshall et al.
6,939,076 B2 9/2005 LaPointe
6,988,769 B2 1/2006 LaPointe
7,021,711 B1 4/2006 Hoffman et al.
7,261,367 B2 8/2007 Duncan et al.
7,275,789 B2 10/2007 LaPointe
7,311,359 B2 12/2007 Smith
7,338,132 B2 3/2008 LaPointe
7,357,450 B2 4/2008 Rogers
7,431,387 B2 10/2008 LaPointe et al.
7,431,392 B2 10/2008 Tamara
7,475,944 B2 1/2009 Griepentrog et al.
7,552,970 B2 6/2009 LaPointe
7,585,018 B2 9/2009 LaPointe et al.
7,637,571 B2 12/2009 Okano et al.
7,673,933 B2 3/2010 Lawson
7,731,276 B2 6/2010 Hoffman et al.
7,823,966 B2 11/2010 Buchholz
7,828,380 B2 11/2010 Olarte
7,850,232 B2 12/2010 Casteel
8,113,574 B2 * 2/2012 Hoffman ..... A47C 1/0355 297/85
8,132,855 B2 3/2012 Richard
8,308,228 B2 11/2012 Lawson et al.
8,573,687 B2 11/2013 Lawson et al.
8,590,964 B2 11/2013 Murphy et al.
8,616,627 B2 12/2013 Murphy et al.
8,622,467 B2 1/2014 Murphy et al.
8,696,054 B2 4/2014 Crum
9,314,101 B2 4/2016 Harwood et al.
9,357,847 B2 6/2016 Murphy
9,433,295 B2 9/2016 Crum
9,635,943 B2 5/2017 Lawson
9,655,450 B2 5/2017 Marshall et al.
9,655,451 B2 5/2017 Harwood et al.
9,808,090 B2 11/2017 Carrera
9,895,000 B2 2/2018 Hassman
9,986,832 B2 6/2018 LaPointe et al.

(56) References Cited

U.S. PATENT DOCUMENTS

| | | | |
|---|---|---|---|
| 9,986,835 | B2 | 6/2018 | LaPointe et al. |
| 10,092,106 | B2 | 10/2018 | LaPointe et al. |
| 10,485,347 | B2 | 11/2019 | Lawson et al. |
| 10,492,613 | B2 | 12/2019 | LaPointe et al. |
| 10,512,332 | B2 | 12/2019 | LaPointe et al. |
| 10,512,333 | B2 | 12/2019 | Lawson et al. |
| 10,524,574 | B2 | 1/2020 | LaPointe et al. |
| 10,524,575 | B2 | 1/2020 | LaPointe |
| 10,537,178 | B2 | 1/2020 | Marshall et al. |
| 10,568,428 | B2 | 2/2020 | Marshall et al. |
| 10,653,243 | B2 | 5/2020 | Lawson et al. |
| 10,681,987 | B2 | 6/2020 | Liu et al. |
| 10,709,246 | B2 | 7/2020 | Murphy |
| 10,750,870 | B2 | 8/2020 | Marshall et al. |
| 10,779,653 | B2 | 9/2020 | LaPointe et al. |
| 10,820,708 | B2 | 11/2020 | LaPointe et al. |
| 10,890,235 | B2 | 1/2021 | Bucove |
| 11,197,549 | B1 | 12/2021 | LaPointe et al. |
| 11,490,736 | B1 | 11/2022 | Liu et al. |
| 2001/0026088 | A1 | 10/2001 | Robinson |
| 2003/0057743 | A1 | 3/2003 | May |
| 2004/0000803 | A1 | 1/2004 | Guillot et al. |
| 2005/0035632 | A1 | 2/2005 | Tseng |
| 2005/0067867 | A1 | 3/2005 | May |
| 2006/0061147 | A1 | 3/2006 | Johnson et al. |
| 2006/0103202 | A1 | 5/2006 | Maki et al. |
| 2006/0249992 | A1 | 11/2006 | LaPointe et al. |
| 2006/0249993 | A1 | 11/2006 | Rogers |
| 2007/0040419 | A1 | 2/2007 | LaPointe et al. |
| 2007/0085395 | A1 | 4/2007 | LaPointe |
| 2007/0158980 | A1 | 7/2007 | LaPointe et al. |
| 2007/0241589 | A1 | 10/2007 | LaPointe |
| 2008/0129006 | A1 | 6/2008 | Johnson et al. |
| 2008/0150329 | A1 | 6/2008 | Lawson |
| 2009/0152915 | A1 | 6/2009 | Krasna et al. |
| 2009/0218862 | A1 | 9/2009 | Du et al. |
| 2009/0243368 | A1 | 10/2009 | LaPointe |
| 2009/0284054 | A1 | 11/2009 | Humer et al. |
| 2011/0016627 | A1 | 1/2011 | Blevins et al. |
| 2011/0175426 | A1 | 7/2011 | Lawson |
| 2011/0233972 | A1 | 9/2011 | Weicek |
| 2011/0248544 | A1 | 10/2011 | Adams et al. |
| 2011/0248545 | A1 | 10/2011 | LaPointe et al. |
| 2011/0248547 | A1 | 10/2011 | LaPointe et al. |
| 2011/0304193 | A1 | 12/2011 | Murphy et al. |
| 2012/0112517 | A1 | 5/2012 | Hoffman et al. |
| 2012/0193946 | A1 | 8/2012 | Robertson |
| 2013/0062914 | A1 | 3/2013 | Marshall et al. |
| 2013/0140855 | A1 | 6/2013 | Murphy et al. |
| 2013/0140856 | A1 | 6/2013 | Murphy et al. |
| 2013/0175847 | A1 | 7/2013 | Lawson |
| 2013/0249256 | A1 | 9/2013 | Payne, Jr. et al. |
| 2014/0049079 | A1 | 2/2014 | Lawson et al. |
| 2014/0049084 | A1 | 2/2014 | Lawson et al. |
| 2014/0070585 | A1 | 3/2014 | LaPointe |
| 2014/0103688 | A1 | 4/2014 | Wilson |
| 2014/0246819 | A1 | 9/2014 | Harwood et al. |
| 2014/0312660 | A1 | 10/2014 | Natuzzi et al. |
| 2014/0327282 | A1 | 11/2014 | Crum |
| 2014/0333099 | A1 | 11/2014 | Lu et al. |
| 2014/0368011 | A1 | 12/2014 | LaPointe |
| 2015/0196123 | A1 | 7/2015 | Buehrer |
| 2015/0250320 | A1 | 9/2015 | Arceci et al. |
| 2015/0272329 | A1 | 10/2015 | Lawson |
| 2015/0282619 | A1 | 10/2015 | Lawson |
| 2016/0058195 | A1 | 3/2016 | Huang et al. |
| 2016/0100686 | A1 | 4/2016 | Regev |
| 2016/0100687 | A1 | 4/2016 | Murphy et al. |
| 2016/0120315 | A1 | 5/2016 | Robertson |
| 2016/0192779 | A1 | 7/2016 | Harwood et al. |
| 2016/0206097 | A1 | 7/2016 | Rivera |
| 2016/0206099 | A1 | 7/2016 | Robertson |
| 2016/0270537 | A1 | 9/2016 | Marshall et al. |
| 2016/0302573 | A1 | 10/2016 | Garland et al. |
| 2016/0325838 | A1 | 11/2016 | Erhel |
| 2016/0376007 | A1 | 12/2016 | Meindlhumer |
| 2017/0013961 | A1 | 1/2017 | LaPointe et al. |
| 2017/0042330 | A1 | 2/2017 | Bruce et al. |
| 2017/0101188 | A1 | 4/2017 | Auge et al. |
| 2017/0150818 | A1 | 6/2017 | Contreras |
| 2017/0347796 | A1 | 12/2017 | LaPointe et al. |
| 2017/0367483 | A1 | 12/2017 | Fecker et al. |
| 2018/0070725 | A1 | 3/2018 | LaPointe et al. |
| 2018/0078039 | A1 | 3/2018 | LaPointe et al. |
| 2018/0206644 | A1 | 7/2018 | Murphy |
| 2018/0228290 | A1 | 8/2018 | Kiwak et al. |
| 2018/0289156 | A1 | 10/2018 | Marshall et al. |
| 2018/0289157 | A1 | 10/2018 | Marshall et al. |
| 2018/0289158 | A1 | 10/2018 | Marshall et al. |
| 2019/0029436 | A1 | 1/2019 | Lin |
| 2019/0082841 | A1 | 3/2019 | LaPointe et al. |
| 2019/0082849 | A1 | 3/2019 | LaPointe et al. |
| 2019/0116981 | A1 | 4/2019 | LaPointe et al. |
| 2019/0290004 | A1 | 9/2019 | Lawson et al. |
| 2019/0313796 | A1 | 10/2019 | LaPointe |
| 2019/0350362 | A1 | 11/2019 | LaPointe et al. |
| 2019/0350368 | A1 | 11/2019 | Lapointe et al. |
| 2019/0380499 | A1 | 12/2019 | Kang |
| 2020/0163458 | A1 | 5/2020 | Murphy |
| 2020/0352333 | A1 | 11/2020 | LaPointe et al. |
| 2021/0022506 | A1 | 1/2021 | Murphy |
| 2021/0100364 | A1 | 4/2021 | Murphy |
| 2021/0169234 | A1 | 6/2021 | Jacobs et al. |
| 2022/0048627 | A1 | 2/2022 | Erhel et al. |
| 2022/0125201 | A1 | 4/2022 | Lapointe et al. |

FOREIGN PATENT DOCUMENTS

| | | | |
|---|---|---|---|
| CN | 2168480 | Y | 6/1994 |
| CN | 200976974 | Y | 11/2007 |
| CN | 104936483 | A | 9/2015 |
| CN | 105208896 | A | 12/2015 |
| CN | 107548287 | A | 1/2018 |
| CN | 113208347 | A | 8/2021 |
| CN | 113349581 | A | 9/2021 |
| DE | 623960 | C | 1/1936 |
| DE | 4122375 | A1 | 5/1992 |
| DE | 29707946 | U1 | 7/1997 |
| EP | 1504697 | A1 | 2/2005 |
| JP | S53147329 | A | 12/1978 |
| JP | H04259403 | A | 9/1992 |
| JP | H08266370 | A | 10/1996 |
| JP | H1146920 | A | 2/1999 |
| JP | 2001-046167 | A | 2/2001 |
| JP | 2001054443 | A | 2/2001 |
| JP | 2003070583 | A | 3/2003 |
| JP | 2003260097 | A | 9/2003 |
| JP | 2004065507 | A | 3/2004 |
| JP | 3125308 | U | 9/2006 |
| JP | 2008132141 | A | 6/2008 |
| JP | 2012070787 | A | 4/2012 |
| JP | 2013172804 | A | 9/2013 |
| JP | 2014147849 | A | 8/2014 |
| JP | 2015-066194 | A | 4/2015 |
| JP | 3198305 | U | 6/2015 |
| JP | 2021133182 | A | 9/2021 |
| KR | 20060036132 | A | 4/2006 |
| KR | 100807370 | B1 | 2/2008 |
| KR | 101245357 | B1 | 3/2013 |
| TW | 374704 | B | 11/1999 |
| TW | 201919523 | A | 6/2019 |
| WO | 9611612 | A1 | 4/1996 |
| WO | 2008008235 | A2 | 1/2008 |
| WO | 2011094478 | A1 | 8/2011 |
| WO | 2012162499 | A1 | 11/2012 |
| WO | 2015066030 | A1 | 5/2015 |
| WO | 2015153446 | A1 | 10/2015 |
| WO | 2016092248 | A1 | 6/2016 |

(56) References Cited

FOREIGN PATENT DOCUMENTS

| | | | |
|---|---|---|---|
| WO | 2017155069 | A1 | 9/2017 |
| WO | 2020118009 | A1 | 6/2020 |

OTHER PUBLICATIONS

International Search Report and Written Opinion of the ISA issued in PCT/US2024/024928, mailed Aug. 8, 2024; ISA/US.
Second Chinese Office Action regarding Patent Application No. 201980075907.5, dated Feb. 1, 2024.
International Search Report and Written Opinion of the ISA, issued in PCT/US2023/081628, maiiled Mar. 18, 2024; ISA/US (16 pages).
Office Action regarding German Patent Application No. 1120210050826, dated Jul. 5, 2025 [machine translation].
Pivoting Member with Adjustable Friction System—Oct. 30, 2024.
Viva Lift Power Recliners Catalog—Mar. 2019.
Viva Lift Power Recliner Collection Catalog [date unknown].
Viva Lift Power Recliner Collection—Atlas Plus Catalog [date unknown].
Chinese Office Action regarding Patent Application No. 201980075907.5, dated Jun. 24, 2024.
International Search Report and Written Opinion regarding International Application No. PCT/US2024/013045, dated Jul. 25, 2024.
Non-Final Office Action regarding U.S. Appl. No. 18/143,240 dated Sep. 15, 2025.
Office Action regarding Taiwanese Patent Application No. 114107320, Jul. 24, 2025 [Translation provided by Lee & Li].
International Search Report and Written Opinion of the International Searching Authority for Application No. PCT/ US2016/021361, dated May 30, 2016.
International Search Report and Written Opinion of the International Searching Authority for Application No. PCT/US2018/025467, dated Jul. 17, 2018.
European Search Report for Application No. 18159817.8, dated Sep. 26, 2018.
International Search Report and Written Opinion of the International Searching Authority for Application No. PCT/US2014/019455, dated May 26, 2014.
International Search Report and Written Opinion of the International Searching Authority for Application No. PCT/US2017/043899, dated Nov. 8, 2017.
International Search Report and Written Opinion of the International Searching Authority for Application No. PCT/US2006/031852, dated Jun. 17, 2008.
International Search Report and Written Opinion of the International Searching Authority for Application No. PCT/US2017/035976, dated Aug. 25, 2017.
European Search Report for Application No. 16824840.9, dated Dec. 7, 2018.
International Search Report and Written Opinion of the International Searching Authority for Application No. PCT/US2016/032967, dated Aug. 19, 2016.
First Examination Report for New Zealand Application No. 738919, dated Mar. 14, 2019.
European Search Report for Application No. 19158581.9, dated May 3, 2019.
International Search Report and Written Opinion of the International Searching Authority for Application No. PCT/US2019/021568, dated Jun. 20, 2019.
International Search Report and Written Opinion of the International Searching Authority for Application No. PCT/US2019/064607, dated Mar. 26, 2020.
International Search Report and Written Opinion of the International Searching Authority for Application No. PCT/US2020/032159, dated Aug. 14, 2020.
Office Action for Taiwanese Application No. 106116858, dated Apr. 10, 2020. Translation provided by Lee and Li, Attorneys-at-Law.
Office Action for Taiwanese Application No. 107109634, dated Apr. 19, 2021. Translation provided by Lee and Li, Attorneys-at-Law.
Office Action for Canadian Application No. 2,896,885, dated Mar. 8, 2018.
Office Action for Canadian Application No. 2,896,885, dated Oct. 18, 2018.
First Examination Report for New Zealand Application No. 565885, dated Oct. 7, 2009.
First Examination Report for Australian Application No. 2016294155, dated Nov. 21, 2019.
First Examination Report for Indian Application No. 201817001204, dated Jan. 3, 2020.
European Search Report for Application No. 16765435.9, dated Sep. 5, 2018.
First Examination Report for Indian Application No. 201717033062, dated Apr. 24, 2020.
First Examination Report for New Zealand Application No. 735460, dated Mar. 2, 2018.
International Search Report and Written Opinion regarding International Application No. PCT/US2021/052135, dated Jan. 3, 2022.
International Search Report and Written Opinion regarding International Patent Application No. PCT/US2023/015263, dated Jun. 29, 2023.
Office Action regarding Chinese Patent Application No. 202180065617X, Jan. 30, 2026 [machine translation].

* cited by examiner

ROCKING AND RECLINING WALL PROXIMITY FURNITURE MEMBER

CROSS-REFERENCE TO RELATED APPLICATIONS

This application claims the benefit of U.S. Provisional Application No. 63/259,925, filed on Dec. 5, 2022. The entire disclosure of the above application is incorporated herein by reference.

FIELD

The present disclosure relates to a rocking and reclining wall proximity furniture member.

BACKGROUND

This section provides background information related to the present disclosure and is not necessarily prior art.

Conventional reclining chairs or sofas must be positioned far enough away from a wall or any other object in a room to provide enough space behind the chair or sofa so that the wall or other object does not restrict the ability of a seatback of the chair or sofa to move into a fully reclined position. This can result in the user having to position the chair or sofa farther away from the wall than he or she would choose to position a non-reclining chair or sofa in order to leave space for the seatback to fully recline. The present disclosure provides a furniture member that translates a frame assembly of the furniture member forward as the seatback reclines, such that a distance between the wall and the seatback is the same or nearly the same in both an upright position and in a fully reclined position.

SUMMARY

This section provides a general summary of the disclosure, and is not a comprehensive disclosure of its full scope or all of its features.

According to an aspect of the present disclosure, a chair mechanism includes a frame structure with a seat bottom supported by the frame structure and a seat back supported by the frame structure and pivotable to a reclined position relative to the seat bottom. A leg rest assembly is supported by the seat bottom and movable between a stowed position and an extended position. A rocking support structure connects the seat frame to a base structure.

According to a further aspect, the seat bottom is supported at a front end by a pair of radial bearings that are supported by the seat bottom and the pair of radial bearings engage a pair of seat ramps that are secured to the frame structure.

According to a further aspect, the seat bottom is supported at a rear end by a pair of rear seat swing assemblies that are attached to the frame structure, the seat bottom and the seat back.

According to a further aspect, the pair of seat ramps include an elongated curved slot.

According to a further aspect, the elongated curved slot is sloped upward in a forward direction.

According to a further aspect, the elongated curved slot is curved upward in a forward direction.

According to a further aspect, an actuator motor is drivingly connected to an actuator arm that is connected to a first lever of an actuator shaft that include a pair of lever arms that are each connected to a linkage that are each connected to a frame of the seat bottom.

According to a further aspect, the seat bottom is supported at a front end by a pair of radial bearings that are supported by the seat bottom and the pair of radial bearings engage a pair of seat ramps that are secured to the frame structure.

According to a further aspect, the seat bottom is supported at a rear end by a pair of rear seat swing assemblies that are attached to the frame structure, the seat bottom, and the seat back.

According to a further aspect, the leg rest assembly includes a pair of leg rest arm assemblies that are connected to a frame of the seat bottom and to a leg rest panel, the leg rest assembly including a manual actuator including a handle connected to a body drive rod assembly that is rotatably connected to the frame structure, the leg rest assembly including a seat drive rod assembly that is mounted to the frame of the seat bottom and is slidably connected to the body drive rod assembly.

According to a further aspect, the body drive rod includes a first U-joint and the seat drive rod assembly includes a second U-joint.

According to a further aspect, the seat drive rod assembly includes a lever toggle assembly that is drivingly connected to a link arm that is connected to a draw bar that is connected to the pair of leg rest arm assemblies.

According to a further aspect, the lever toggle assembly includes an over-center spring arm that is connected to an over-center toggle spring.

According to a further aspect, a leg rest slide notch mechanism is connected between the seat drive rod assembly and the draw bar, the leg rest slide notch mechanism including a slide yoke and notch slide that includes a notched slot that is engaged by a spring pin to hold the leg rest assembly at a plurality of intermediate positions between the stowed position and a fully extended position.

According to a further aspect, the leg rest assembly includes a pair of leg rest arm assemblies that are connected to a frame of the seat bottom and to a leg rest panel, the leg rest assembly including a draw bar connected between the pair of leg rest arm assemblies, the leg rest assembly including an actuator motor that is drivingly connected to an actuator arm that is connected to a rear of a frame of the seat bottom and to the draw bar.

According to a further aspect, the seat bottom is supported at a front end by a pair of radial bearings that are supported by the seat bottom and the pair of radial bearings engage a pair of seat ramps that are secured to the frame structure.

According to a further aspect, the seat bottom is supported at a rear end by a pair of rear seat swing assemblies that are attached to the frame structure, the seat bottom, and the seat back.

According to a further aspect, the frame structure includes a cross tube connected to a pair of side rails, the rocking support structure including a rocker mount tube connected to the cross tube of the frame structure by a pair of spring plates.

According to a further aspect, a pedestal rocker mount assembly is connected to the rocker mount tube and includes a cylindrical sleeve that is engaged with a spindle of the base structure.

According to a further aspect, a pawl rack assembly is mounted to the cross tube and has a rack releasably engaged by a pawl and a rack connector connected to the rack and to the pedestal rocker mount assembly for securing the frame structure in a tilted position.

According to a further aspect, a tilt activation lever is drivingly connected to the pawl and is movable from a first position that allows the pawl to engage the rack and a second position that disengages the pawl from the rack.

According to a further aspect, the tilt activation lever is connected to an over-center toggle spring.

According to a further aspect, a pedestal rocker mount arm is pivotally connected to the rocker mount tube and includes a cylindrical sleeve that is engaged with a spindle of the base structure.

According to a further aspect, a power tilt mechanism is connected between the rocker mount tube and the pedestal rocker mount arm, the power tilt mechanism tilting the pedestal rocker mount arm relative to the rocker mount tube.

According to a further aspect, the power tilt mechanism includes an actuator motor connected to an actuator arm that engages a tilt lever attached to a tilt shaft, the tilt shaft is connected to a linkage that is connected to upper and lower swing links that are connected to the rocker mount tube and the pedestal rocker mount arm, respectively.

According to a further aspect, a tilt adjustment mechanism is connected between the rocker mount tube and the pedestal rocker mount tube.

According to a further aspect, the tilt adjustment mechanism includes a tilt adjustment plate having a pivot hole and a plurality of adjustment holes spaced at different distance from the pivot hole.

According to a further aspect, the base structure includes a swivel base with a spindle that supports the rocking support structure.

According to a further aspect, the base structure includes a pedestal base with a spindle that supports the rocking support structure.

According to a further aspect, the base structure includes a base assembly including a first pair of side rails with a channel therein and a first pair of wheels supported thereon, a base structure includes a second pair of side rails with a channel therein and a second pair of wheels supported thereon, wherein the first pair of wheels are received in the second pair of side rails and the second pair of wheels are received in the first pair of side rails, wherein the base structure includes a spindle that supports the rocking support structure.

According to a further aspect, a third pair of wheels are mounted above the first pair of side rails and engaging an upper surface of the second pair of side rails.

According to a further aspect, the rocking support structure is above the base structure.

According to a further aspect, the seat frame is able to rock on the rocking support structure when the pawl rack assembly is not securing the frame structure in a tilted position.

According to a further aspect, the seat frame is able to rock on the rocking support structure when the power tilt mechanism is not tilting the pedestal rocker mount arm relative to the rocker mount tube.

According to a further aspect, the pawl rack assembly is operable to secure the frame structure in a tilted position when the leg rest assembly is in a stowed position.

According to a further aspect, the power tilt mechanism is operable to secure the frame structure in a tilted position when the leg rest assembly is in a stowed position.

According to a further aspect, the pawl rack assembly is operable to secure the frame structure in a tilted position when the seat back is in an upright position.

According to a further aspect, the power tilt mechanism is operable to secure the frame structure in a tilted position when the seat back is in an upright position.

According to a further aspect, a chair mechanism includes a frame structure with a seat bottom supported by the frame structure and a seat back supported by the frame structure and pivotable to a reclined position relative to the seat bottom. A leg rest assembly is supported by the seat bottom and movable between a stowed position and an extended position. The seat bottom is supported at a front end by a pair of radial bearings that are supported by the seat bottom and the pair of radial bearings engage a pair of seat ramps that are secured to the frame structure.

According to a further aspect, the seat bottom is supported at a rear end by a pair of rear seat swing assemblies that are attached to the frame structure, the seat bottom, and the seat back.

According to a further aspect, the pair of seat ramps include an elongated curved slot.

According to a further aspect, the elongated curved slot is sloped upward in a forward direction.

According to a further aspect, the elongated curved slot is curved upward in a forward direction.

According to a further aspect, a chair mechanism includes a frame structure with a seat bottom supported by the frame structure and a seat back supported by the frame structure and pivotable to a reclined position relative to the seat bottom. A leg rest assembly is supported by the seat bottom and movable between a stowed position and an extended position. An actuator motor is drivingly connected to an actuator arm that is connected to a first lever of an actuator shaft that include a pair of lever arms that are each connected to a linkage that are each connected to a frame of the seat bottom.

According to a further aspect, the seat bottom is supported at a front end by a pair of radial bearings that are supported by the seat bottom and the pair of radial bearings engage a pair of seat ramps that are secured to the frame structure.

According to a further aspect, the seat bottom is supported at a rear end by a pair of rear seat swing assemblies that are attached to the frame structure, the seat bottom, and the seat back.

According to a further aspect, a chair mechanism includes a frame structure with a seat bottom supported by the frame structure and a seat back supported by the frame structure and pivotable to a reclined position relative to the seat bottom. A leg rest assembly is supported by the seat bottom and is movable between a stowed position and an extended position. The leg rest assembly includes a pair of leg rest arm assemblies that are connected to a frame of the seat bottom and to a leg rest panel, the leg rest assembly including a manual actuator including a handle connected to a body drive rod assembly that is rotatably connected to the frame structure, the leg rest assembly including a seat drive rod assembly that is mounted to the frame of the seat bottom and is slidably connected to the body drive rod assembly.

According to a further aspect, the body drive rod includes a first U-joint and the seat drive rod assembly includes a second U-joint.

According to a further aspect, the seat drive rod assembly includes a lever toggle assembly that is drivingly connected to a link arm that is connected to a draw bar that is connected to the pair of leg rest arm assemblies.

According to a further aspect, the lever toggle assembly includes an over-center spring arm that is connected to an over-center toggle spring.

According to a further aspect, a leg rest slide notch mechanism is connected between the seat drive rod assembly and the draw bar, the leg rest slide notch mechanism including a slide yoke and notch slide that includes a notched slot that is engaged by a spring pin to hold the leg rest assembly at a plurality of intermediate positions between the stowed position and a fully extended position.

A chair mechanism including a frame structure with a seat bottom supported by the frame structure and a seat back supported by the frame structure and pivotable to a reclined position relative to the seat bottom. A leg rest assembly is supported by the seat bottom and movable between a stowed position and an extended position. The leg rest assembly includes a pair of leg rest arm assemblies that are connected to a frame of the seat bottom and to a leg rest panel. The leg rest assembly including a draw bar connected between the pair of leg rest arm assemblies and the leg rest assembly including an actuator motor that is drivingly connected to an actuator arm that is connected to a rear of a frame of the seat bottom and to the draw bar.

According to a further aspect, the seat bottom is supported at a front end by a pair of radial bearings that are supported by the seat bottom and the pair of radial bearings engage a pair of seat ramps that are secured to the frame structure.

According to a further aspect, the seat bottom is supported at a rear end by a pair of rear seat swing assemblies that are attached to the frame structure, the seat bottom, and the seat back.

A chair mechanism includes a frame structure with a seat bottom supported by the frame structure and a seat back supported by the frame structure and pivotable to a reclined position relative to the seat bottom. A leg rest assembly is supported by the seat bottom and movable between a stowed position and an extended position. A rocking support structure is connected to the seat frame, wherein the frame structure includes a cross tube connected to a pair of side rails, the rocking support structure including a rocker mount tube that is connected to the cross tube of the frame structure by a pair of spring plates.

According to a further aspect, a pedestal rocker mount assembly is connected to the rocker mount tube and including a cylindrical sleeve that is engaged with a spindle of a base structure.

According to a further aspect, a pawl rack assembly that is mounted to the cross tube and has a rack releasably engaged by a pawl and a rack connector connected to the rack and to the pedestal rocker mount assembly for securing the frame structure in a tilted position.

According to a further aspect, a tilt activation lever is drivingly connected to the pawl and being movable from a first position that allows the pawl to engage the rack and a second position that disengages the pawl from the rack.

According to a further aspect, the tilt activation lever is connected to an over-center toggle spring.

According to a further aspect, a pedestal rocker mount arm is pivotally connected to the rocker mount tube and includes a cylindrical sleeve that is engaged with a spindle of a base structure.

According to a further aspect, a power tilt mechanism is connected between the rocker mount tube and the pedestal rocker mount arm, the power tilt mechanism tilting the pedestal rocker mount arm relative to the rocker mount tube.

According to a further aspect, the power tilt mechanism includes an actuator motor connected to an actuator arm that engages a tilt lever attached to a tilt shaft, the tilt shaft is connected to a linkage that is connected to upper and lower swing links that are connected to the rocker mount tube and the pedestal rocker mount arm, respectively.

According to a further aspect, a tilt adjustment mechanism is connected between the rocker mount tube and the pedestal rocker mount tube.

According to a further aspect, the tilt adjustment mechanism includes a tilt adjustment plate having a pivot hole and a plurality of adjustment holes spaced at different distances from the pivot hole.

According to a further aspect, a chair mechanism includes a frame structure with a seat bottom supported by the frame structure and a seat back supported by the frame structure and pivotable to a reclined position relative to the seat bottom. A leg rest assembly is supported by the seat bottom and movable between a stowed position and an extended position. A base structure includes a base assembly including a first pair of side rails with a channel therein and a first pair of wheels supported thereon, a base structure including a second pair of side rails with a channel therein and a second pair of wheels supported thereon, wherein the first pair of wheels are received in the second pair of side rails and the second pair of wheels are received in the first pair of side rails, wherein the base structure supports the frame structure.

According to a further aspect, a third pair of wheels are mounted above the first pair of side rails and engaging an upper surface of the second pair of side rails.

A chair mechanism includes a frame structure with a seat bottom supported by the frame structure. A seat back is supported by the frame structure and is pivotable to a reclined position relative to the seat bottom. A leg rest assembly is supported by the seat bottom and movable between a stowed position and an extended position. A rocking support structure is connected to the seat frame, wherein the frame structure includes a cross tube connected to a pair of side rails, and the rocking support structure including a rocker mount tube is connected to the cross tube of the frame structure by a pair of spring plates. A pawl rack assembly is mounted to the cross tube and has a rack releasably engaged by a pawl and a rack connector connected to the rack and to the pedestal rocker mount assembly for securing the frame structure in a tilted position. The pawl rack assembly is operable to secure the frame structure in a tilted position when the leg rest assembly is in a stowed position.

A chair mechanism includes a frame structure with a seat bottom supported by the frame structure. A seat back is supported by the frame structure and pivotable to a reclined position relative to the seat bottom. A leg rest assembly is supported by the seat bottom and movable between a stowed position and an extended position. A rocking support structure is connected to the seat frame, wherein the frame structure includes a cross tube connected to a pair of side rails and the rocking support structure includes a rocker mount tube connected to the cross tube of the frame structure by a pair of spring plates. A power tilt mechanism is connected between the rocker mount tube and the pedestal rocker mount arm, the power tilt mechanism tilting the pedestal rocker mount arm relative to the rocker mount tube, wherein the seat frame is able to rock on the rocking support structure when the power tilt mechanism is not tilting the pedestal rocker mount arm relative to the rocker mount tube.

A chair mechanism includes a frame structure and a seat bottom supported by the frame structure. A seat back is supported by the frame structure and is pivotable to a reclined position relative to the seat bottom. A leg rest assembly is supported by the seat bottom and is movable between a stowed position and an extended position. A rocking support structure is connected to the seat frame, wherein the frame structure includes a cross tube connected to a pair of side rails, the rocking support structure including a rocker mount tube connected to the cross tube of the frame structure by a pair of spring plates. A power tilt mechanism is connected between the rocker mount tube and the pedestal rocker mount arm, the power tilt mechanism tilting the pedestal rocker mount arm relative to the rocker mount tube. A power recline mechanism moves the seat back to the recline position; and a power leg rest mechanism moves the leg rest to the extended position, wherein the power recline mechanism, the power leg rest mechanism and the power tilt mechanism are independently operable relative to one another.

According to a further aspect, the power recline mechanism, the power leg rest mechanism and the power tilt mechanism are operated based upon a pre-arranged sequence based upon occupant preference using memory.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIG. 14A is a side plan view of the leg rest arm assembly according to the principles of the present disclosure;

Corresponding reference numerals indicate corresponding parts throughout the several views of the drawings.

DETAILED DESCRIPTION

Example embodiments will now be described more fully with reference to the accompanying drawings.

Figure 1A:
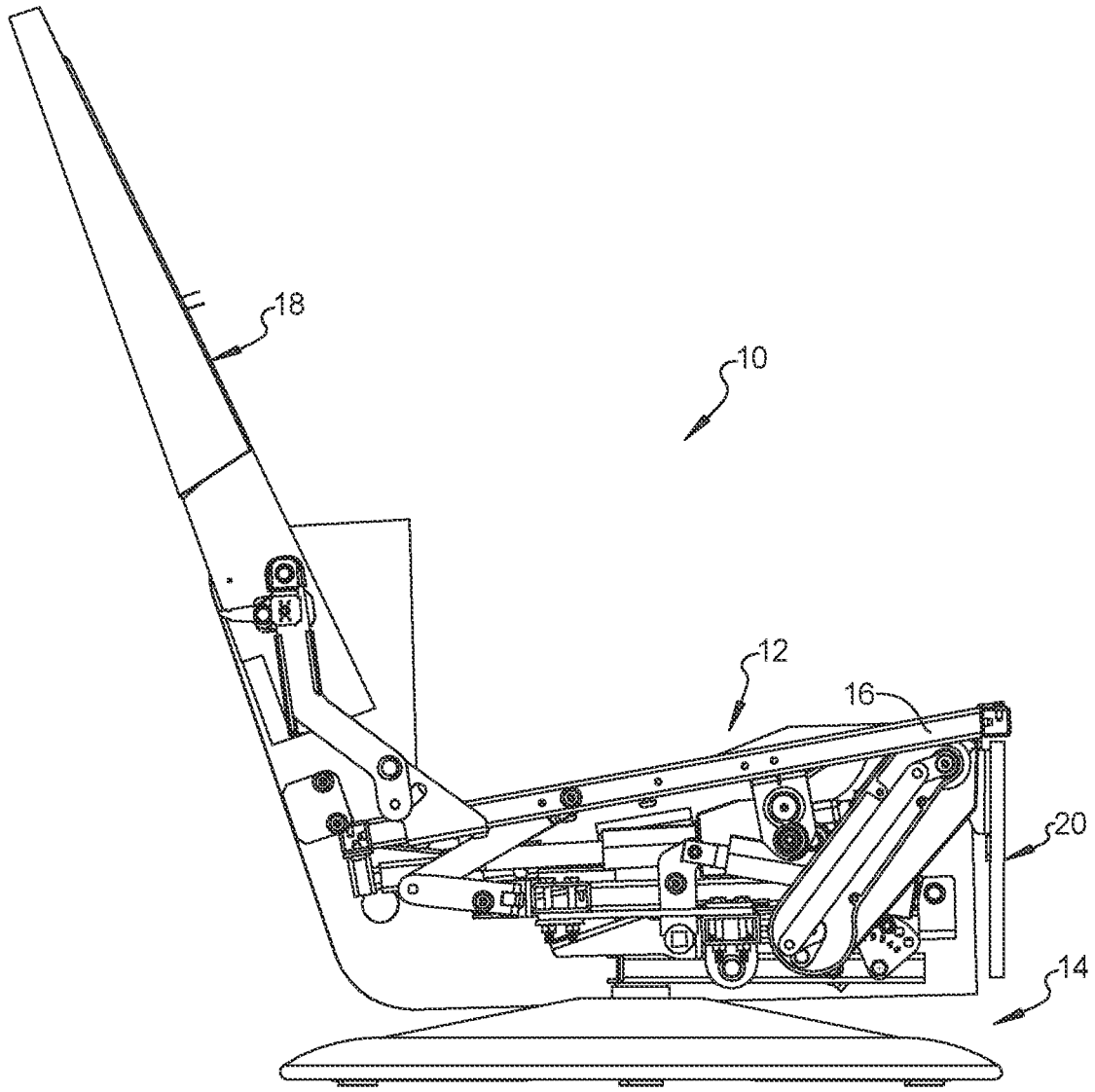
FIG. 1A is a side view of a rocking, reclining, and swiveling power chair mechanism in an upright position.

With reference to FIG. 1A, a side view of a rocking, reclining, and swiveling power chair mechanism 10 is shown in an upright position. The chair mechanism 10 includes a power chair chassis 12 on a swivel base 14. The power chair chassis 12 has a seat bottom 16 (shown with covering and padding removed), a reclinable seat back 18 (shown with covering and padding removed), and an extendable leg rest 20 (shown with covering and padding removed) and it is capable of rocking or holding in a tilted position. The swivel base 14 allows the chair chassis 12 to swivel.

Figure 1B:
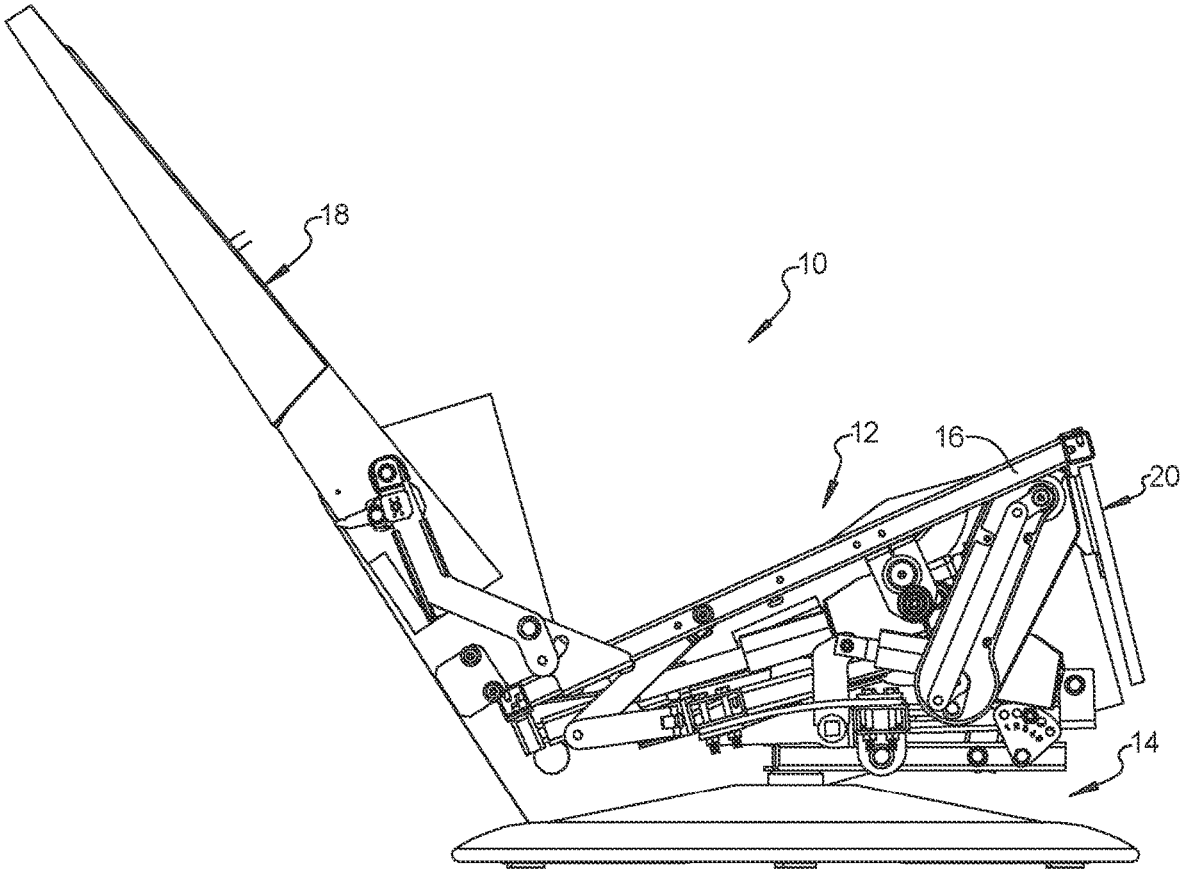
FIG. 1B is a side view of the rocking, reclining, and swiveling power chair mechanism rocked rearward.
Figure 1C:
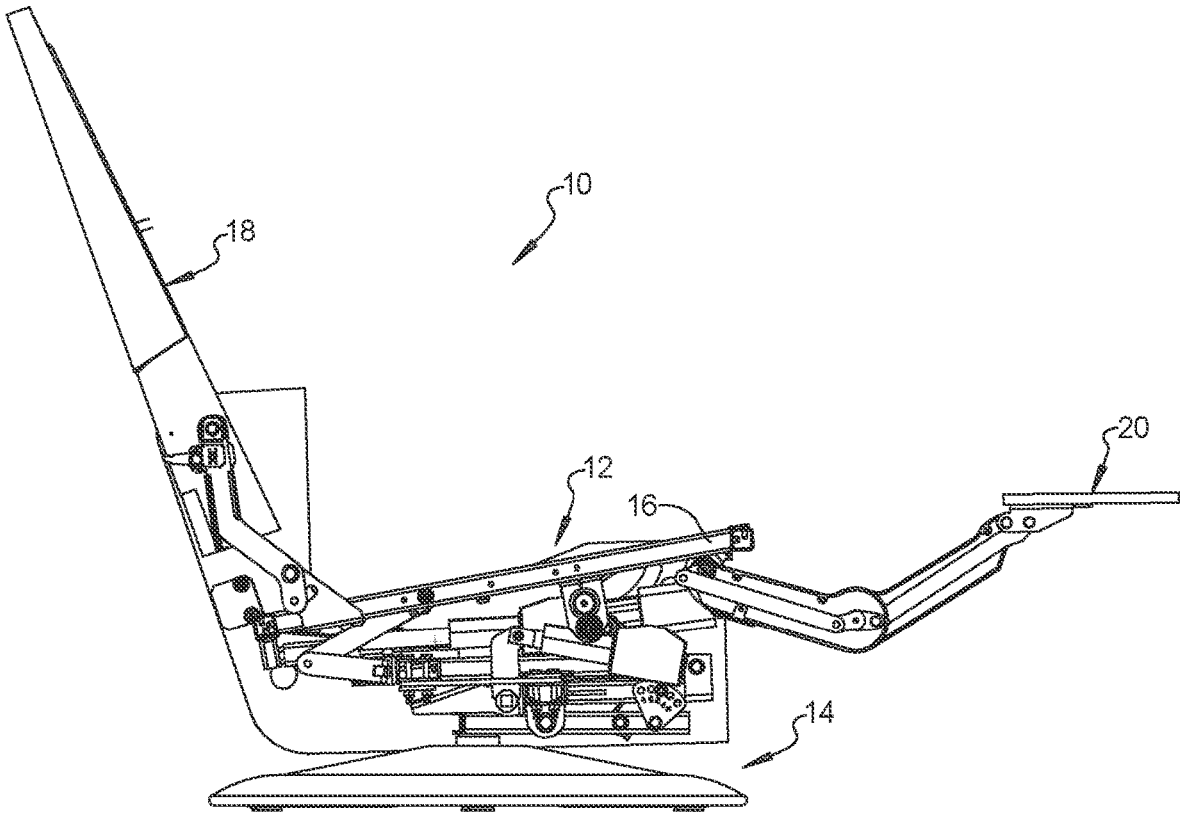
FIG. 1C is a side view of the rocking, reclining, and swiveling power chair mechanism in a leg rest extended position.
Figure 1D:
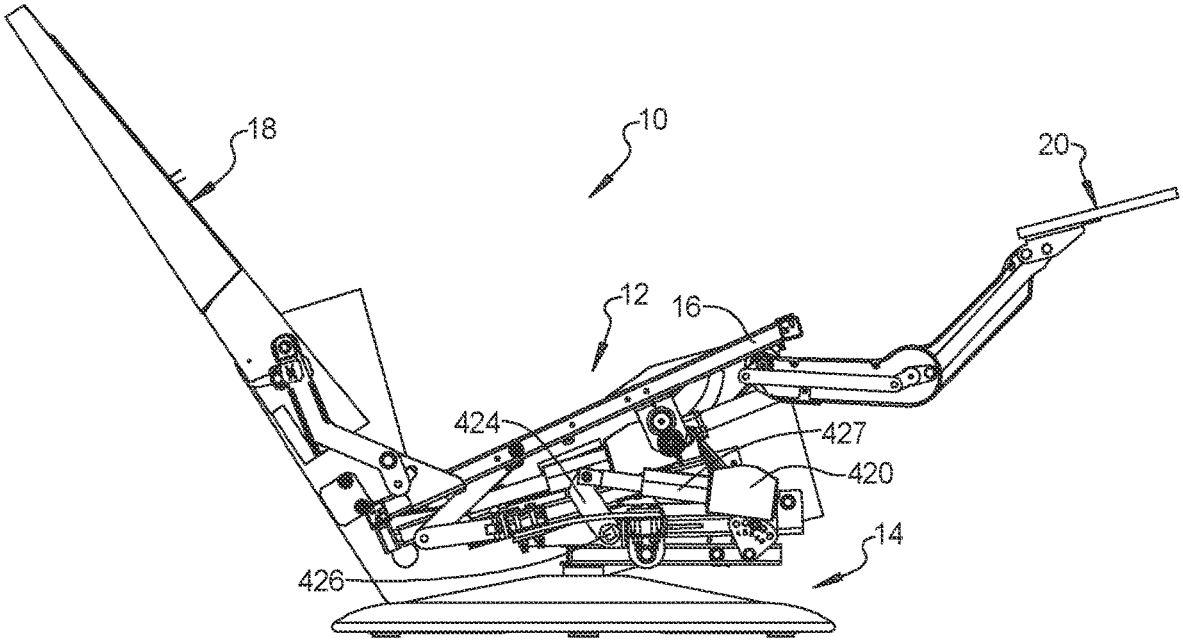
FIG. 1D is a side view of the rocking, reclining, and swiveling power chair mechanism in a leg rest extended position and tilted rearward.
Figure 1E:
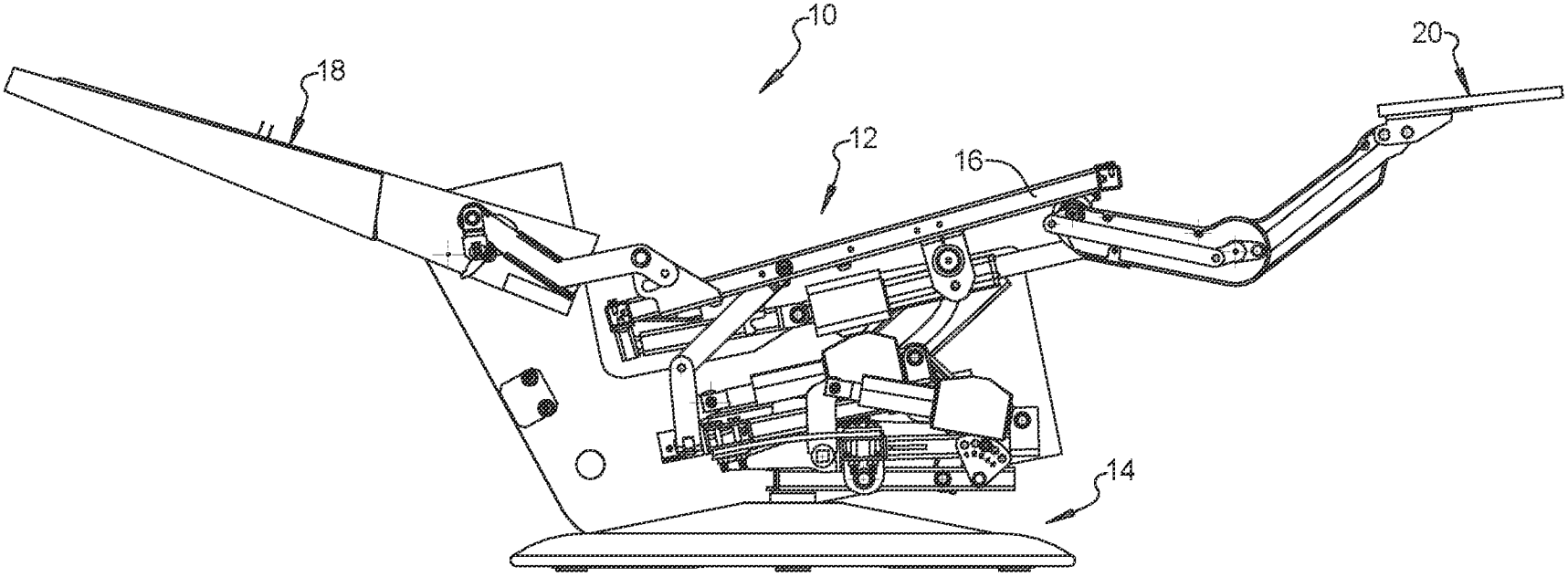
FIG. 1E is a side view of the rocking, reclining, and swiveling power chair mechanism in a seat back reclined and leg rest extended position.
Figure 1F:
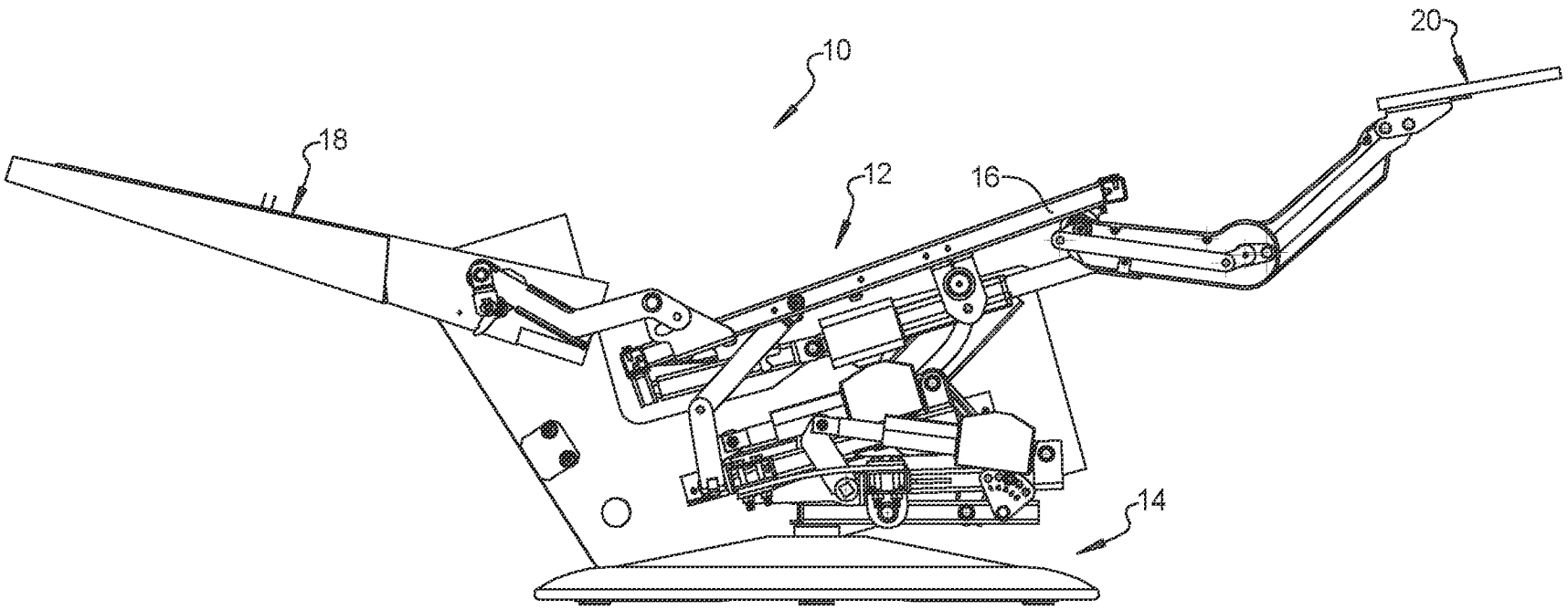
FIG. 1F is a side view of the rocking, reclining, and swiveling power chair mechanism in a seat back reclined and leg rest extended position and tilted rearward.

FIG. 1B is a side view of the rocking, reclining, and swiveling power chair mechanism 10 rocked rearward. FIG. 1C is a side view of the rocking, reclining, and swiveling power chair mechanism 10 with the leg rest 20 in an extended position. FIG. 1D is a side view of the rocking, reclining, and swiveling power chair mechanism 10 with the leg rest 20 in an extended position and the power chair chassis 12 tilted rearward. FIG. 1E is a side view of the rocking, reclining, and swiveling power chair mechanism 10 with the seat back 18 reclined and the leg rest 20 in an extended position. FIG. 1F is a side view of the rocking, reclining, and swiveling power chair mechanism 10 with the seat back 18 reclined, the leg rest 20 in an extended position and the power seat chassis 12 tilted rearward.

Figure 2A:
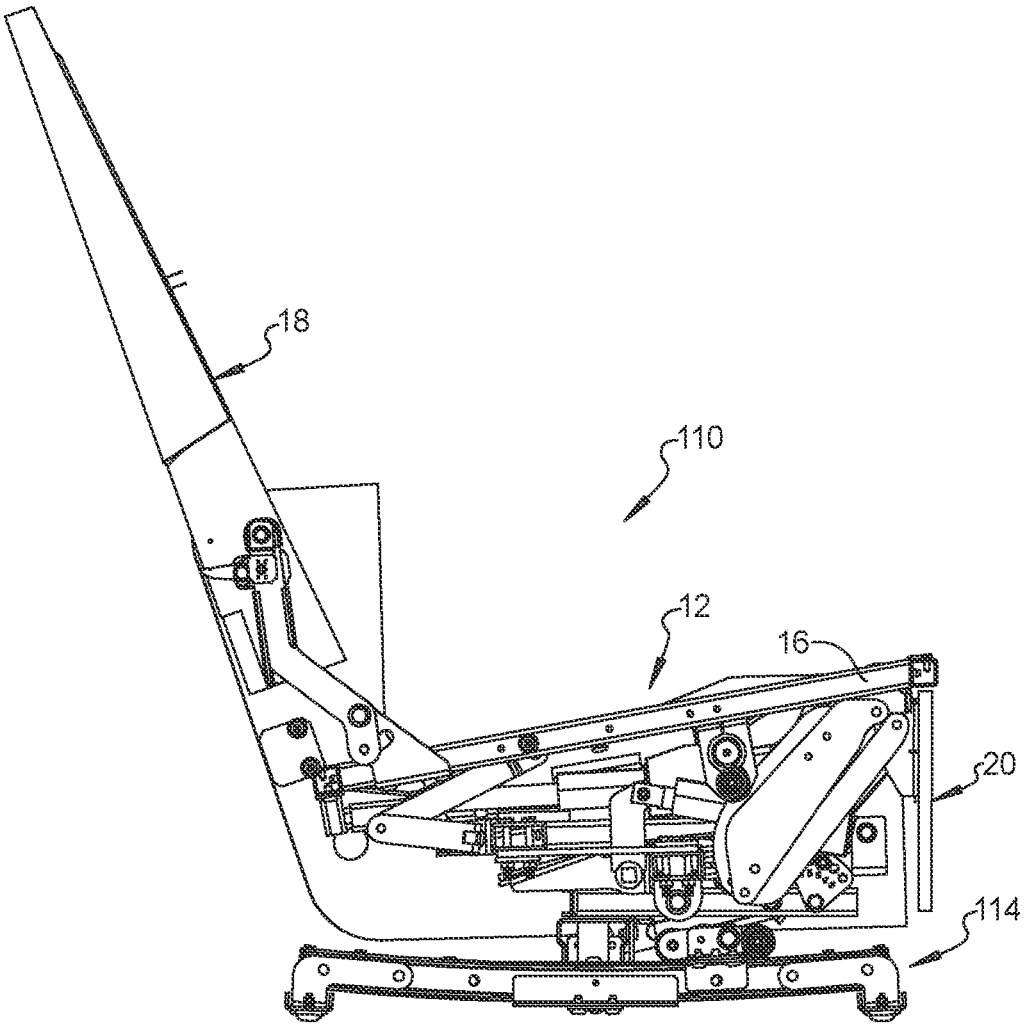
FIG. 2A is a side view of a rocking, reclining and wall-away power chair mechanism in an upright position.

With reference to FIG. 2A, a side view of a rocking, reclining and wall-away power chair mechanism 110 is shown in an upright position. The chair mechanism 110 includes a power chair chassis 12 on a wall-away base 114. The power chair chassis 12 has a seat bottom 16, a reclinable seat back 18, an extendable leg rest 20 and it is capable of rocking or holding in a tilted position. The wall-away base 114 allows the chair chassis 12 to stay in a relatively constant distance from a wall or other structure when the seat back 18 of the chair mechanism 110 is reclined.

Figure 2B:
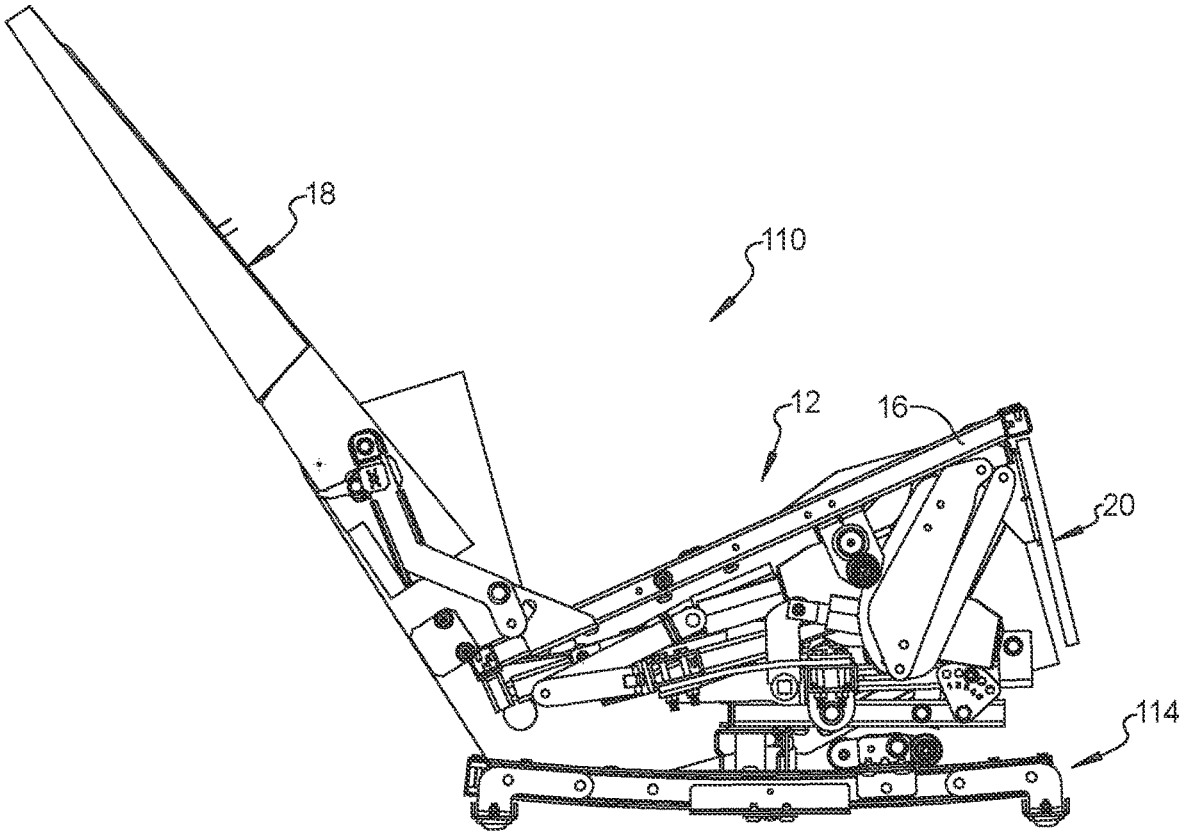
FIG. 2B is a side view of the rocking, reclining and wall-away power chair mechanism rocked rearward.
Figure 2C:
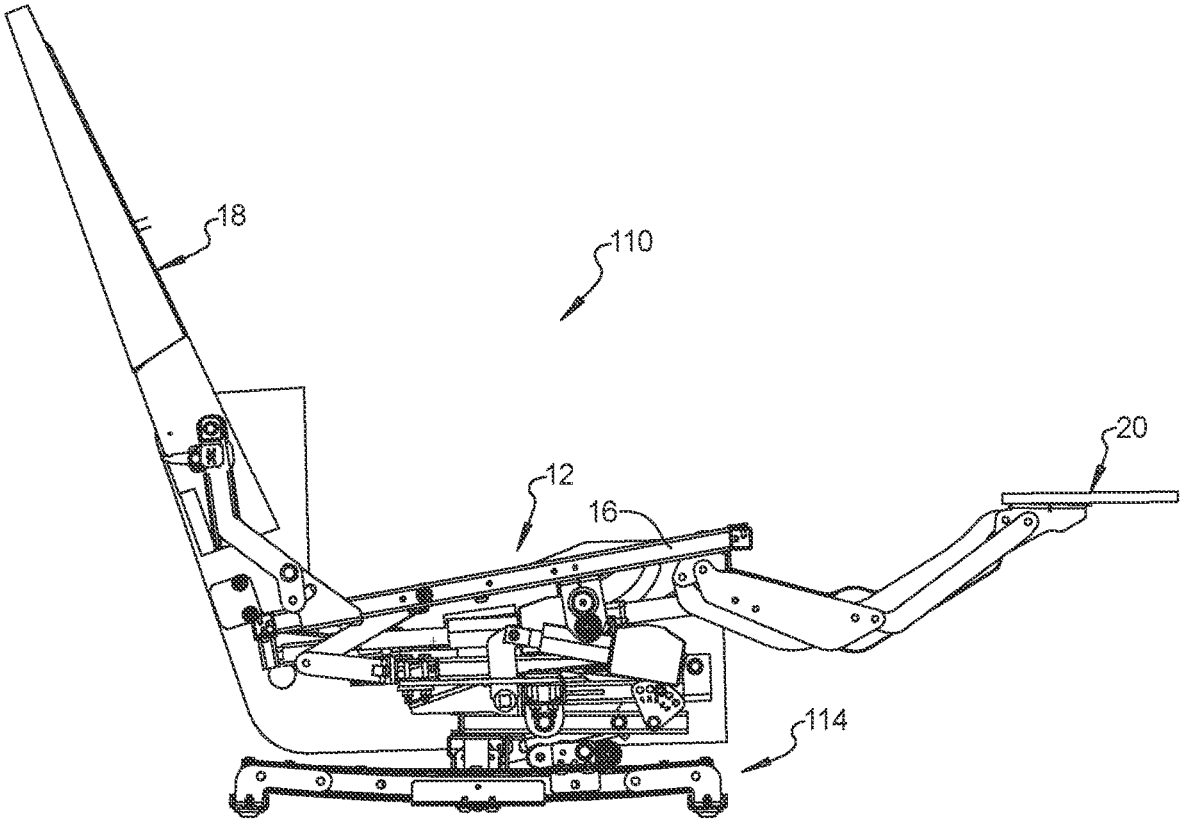
FIG. 2C is a side view of the rocking, reclining and wall-away power chair mechanism in a leg rest extended position.
Figure 2D:
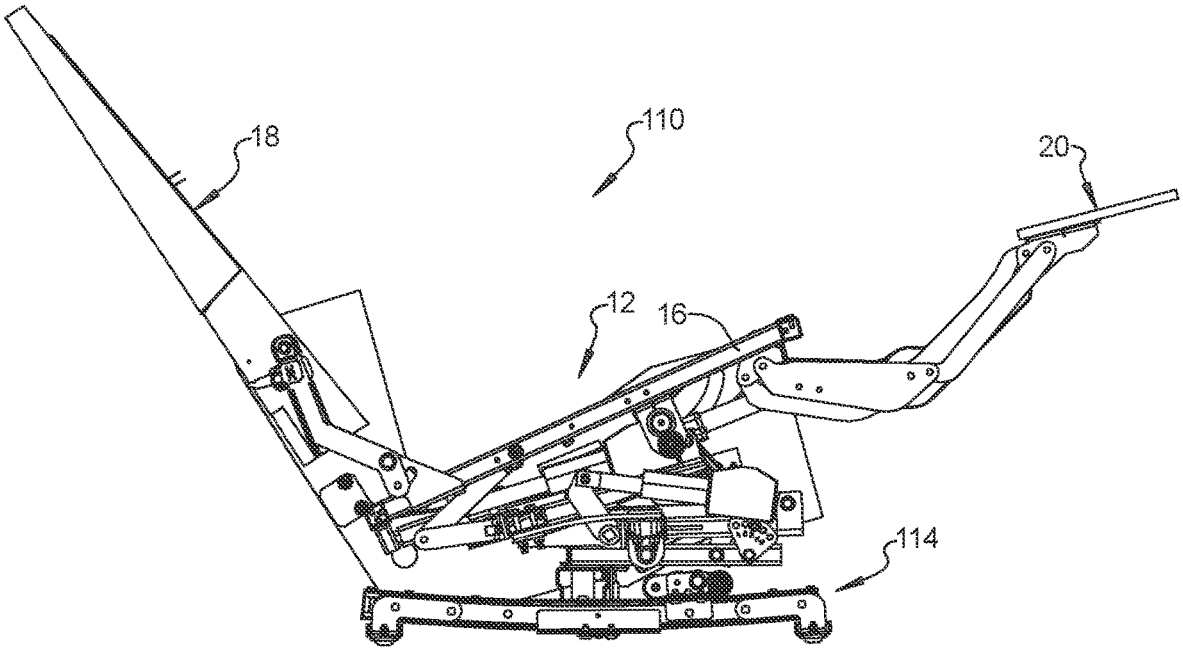
FIG. 2D is a side view of the rocking, reclining and wall-away power chair mechanism in a leg rest extended position and tilted rearward.
Figure 2E:
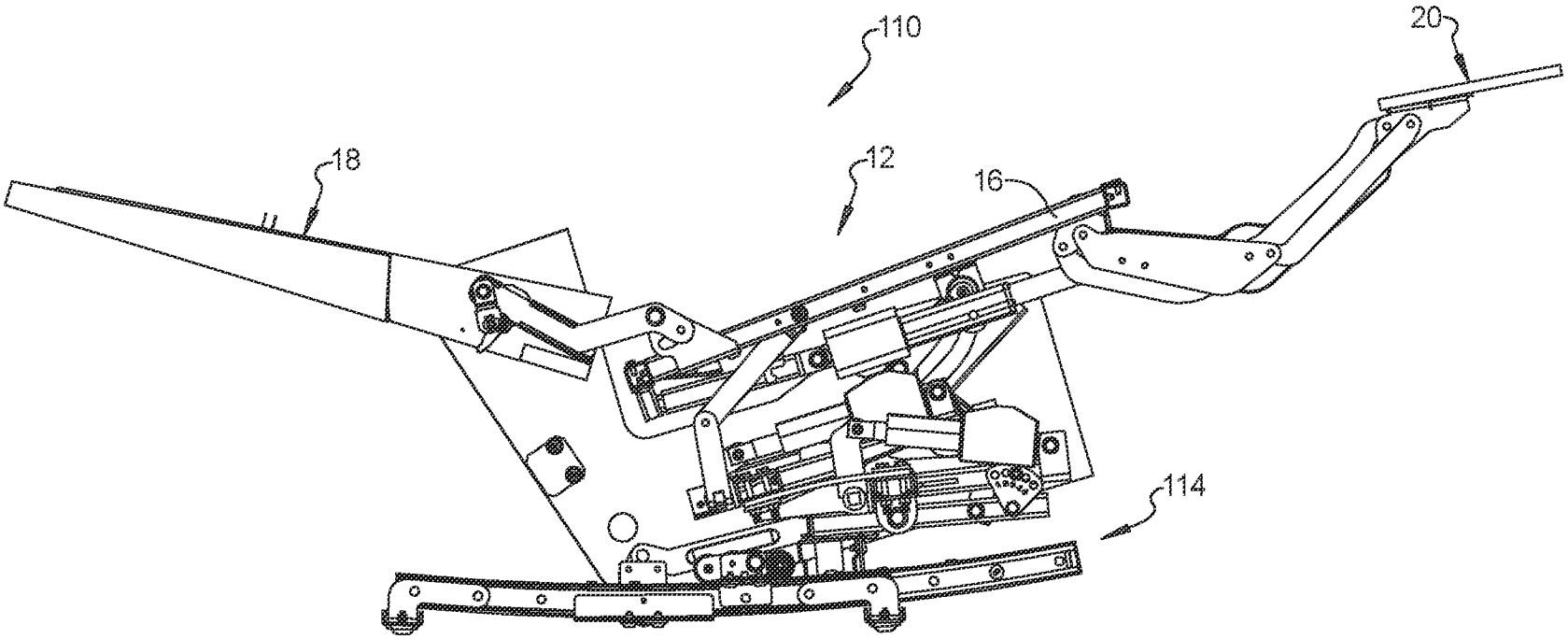
FIG. 2E is a side view of the rocking, reclining and wall-away power chair mechanism in a seat back reclined and leg rest extended position.
Figure 2F:
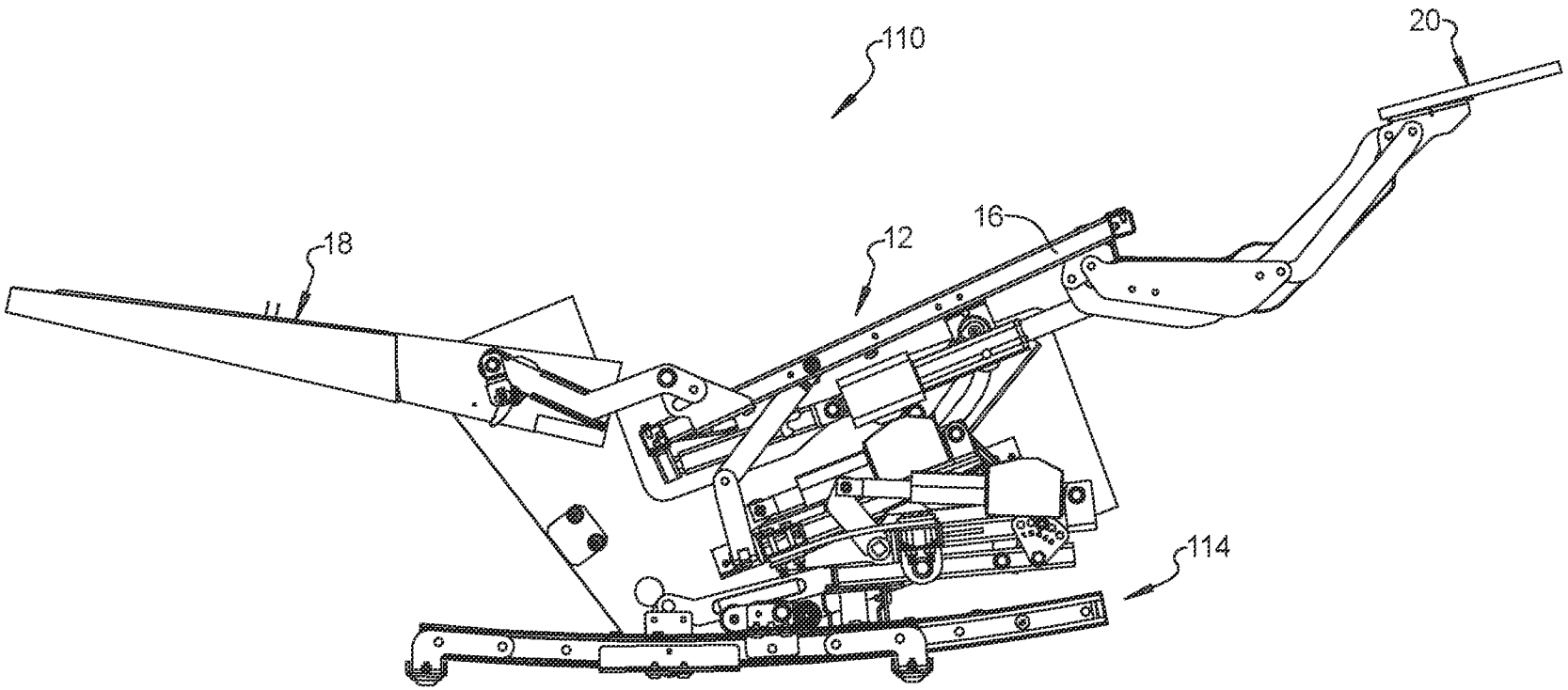
FIG. 2F is a side view of the rocking, reclining and wall-away power chair mechanism in a seat back reclined and leg rest extended position and tilted rearward.

FIG. 2B is a side view of the rocking, reclining and wall-away power chair mechanism 110 rocked rearward. FIG. 2C is a side view of the rocking, reclining and wall-away power chair mechanism 110 with the leg rest 20 in an extended position. FIG. 2D is a side view of the rocking, reclining and wall-away power chair mechanism 110 with the leg rest 20 in an extended position and the power chair chassis 12 tilted rearward. FIG. 2E is a side view of the rocking, reclining and wall-away power chair mechanism 110 with the seat back 18 reclined and the leg rest 20 in an extended position. FIG. 2F is a side view of the rocking, reclining and wall-away power chair mechanism 110 with the seat back 18 reclined, the leg rest 20 in an extended position and the power seat chassis 12 tilted rearward.

Figure 3:
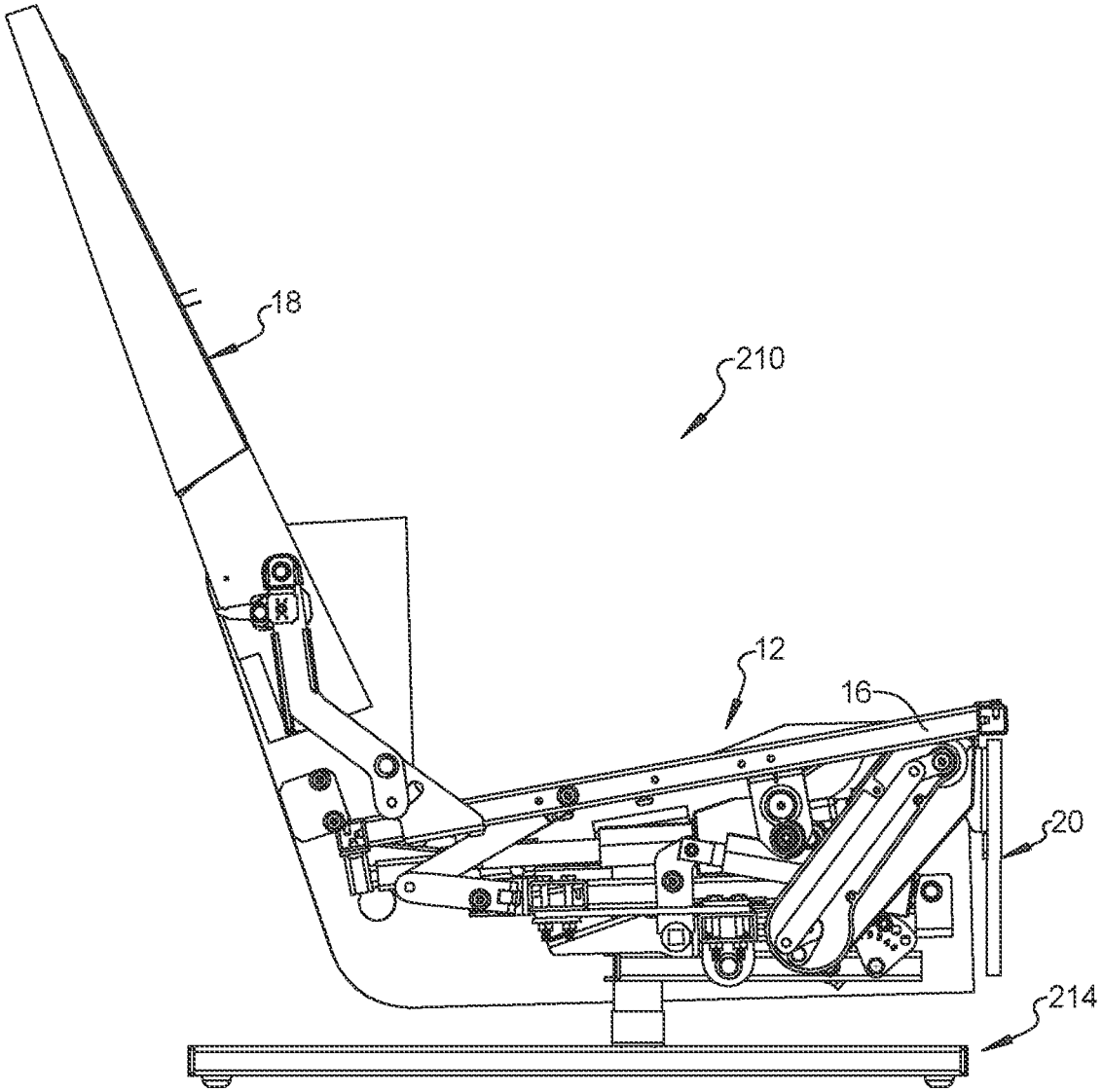
FIG. 3 is a side view of a rocking and reclining power chair mechanism in an upright position.

With reference to FIG. 3, a side view of a rocking and reclining power chair mechanism 210 is shown in an upright position. The chair mechanism 210 includes a power chair chassis 12 on a pedestal base 214. The power chair chassis 12 has a seat bottom 16, a seat back 18 that reclines, an extendable leg rest 20 and it is capable of rocking and holding in a tilted position. The pedestal base 214 supports the chair chassis 12. The chair mechanism 210 is capable of extending the leg rest 20, reclining the seat back 18, rocking and tilting in a same manner as disclosed with reference to the embodiment of FIGS. 1A-1F.

Figure 4A:
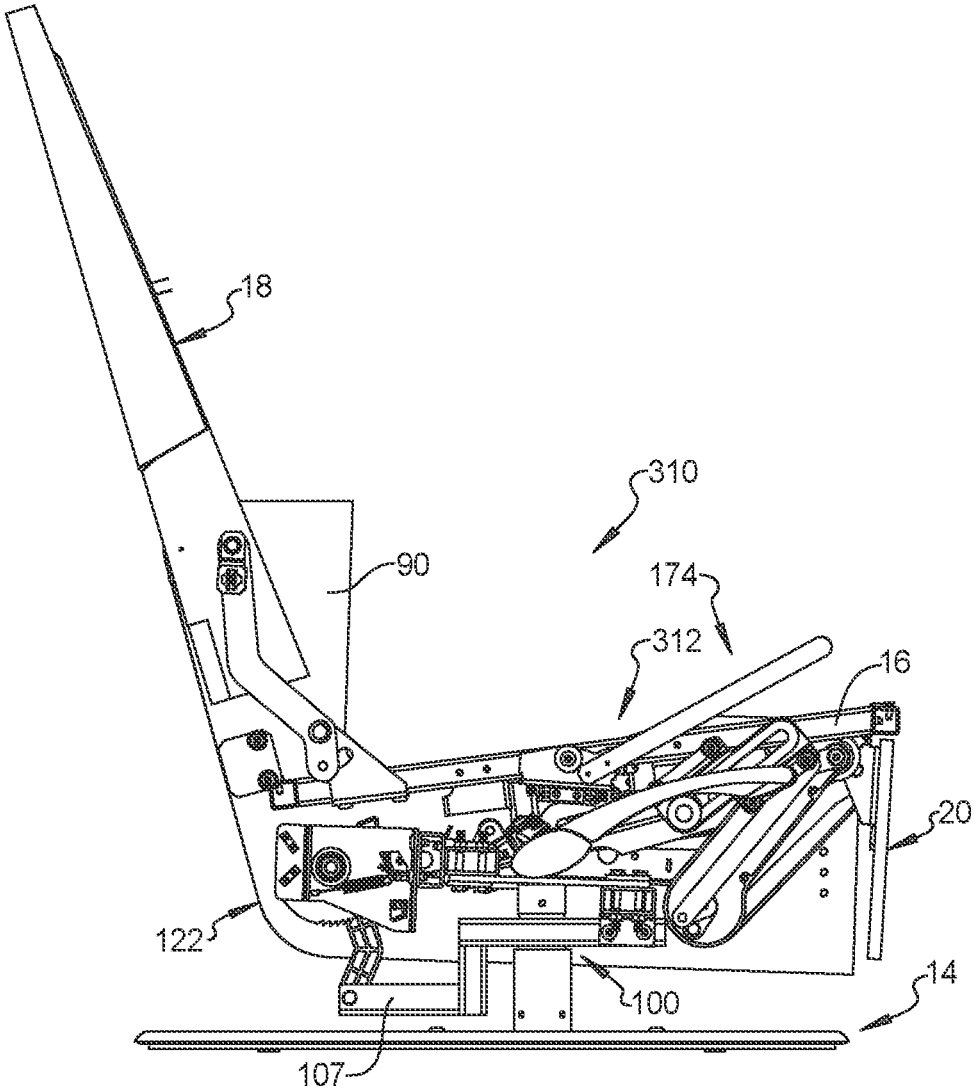
FIG. 4A is a side view of a rocking, reclining, and swiveling manual chair mechanism in an upright position.
Figure 4B:
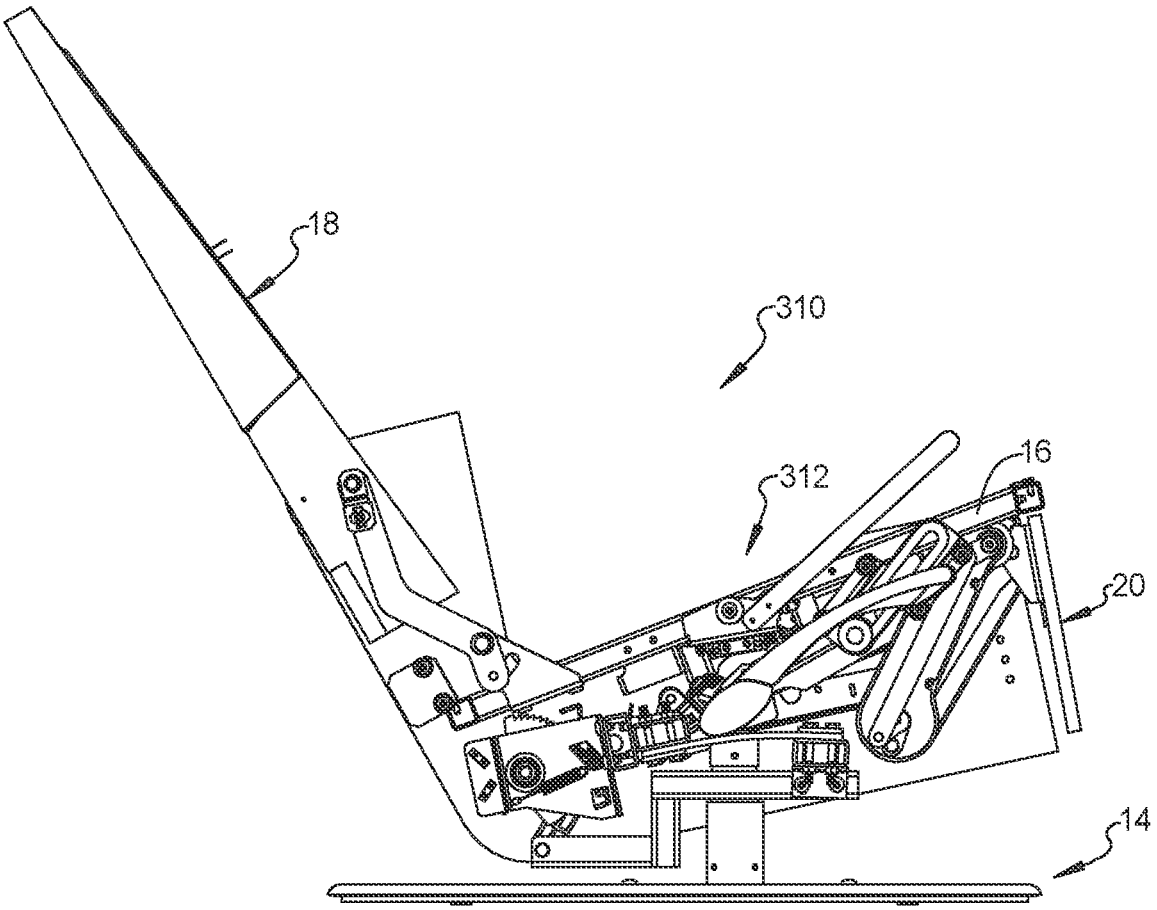
FIG. 4B is a side view of the rocking, reclining, and swiveling manual chair mechanism tilted rearward.
Figure 4C:
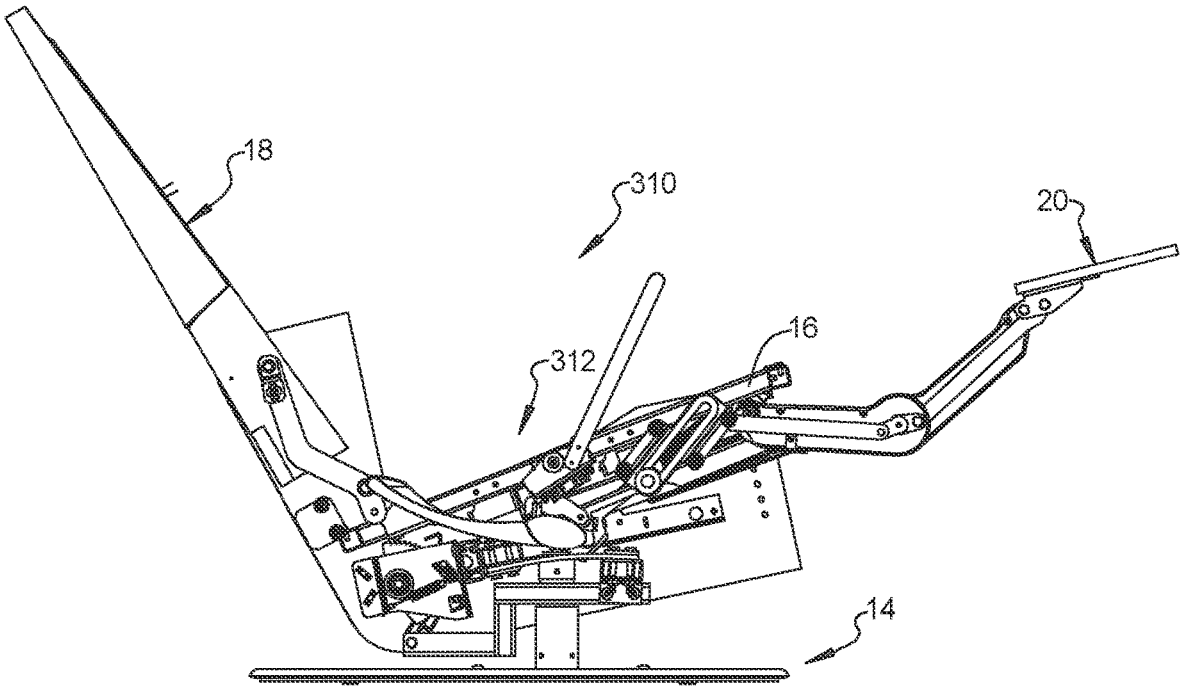
FIG. 4C is a side view of the rocking, reclining, and swiveling manual chair mechanism in a leg rest extended position and tilted rearward.
Figure 4D:
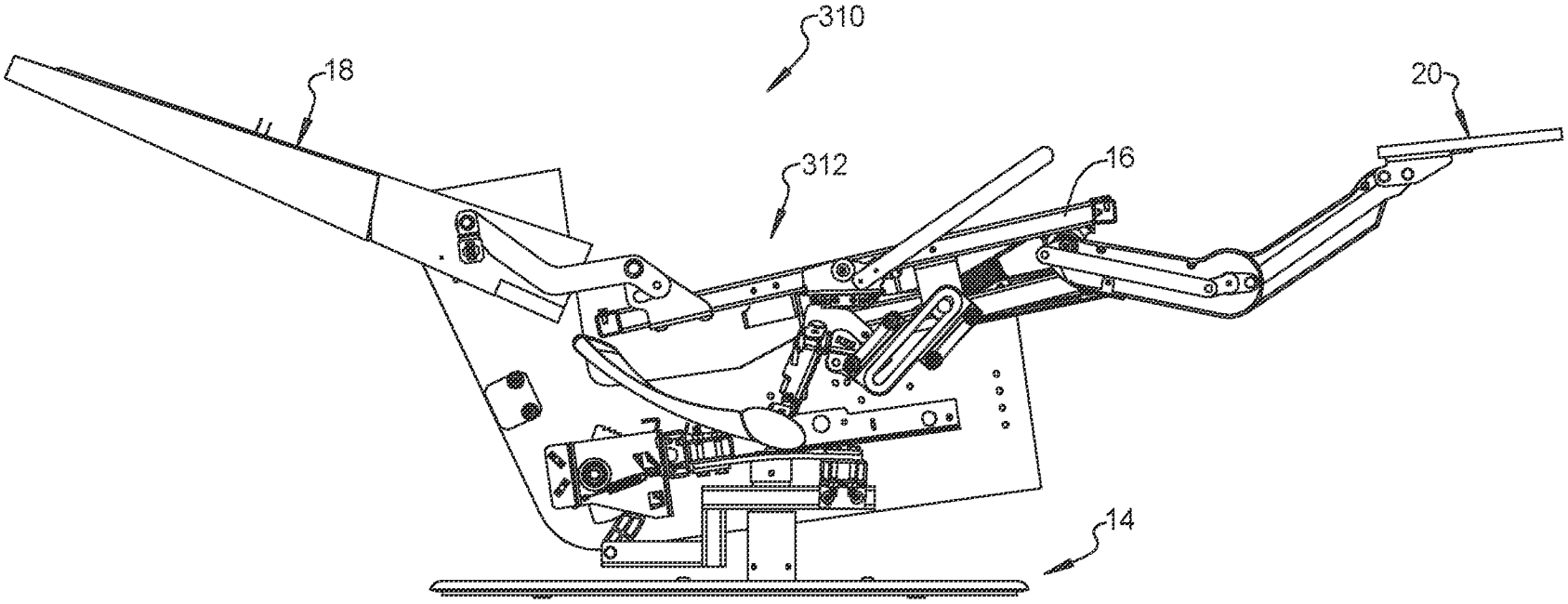
FIG. 4D is a side view of the rocking, reclining, and swiveling manual chair mechanism in a seat back reclined and leg rest extended position and rocked rearward.
Figure 4E:
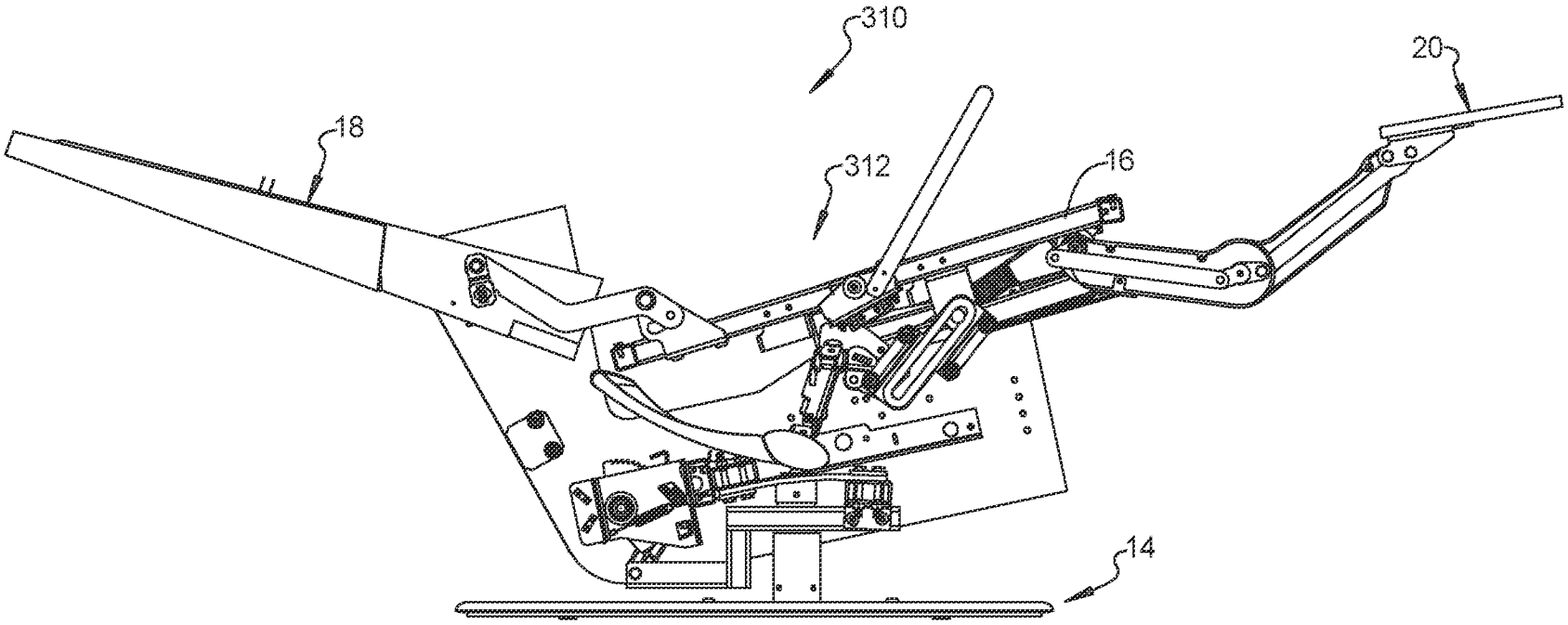
FIG. 4E is a side view of the rocking, reclining, and swiveling manual chair mechanism in a seat back reclined and leg rest extended position and tilted rearward.

With reference to FIG. 4A, a side view of a rocking, reclining, and swiveling manual chair mechanism 310 is shown in an upright position. The chair mechanism 310 includes a manual chair chassis 312 on a swivel base 14. The manual chair chassis 312 has a seat bottom 16, a reclinable seat back 18, an extendable leg rest 20 (See FIG. 4B) and it is capable of rocking or holding in a tilted position. The swivel base 14 allows the chair chassis 312 to swivel. FIG. 4B is a side view of the rocking, reclining, and swiveling manual chair mechanism 310 rocked rearward. FIG. 4C is a side view of the rocking, reclining, and swiveling manual chair mechanism 310 with the leg rest 20 in an extended position and the seat chassis 312 tilted. FIG. 4D is a side view of the rocking, reclining, and swiveling power chair mechanism 310 with the leg rest 20 in an extended position and the manual chair chassis 312 rocked rearward. FIG. 4E is a side view of the rocking, reclining, and swiveling manual chair mechanism 310 with the seat back 18 reclined, the leg rest 20 in an extended position and the manual seat chassis 312 tilted rearward.

Figure 5A:
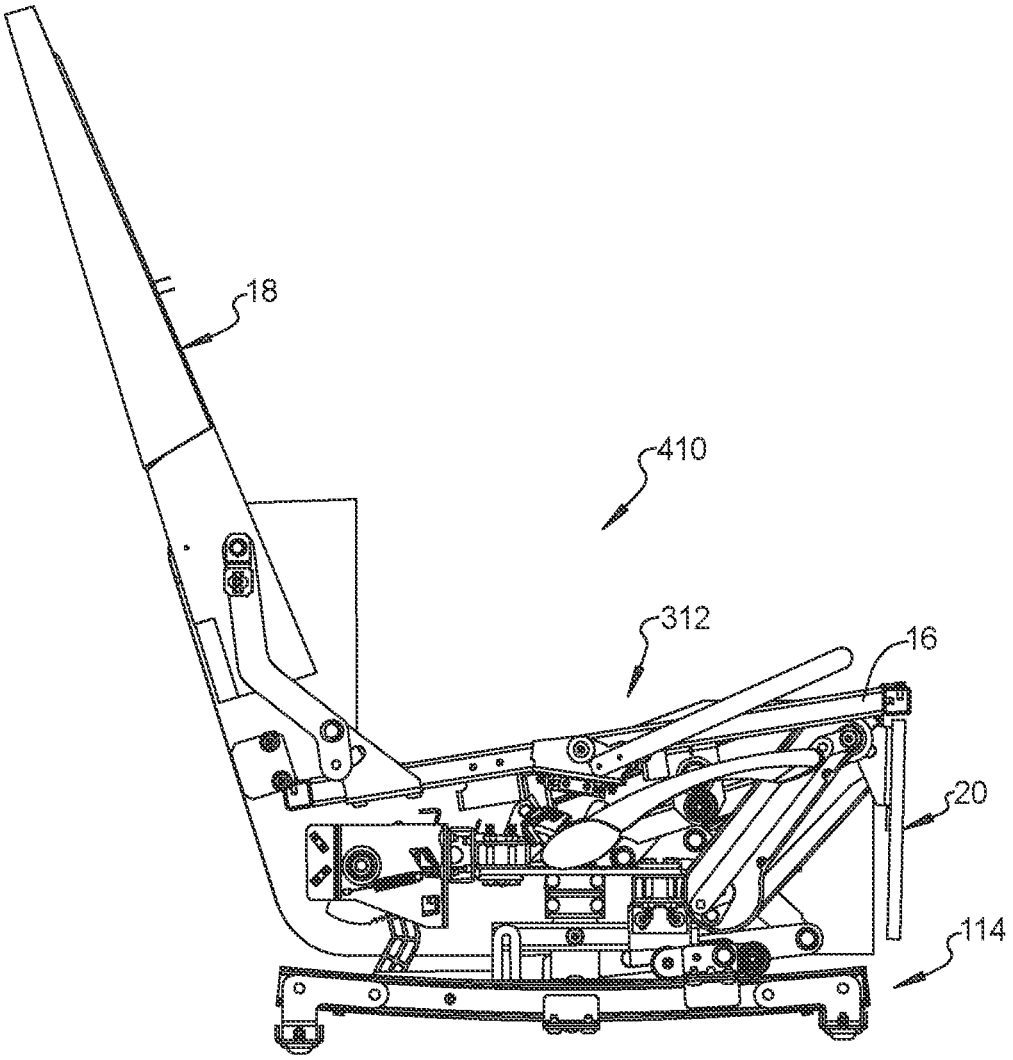
FIG. 5A is a side view of a rocking, reclining and wall-away manual chair mechanism in an upright position.
Figure 5B:
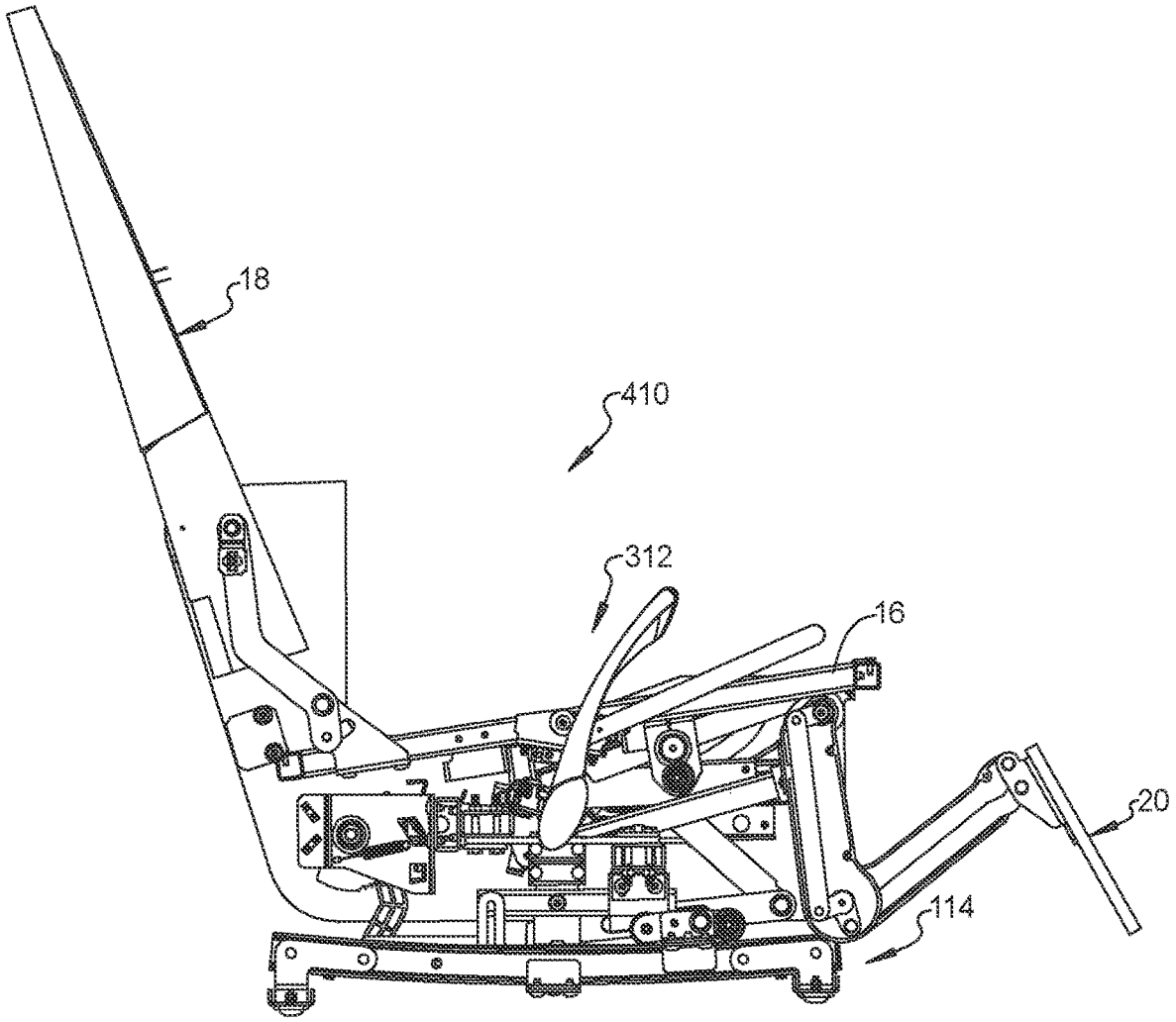
FIG. 5B is a side view of the rocking, reclining and wall-away manual chair mechanism with the leg rest assembly partially extended.
Figure 5C:
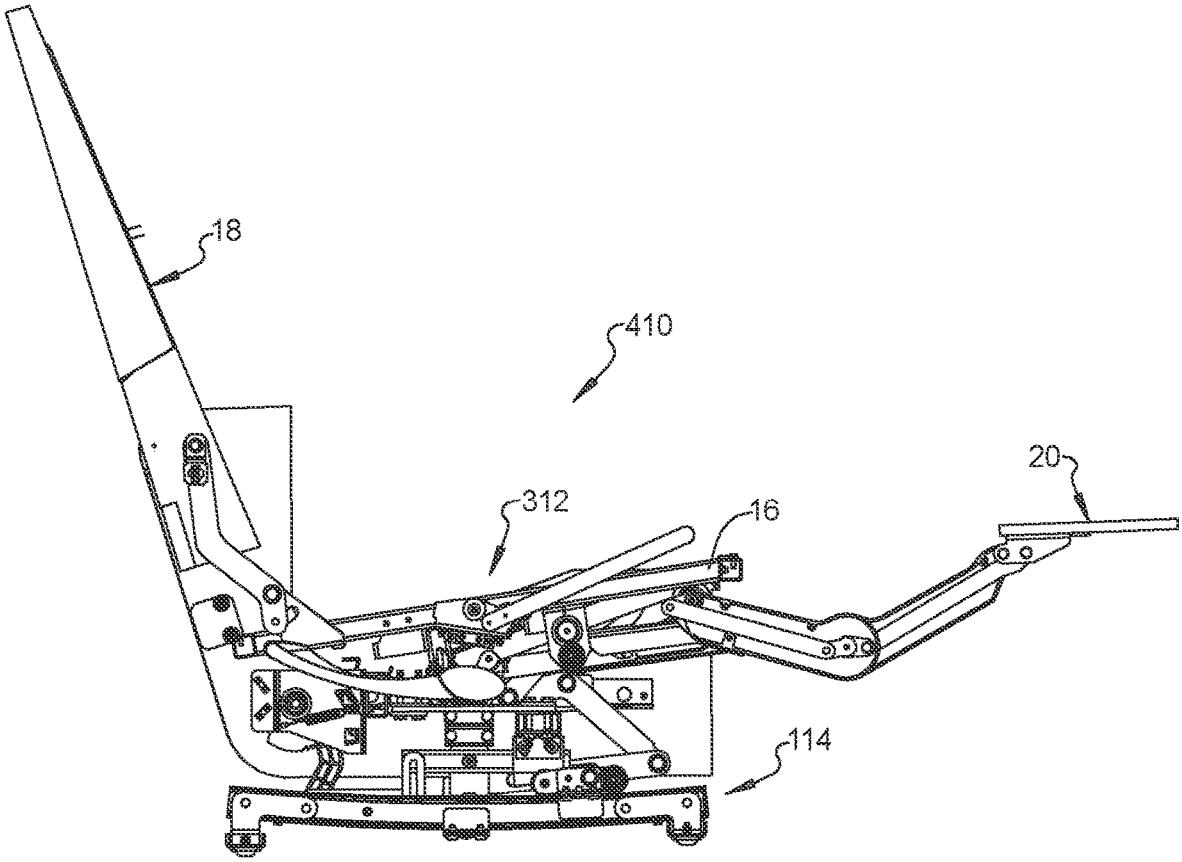
FIG. 5C is a side view of the rocking, reclining and wall-away manual chair mechanism in a leg rest extended position.
Figure 5D:
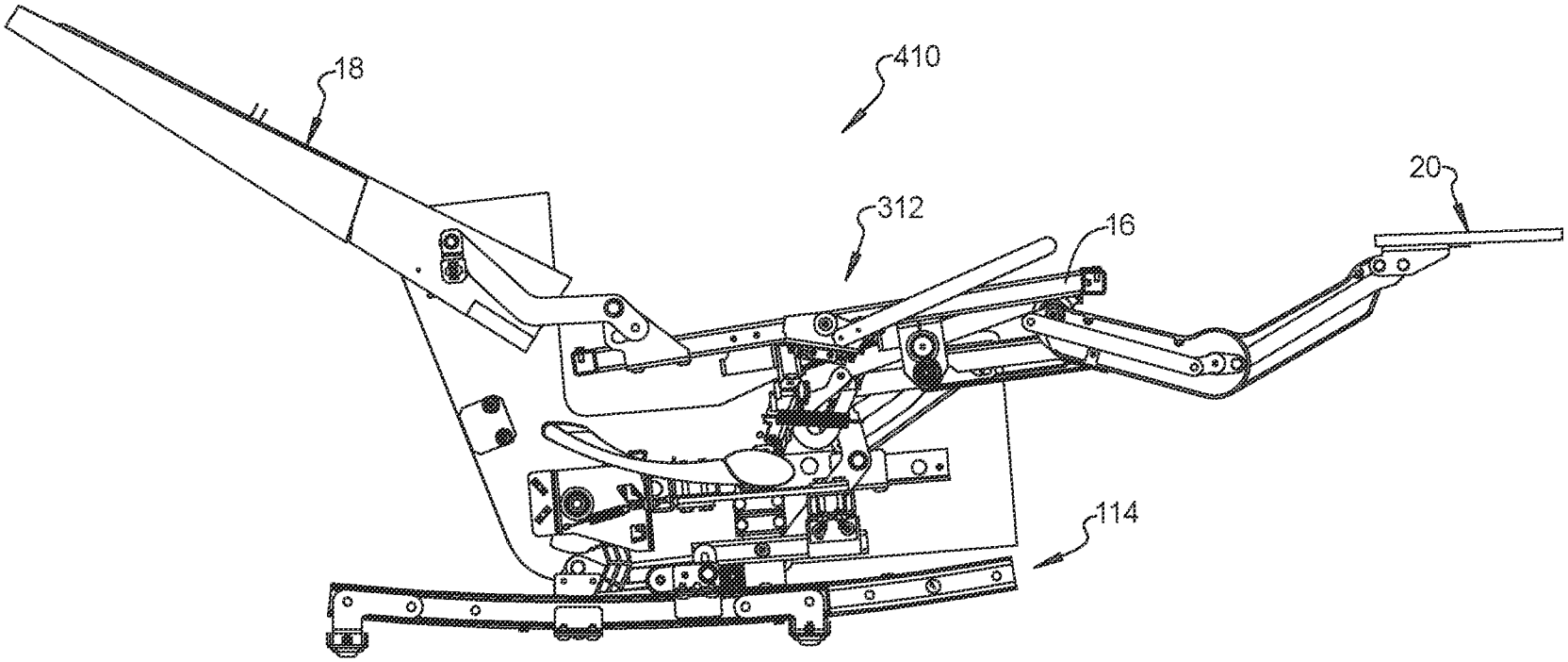
FIG. 5D is a side view of the rocking, reclining and wall-away manual chair mechanism in a seat back reclined and leg rest extended position.

With reference to FIG. 5A, a side view of a rocking, reclining and wall-away manual chair mechanism 410 is shown in an upright position. The chair mechanism 410 includes a manual chair chassis 312 on a wall-away base 114. The manual chair chassis 312 has a seat bottom 16, a reclinable seat back 18, an extendable leg rest 20 and it is capable of rocking or holding in a tilted position. The wall-away base 114 allows the manual chair chassis 312 to stay in a relatively constant distance from a wall or other structure when the seat back 18 of the chair mechanism 410 is reclined. FIG. 5B is a side view of the rocking, reclining and wall-away manual chair mechanism 410 with the leg rest 20 partially extended. FIG. 5C is a side view of the rocking, reclining and wall-away manual chair mechanism 410 with the leg rest 20 in a fully extended position. FIG. 5D is a side view of the rocking, reclining and wall-away manual chair mechanism 410 with the seat back 18 reclined and the leg rest 20 in an extended position. The wall-away manual chair mechanism 410 is also capable of rocking and tilting rearward in the same manner as the embodiment of FIGS. 4A-4E, as discussed above.

Figure 6:
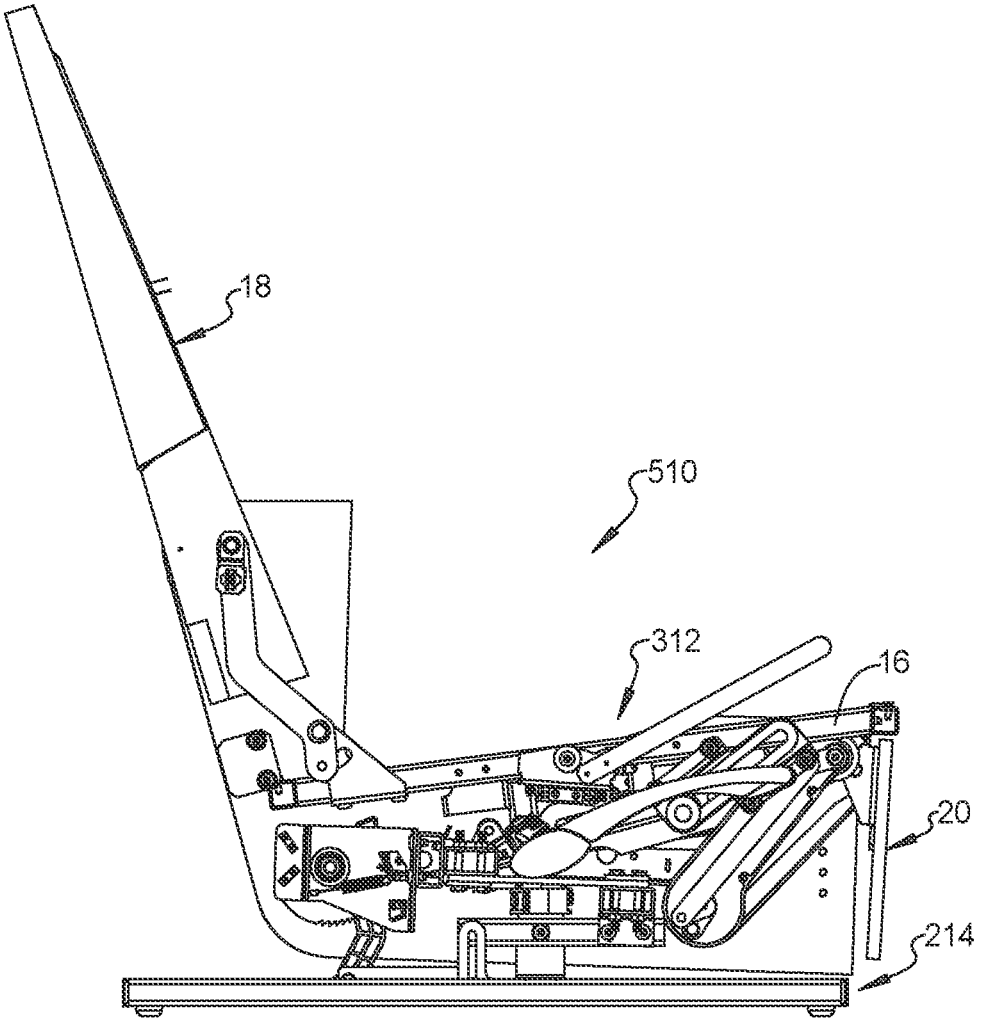
FIG. 6 is a side view of a rocking and reclining manual chair mechanism in an upright position.

With reference to FIG. 6, a side view of a rocking, and reclining manual chair mechanism 510 is shown in an upright position. The chair mechanism 510 includes a manual chair chassis 312 on a pedestal base 214. The manual chair chassis 312 has a seat bottom 16, a reclinable seat back 18, an extendable leg rest 20 and it is capable of rocking or holding in a tilted position. The pedestal base 214 supports the manual chair chassis 312. The rocking and reclining manual chair mechanism 510 is capable of extending the leg rest 20, reclining the seat back 18, rocking and tilting in a same manner as disclosed with reference to the embodiment of FIGS. 4A-4E.

With each of the above disclosed embodiments of the chair mechanism 10, 110, 210, 310, 410, 510 the power chair chassis 12 and the manual chair chassis 312 are interchangeable with the different swivel base 14, wall-away base 114 and the pedestal base 214.

Figure 7A:
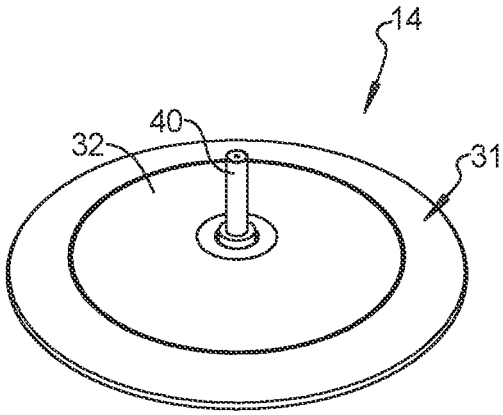
FIG. 7A is a perspective view of a swivel pedestal base assembly.
Figure 7B:
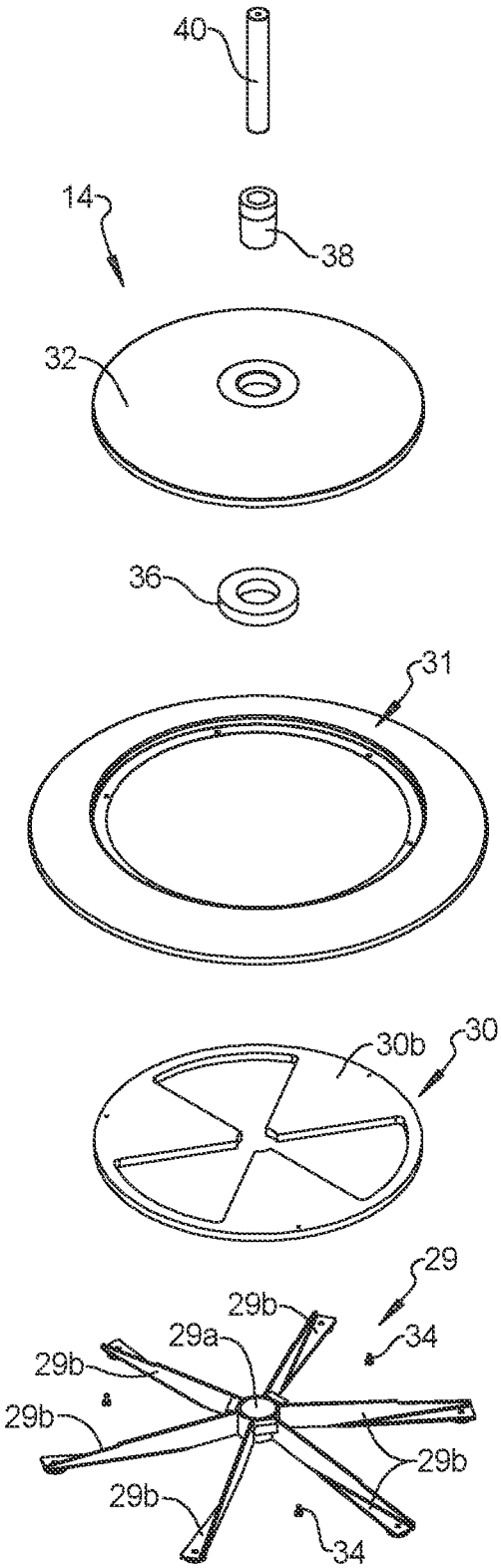
FIG. 7B is an exploded perspective view of the swivel pedestal base assembly.

With reference to FIGS. 7A and 7B, the swivel base 14 will now be described. The swivel base 14 can include a bottom base member 29 having a center cylindrical sleeve 29*a* and a plurality of legs 29*b*. An intermediate base member 30 is disposed above the bottom base member. An outer ring 31 surrounds the intermediate base member 30. A base mount 32 is secured above the intermediate base member 30 by screws 34. A spindle collar 36 can be mounted to the base mount 32. A collar 38 is tapered on an outside diameter and fits into the bore of the center cylindrical sleeve 29*a*. A spindle 40 is welded onto the collar 38 at the bottom of the spindle 40. The base structure 30 and base mount 32 are shown as circular, although other shapes could be used. Each of the chair mechanisms 10, 110, 210, 310, 410, 510 includes a pedestal rocker mount 100 with a cylindrical slide bushing (described later herein) for receiving the spindle 40. One or more height adjustment spacers can be placed on the spindle to adjust the height of the chair mechanism.

Figure 8A:
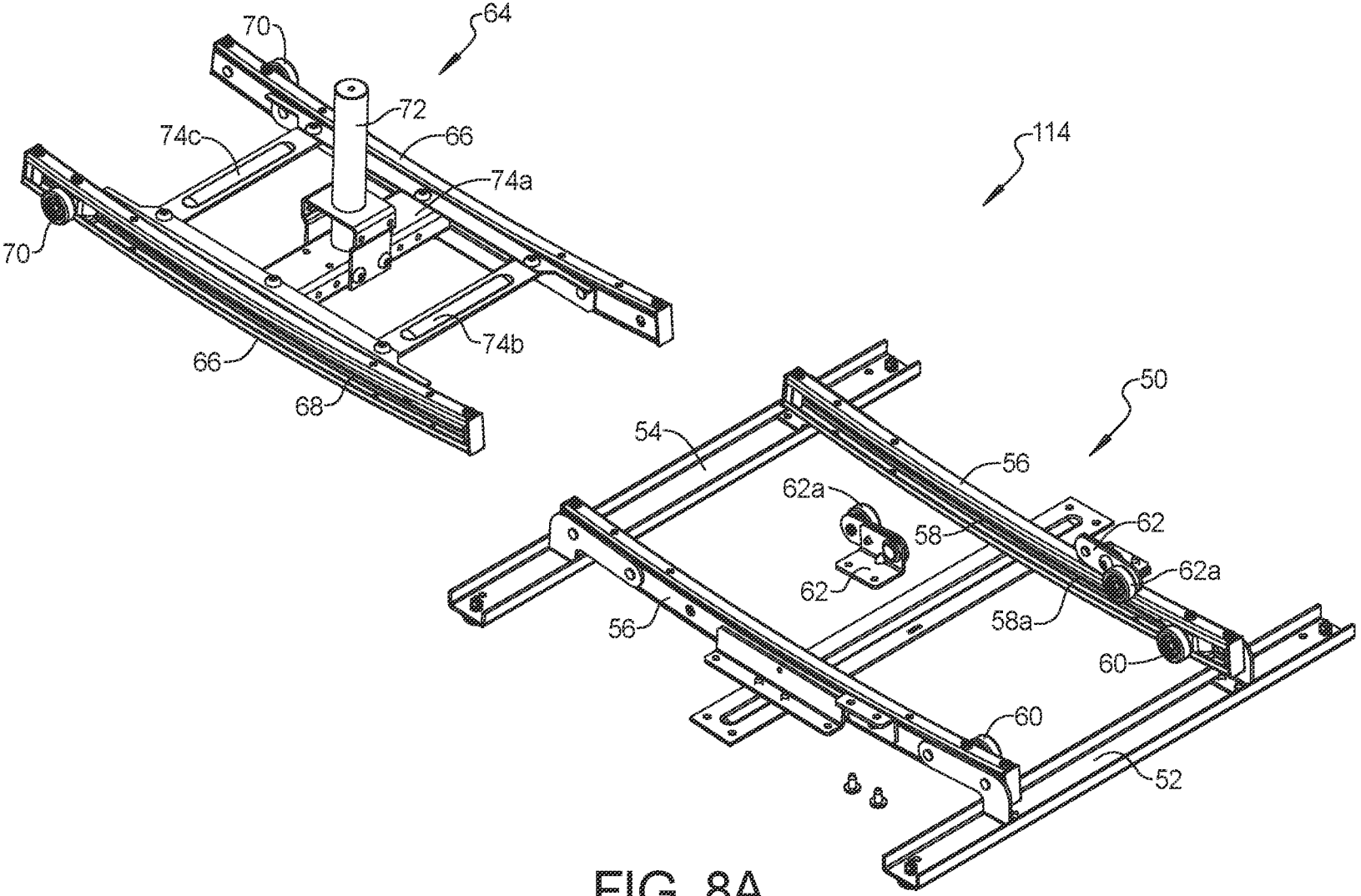
FIG. 8A is an exploded perspective view of a wall-away pedestal base assembly.
Figure 8B:
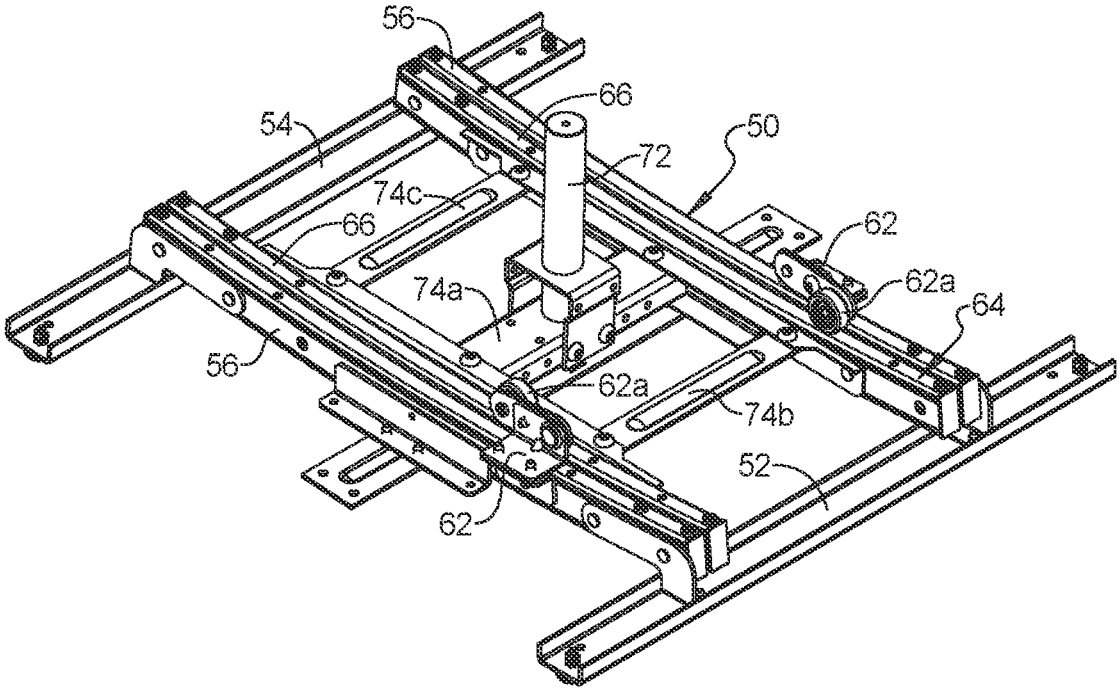
FIG. 8B is a perspective view of the wall-away pedestal base assembly.
Figure 8C:
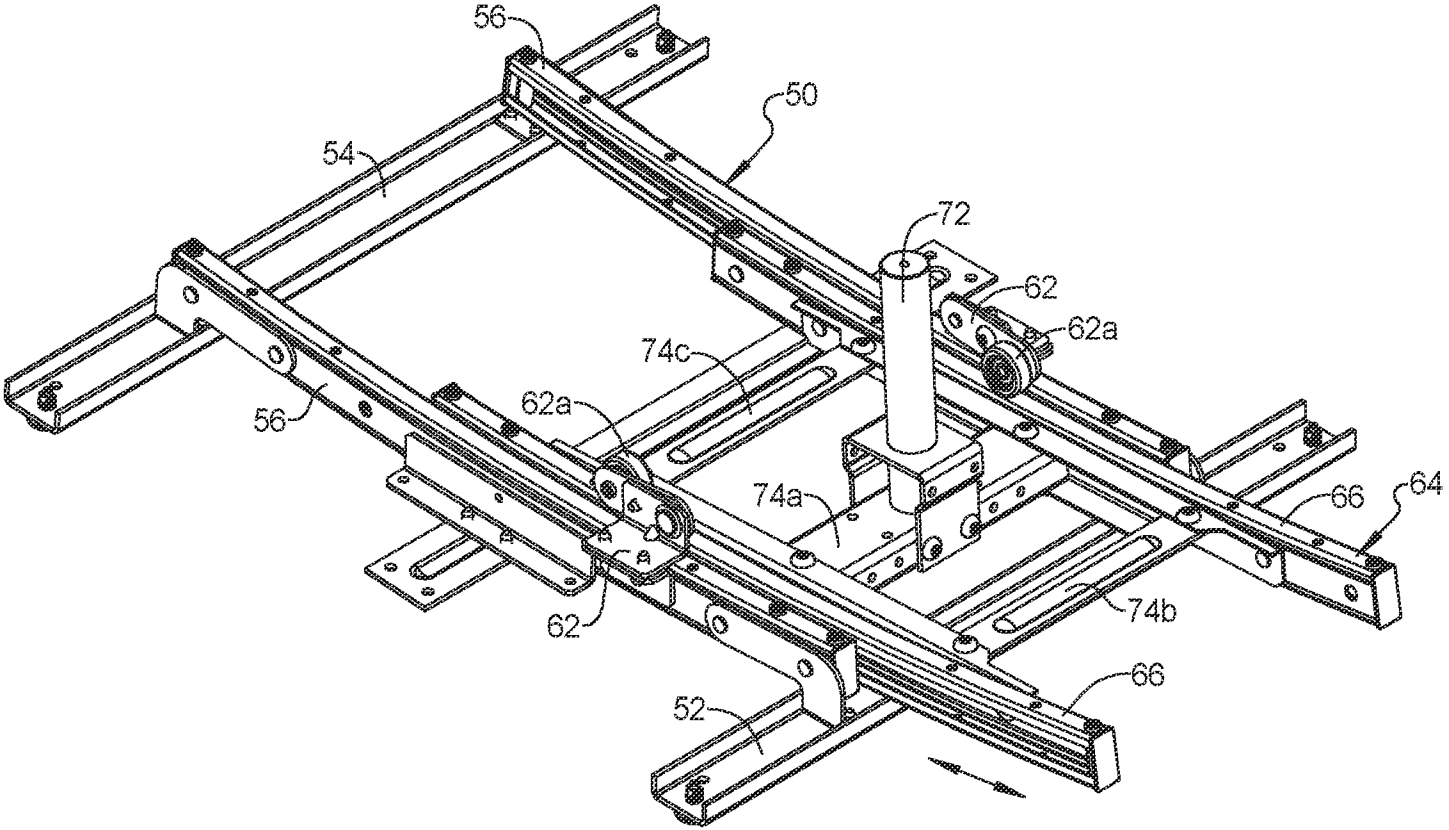
FIG. 8C is an exploded perspective view of a wall-away pedestal base assembly shown in an extended position.

With reference to FIGS. 8A-8C, the wall-away base mechanism 114 will be described. The wall-away base mechanism 114 includes a base assembly 50 including front and rear rails 52, 54 and a pair of side rails 56. The pair of side rails 56 can have a C-shaped channel 58 each with an opening 58*a* facing each other. A forward wheel 60 can be supported exterior to a forward end of the side rails 58. A pair of wheel mounts 62 can be mounted to an upper surface of the side rails 56. The pair of wheel mounts 62 each support a collar 62*a*. A base structure 64 is slidably mounted to the base assembly 50 and includes a pair of side rails 66 having a C-shaped channel 68 with an opening facing away from each other. A pair of rear wheels 70 are mounted to a rearward end of the pair of side rails 66. A spindle 72 is supported by one or more cross bars 74*a*, 74*b*, 74*c* that extend between the pair of side rails 66. As shown in FIGS. 8B and 8C, the pair of side rails 66 are disposed between and adjacent to the pair of side rails 56 of the base assembly 50 and receive the forward wheels 60 therein. The pair of rear wheels 70 are received in the c-shaped channel 58 of the pair of side rails 56. The pair of wheels 62*a* are disposed against an upper surface of the pair of side rails 66 As shown in FIG. 8B, the base structure 64 is supported at a rearward location along the base assembly 50. As shown in FIG. 8C, the base structure 64 is supported at a forward location along the base assembly 50 as would occur when the seat back 18 is in a reclined position. Each of the chair mechanisms 10, 110, 210, 310, 410, 510 includes a pedestal rocker mount 100 with a cylindrical slide bushing (described later herein) for receiving the spindle 72.

Figure 9A:
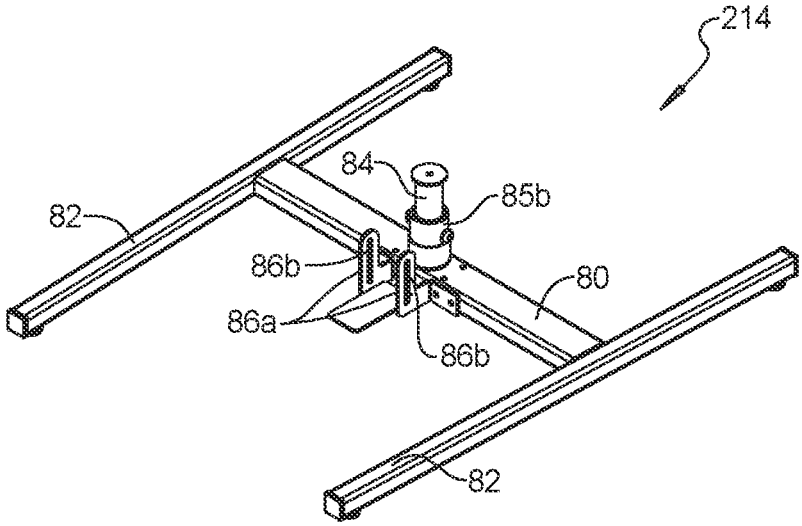
FIG. 9A is a perspective view of a pedestal base assembly.
Figure 9B:
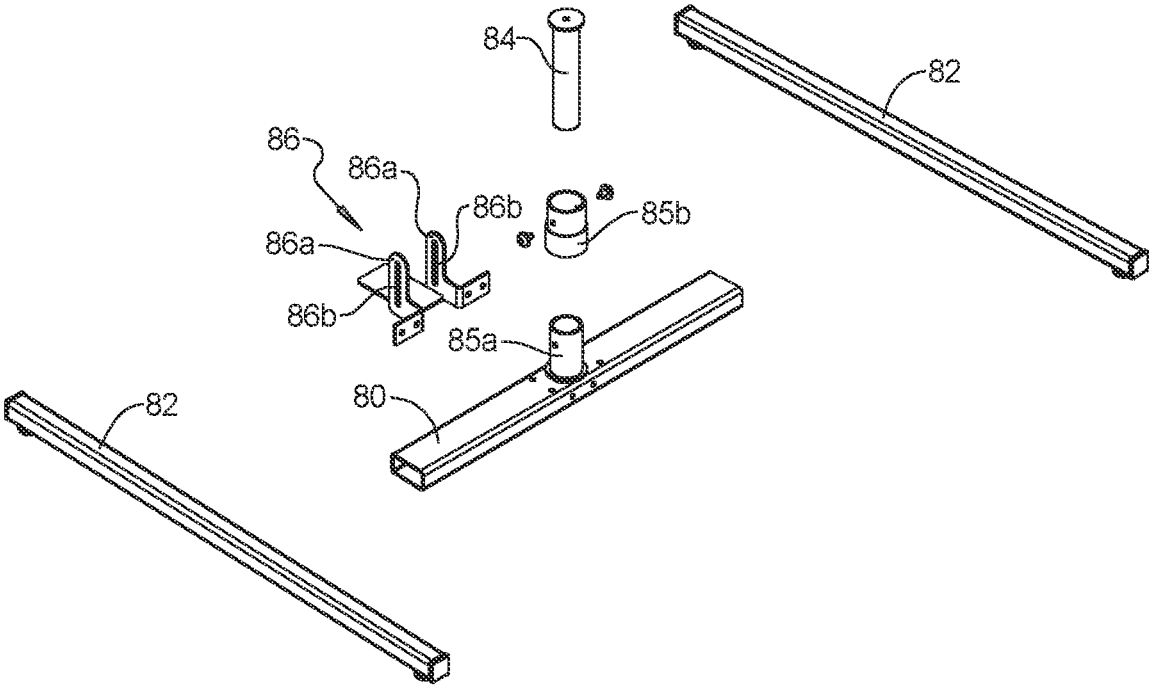
FIG. 9B is an exploded perspective view of the pedestal base assembly.

With reference to FIGS. 9A and 9B, the pedestal base 214 will be described. The pedestal base 214 includes a cross brace member 80 and a pair of side rails 82 connected on opposite ends of the cross brace member 80. A spindle 84 is fixed to the cross brace member 80 by a sleeve 85*a* mounted to the cross brace member 80 and a collar 85*b* mounted to the sleeve 85*a*. A lock plate bracket 86 includes a pair of lock plates 86*a* that are secured to a rear surface of the cross brace member 80 on opposite sides of the spindle 84. Each of the lock plates 86*a* includes an elongated vertical slot 86*b* facing in a lateral direction. Each of the chair mechanisms 10, 110, 210, 310, 410, 510 includes a pedestal rocker mount 100 with a cylindrical slide bushing (described later herein) for receiving the spindle 84.

Figure 10A:
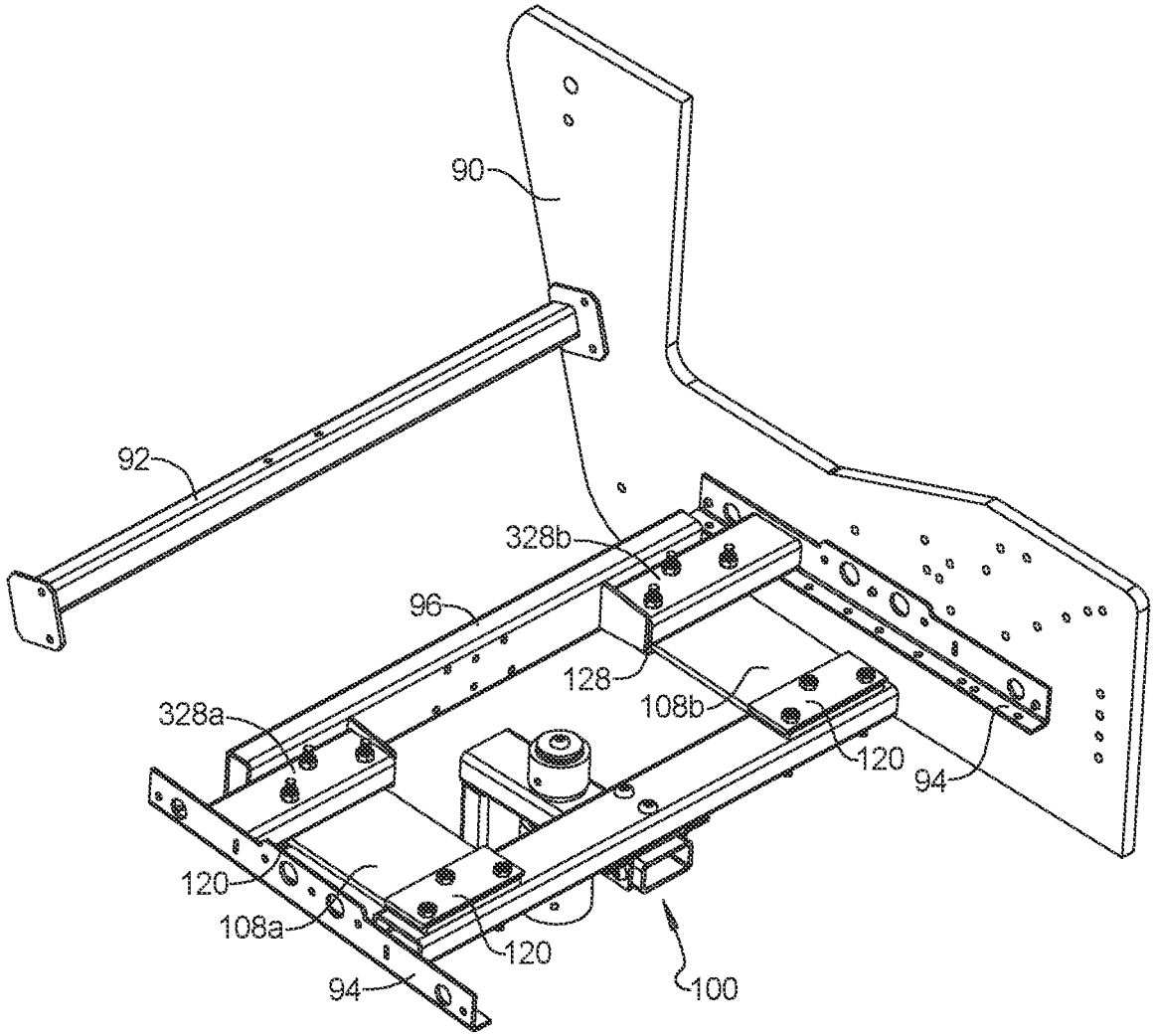
FIG. 10A is a front right perspective view of the frame and support components of the manual chair mechanism.

With reference to FIGS. 10A-10D, the manual chair chassis 312 will be described. As shown in FIG. 10A, the manual chair chassis 312 includes a frame including a pair of siderails 90 (one of which is shown) and a cross brace structure including a rear tube rail 92 extending between a rear portion of the side rails 90, a pair of side brackets 94 mounted to a respective one of the side rails 90 and a center cross tube 96 extending between the pair of side brackets 94. A rocker mount tube 98 is disposed between the pair of side brackets 94 forward of the center cross tube 96. A pedestal rocker mount 100 is mounted below the rocker mount tube 98.

Figure 21:
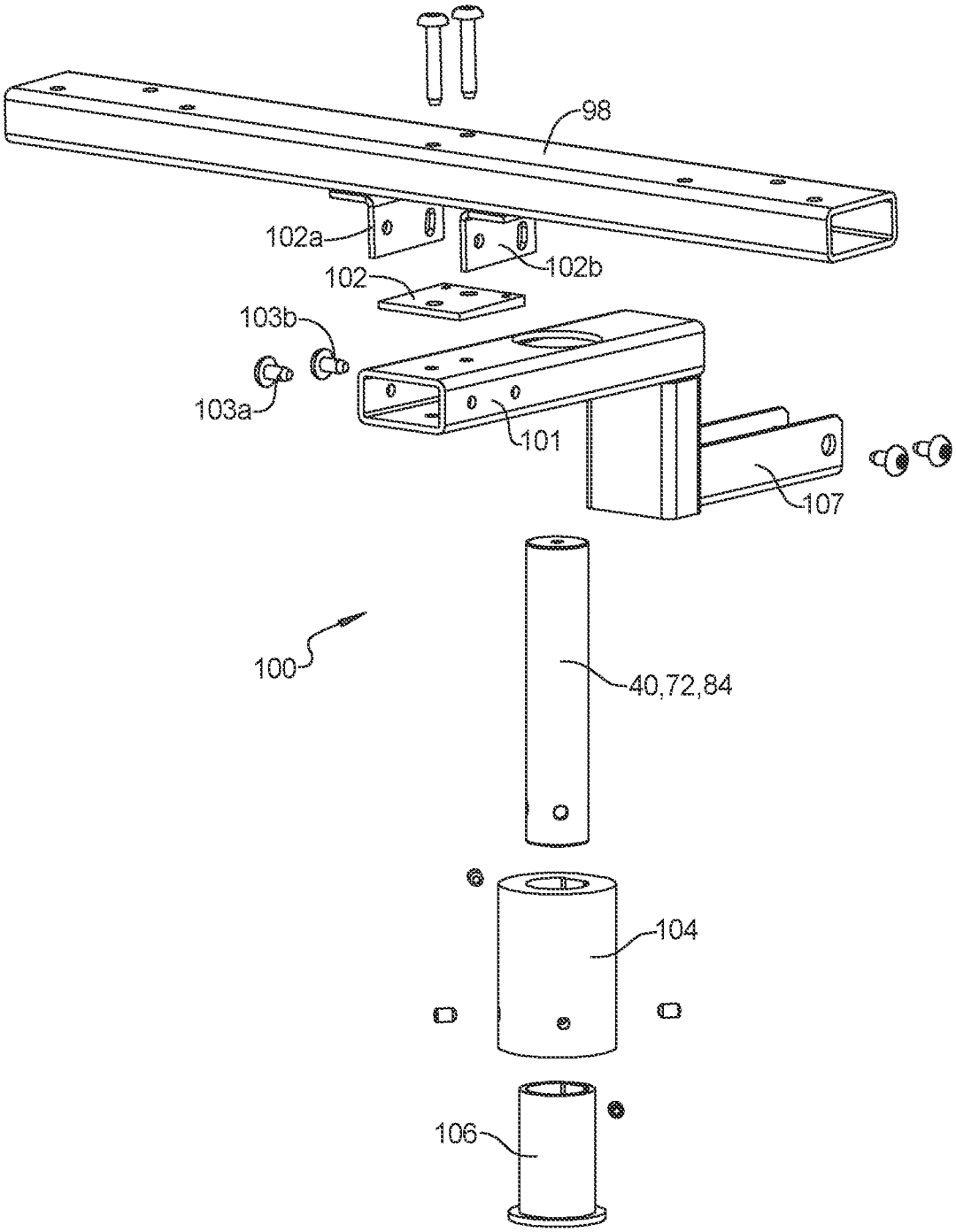
FIG. 21 is an exploded perspective view of a pedestal rocker mount assembly according to the principles of the present disclosure.

With reference to FIG. 21, the pedestal rocker mount assembly 100 includes a mount base 101 that is connected to the rocker mount tube 98 by a pair of brackets 102*a*, 102*b* and fasteners 103*a*, 103*b*. The pedestal rocker mount 100 includes a cylindrical sleeve 104 that is mounted to the mount base 101 and receives a slide bushing 106. A pedestal support mount 107 extends below and rearward from the mount base 101. The spindles 40, 72, 84 of the different pedestal bases 14, 114, 214 are selectively received in the slide bushing 106 to support the manual chair chassis 312 to the different bases.

Figure 22:
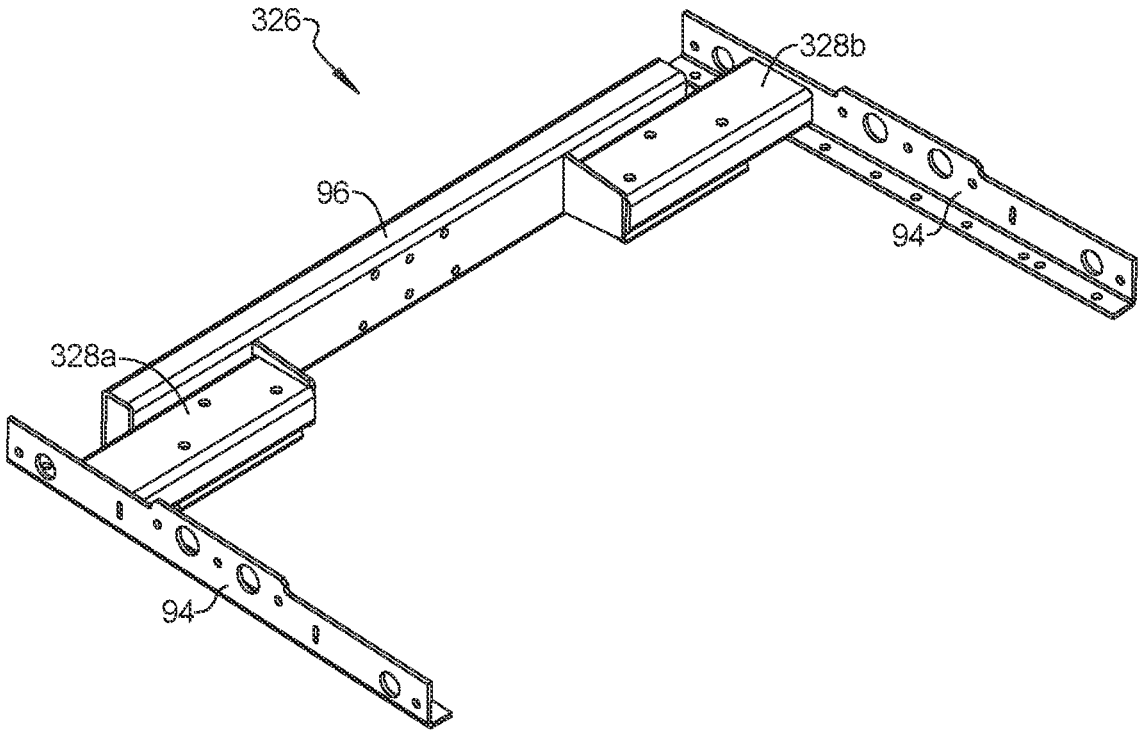
FIG. 22 is a perspective view of a tube center cross sub assembly according to the principles of the present disclosure.

With reference to FIG. 22, the tube center cross sub assembly 326 will now be described. The tube center cross sub assembly 326 includes the center cross tube 96 and the pair of side brackets 94 that are connected to the center cross tube 96 by a pair of spring mount brackets 328*a*, 328*b*.

Returning reference to FIG. 10A, the manual chair chassis includes a pair of leaf springs 108*a*, 108*b* each connected between the pair of spring mount brackets 328*a*, 328*b* and the rocker mount tube 98 by respective pairs of clamp plates 120. Accordingly, the components of the rocking feature are all separate from and mounted above the base.

Figure 10B:
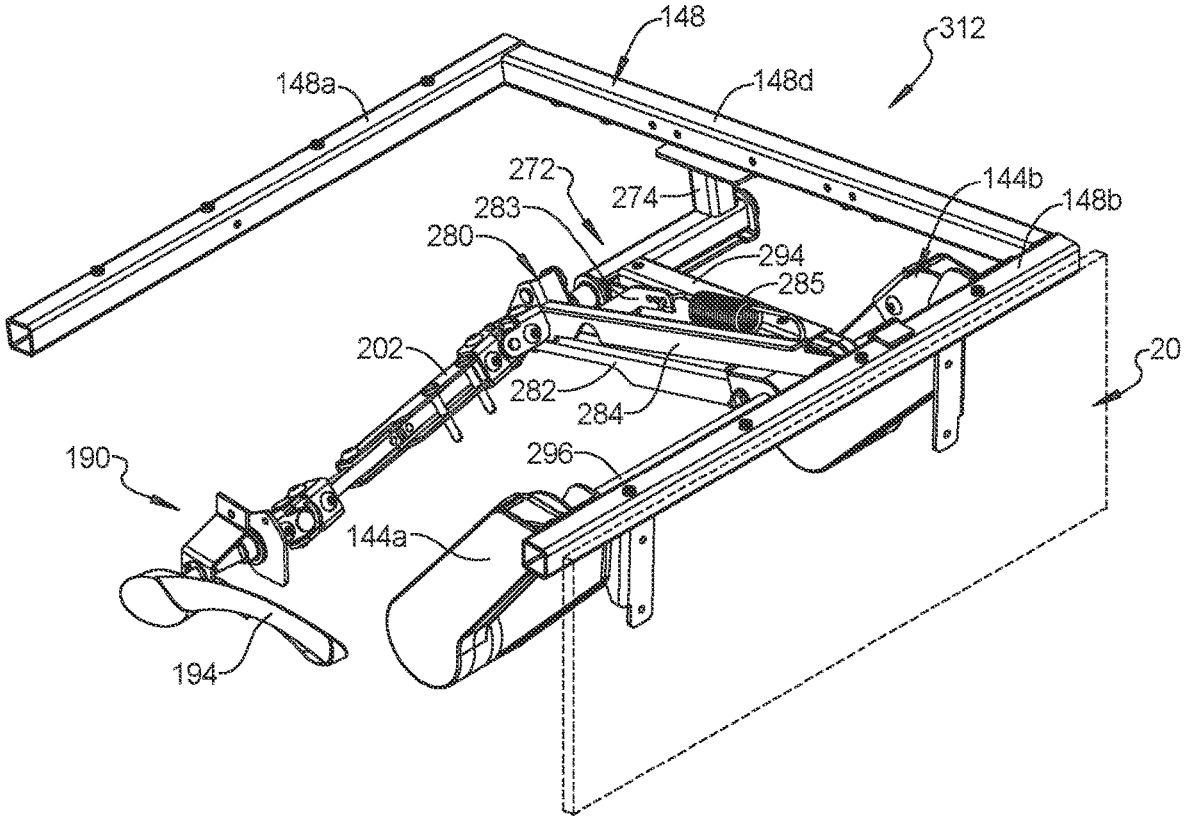
FIG. 10B is a front right perspective view of the leg rest components of the manual chair mechanism.
Figure 10C:
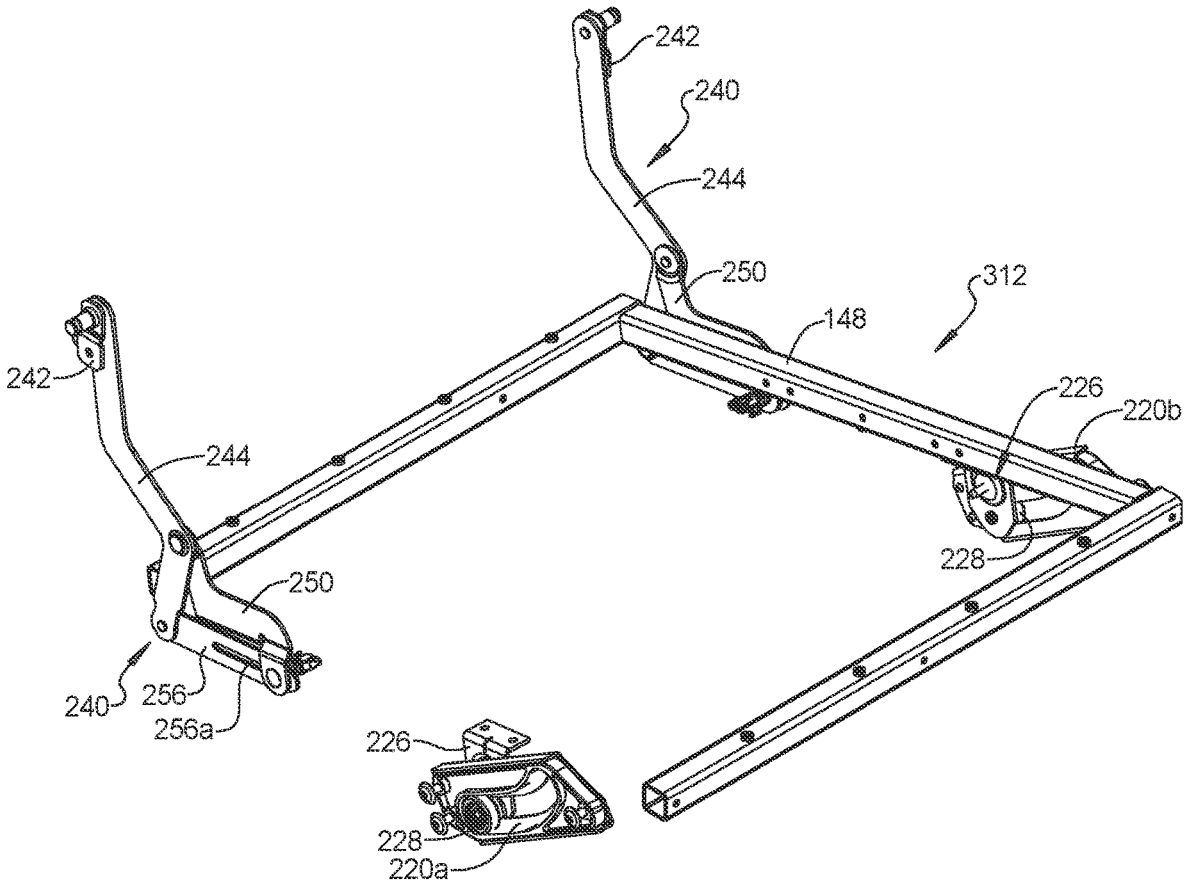
FIG. 10C is a front right perspective view of the leg rest components of the manual chair mechanism.
Figure 10D:
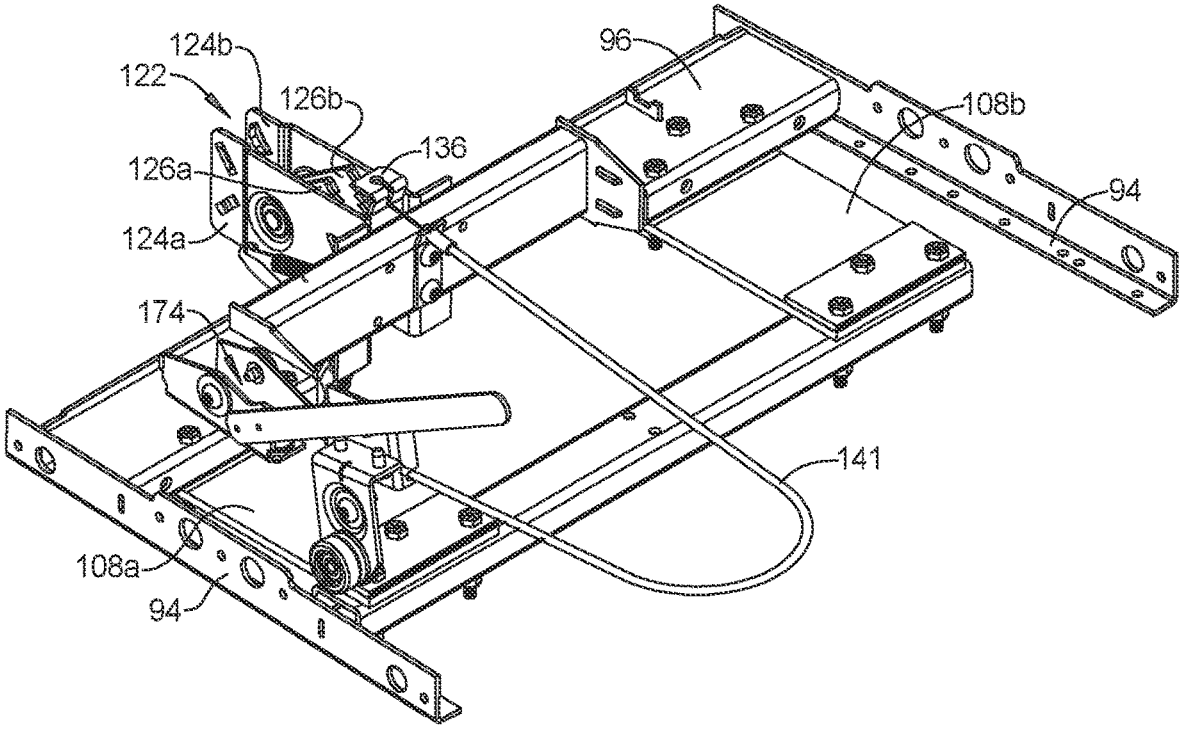
FIG. 10D is a front right perspective view of the tilt components of the manual chair mechanism.
Figure 19A:
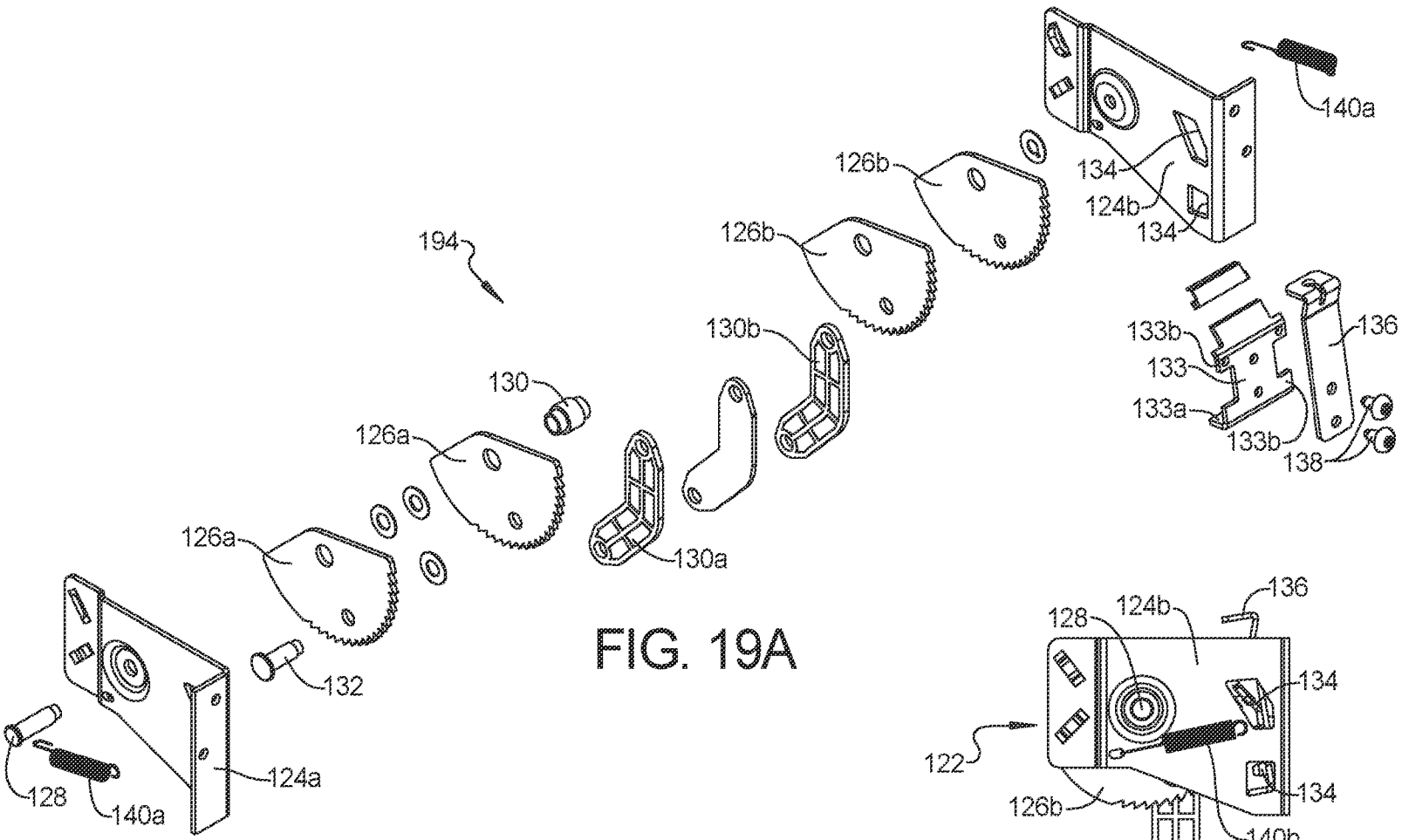
FIG. 19A is an exploded perspective view of a rotary pawl rack assembly according to the principles of the present disclosure.
Figure 19B:
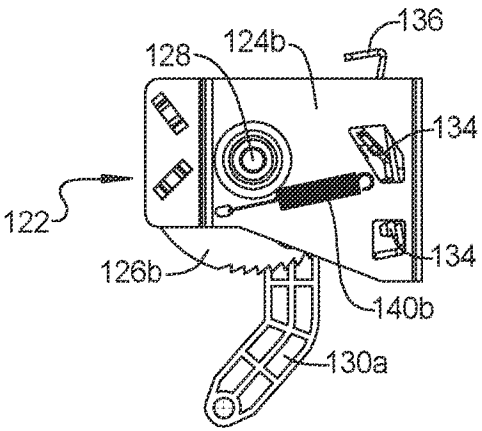
FIG. 19B is a side plan view of the rotary pawl rack assembly according to the principles of the present disclosure.

With reference to FIG. 10D, a rotary pawl rack assembly 122 is mounted to a rear surface of the center cross tube 96. With reference to FIGS. 19A and 19B, the rotary pawl rack assembly 122 includes a pair of rack mount plates 124*a*, 124*b* that support a first pair of rotary pawl racks 126*a* and a second pair of rotary pawl racks 126*b* on a swing rivet 128. A spacer bushing 130 is provided between the first and second pairs of rotary pawl racks 126*a*, 126*b*. A pair of rack connectors 130*a*, 130*b* are connected to the rack mount plates 126*a*, 126*b*, by a rivet 132. A pawl 133 is engageable with the first and second pair of rotary pawl racks 126*a*, 126*b* and is pivotally mounted between the rack mount plates 124*a*, 124*b*, by arms 133*a*, 133*b* that are received in corresponding apertures 134 in the rack mount plates 124*a*, 124*b*. A cable end bracket 136 is mounted to the pawl 132 by screws 138. A pair of extension springs 140*a*, 140*b* are connected to an aperture in the rack mount plates 124*a*, 124*b* and apertures 139 in the arms 133*b* to draw the pawl 132 toward an engaged position with the teeth of the first and second pair of rotary pawl racks 126*a*, 126*b*.

The rack mount plates 124*a*, 124*b* are mounted to the center cross tube 96. A distal end of the pair of rack connectors 130*a*, 130*b* of the rotary pawl rack assembly 122 are connected to a rear end of the pedestal support mount 107 of the pedestal rocker mount assembly 100 (See FIGS. 21 and 4A). The rotary rack pawl assembly 122 secures the manual chair chassis 312 in a selected tilted position. A cable 141 is connected to the cable end bracket 136 and can be pulled to release the pawl 133 from engagement with the rotary pawl racks 126*a*, 126*b*. With reference to FIG. 10D, the cable 141 is connected to a tilt lever assembly 174 that is mounted to a side seat tube 148*c* (see FIG. 4A) of the tube seat frame 148. The rocking feature is enabled when the rotary pawl rack assembly 122 is disengaged and independent of whether the seat back 18 is reclined or the leg rest 16 is extended.

Figure 20A:
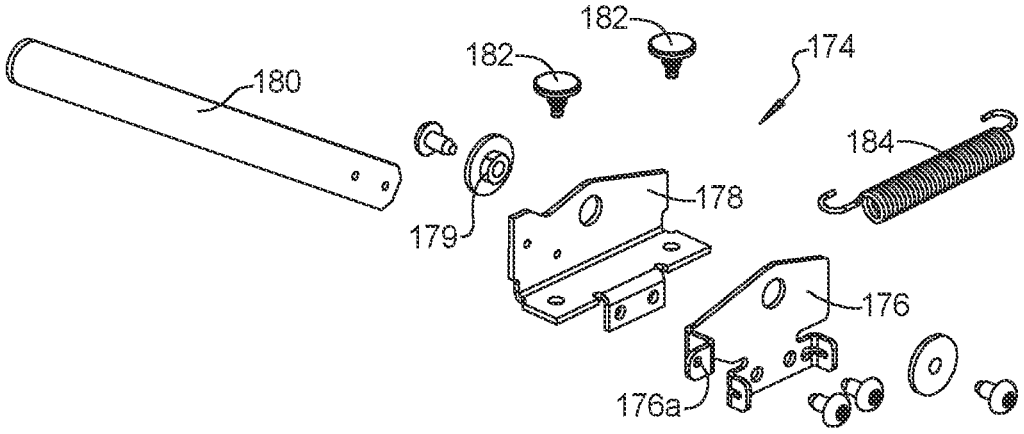
FIG. 20A is an exploded perspective view of a tilt lever assembly according to the principles of the present disclosure.
Figure 20B:
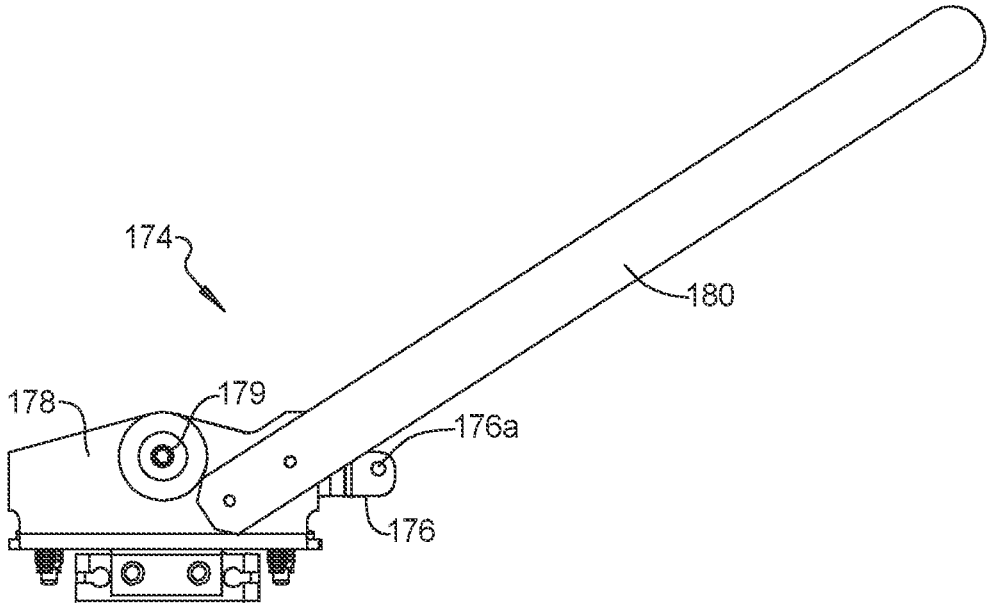
FIG. 20B is a side plan view of the tilt lever assembly according to the principles of the present disclosure.

With reference to FIGS. 20A and 20B, the tilt lever assembly 174 includes a tilt over center lever 176 and a tilt lever over center swing 178 that are pivotally mounted to the side seat tube 148*c* via a pivot 179. A tilt activation lever 180 is connected to the tilt lever over center swing 178. A pair of stop pads 182 are mounted to the tilt lever over center swing 178. The stop pads 182 engage an underside of the side seat tube 148*c*. The tilt over-center lever 176 has an aperture 176*a* that is connected to an over-center toggle spring 184 which biases the tilt over center lever 176 to an engaged or disengaged position once the tilt over-center lever 176 is past an over-center position.

With continued reference to FIG. 10B, the leg rest 20 is supported by a pair of leg rest arm assemblies 144*a*, 144*b*. With reference to FIG. 14, a leg rest arm assembly 144*a* includes a leg rest mount pivot 146 that is connected to a seat frame 148 and pivotally supports an upper lever 150, an upper arm housing 152 and an upper housing cover 154 via an upper housing drive link 156 and a first drive hub 158. A second drive hub 160 is supported at a second end of the lever arm 150 and is connected to a lower lever 162 via a drive plate stud 164. The lower lever 162 supports a lower housing 166 and a lower housing cover 168 that are connected to a leg rest deck mount 170 by one or more rivets. The upper housing cover 154 can be connected to the upper housing 152 by a plurality of fasteners and the lower cover 168 can be connected to the lower housing 166 by a plurality of fasteners. As the leg rest arm assemblies 144*a*, 144*b* are articulated in a forward direction, the leg rest deck mount 170 is pivoted to a generally horizontal position by pivoting about an upper pivot point 170*a* and being driven by a lower connection point 170*b* to the upper lever 162. It is noted that the leg rest arm assembly 144*b* is a mirror image of the leg rest arm assembly 144*a*.

Figure 11:
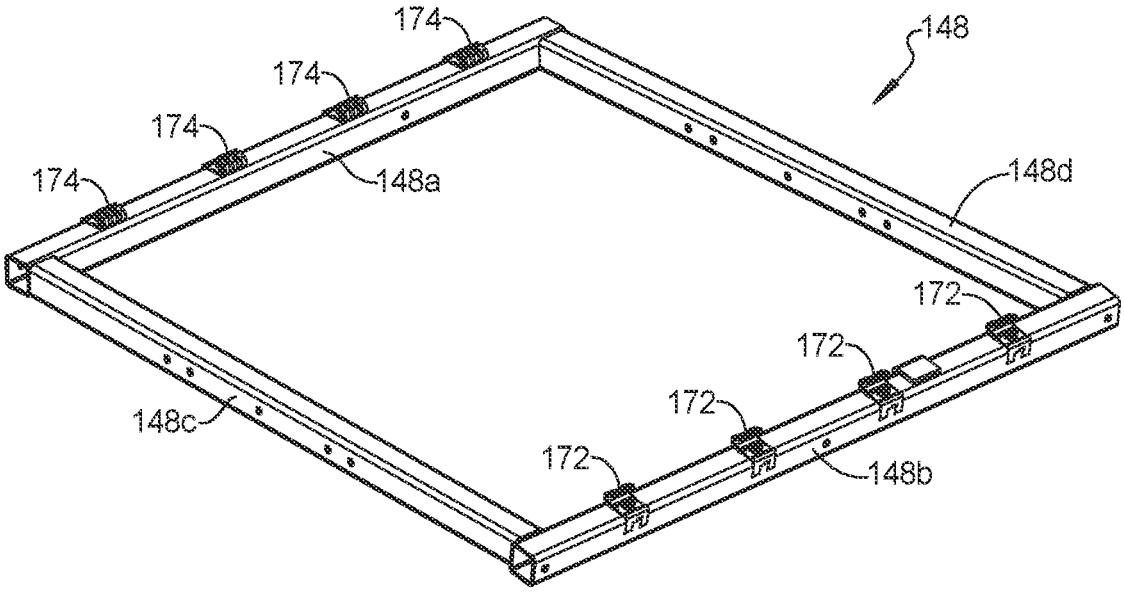
FIG. 11 is a perspective view of the tube seat subassembly according to the principles of the present disclosure.

With reference to FIG. 11, the tube seat frame 148 includes a rear seat tube 148*a*, a front seat tube 148*b* and a pair of side seat tubes 148*c*, 148*d*. A plurality of anchor clips 172 are mounted to the rear seat tube 148*a* and the front seat tube 148*b*. Seat springs (not shown) can be mounted to the anchor clips 172 as is known in the art.

Figure 17A:
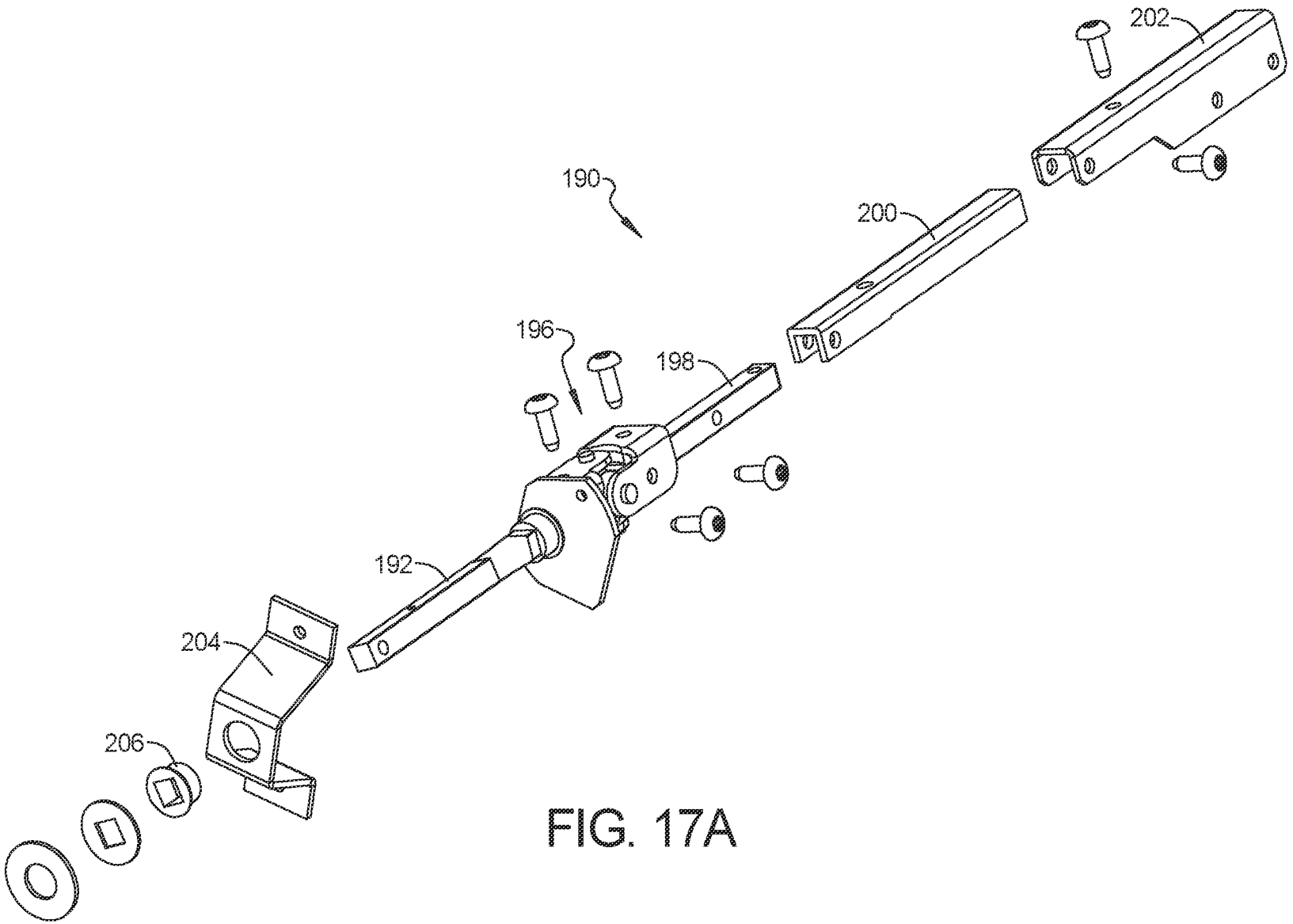
FIG. 17A is an exploded perspective view of a body drive rod assembly according to the principles of the present disclosure.
Figure 17B:
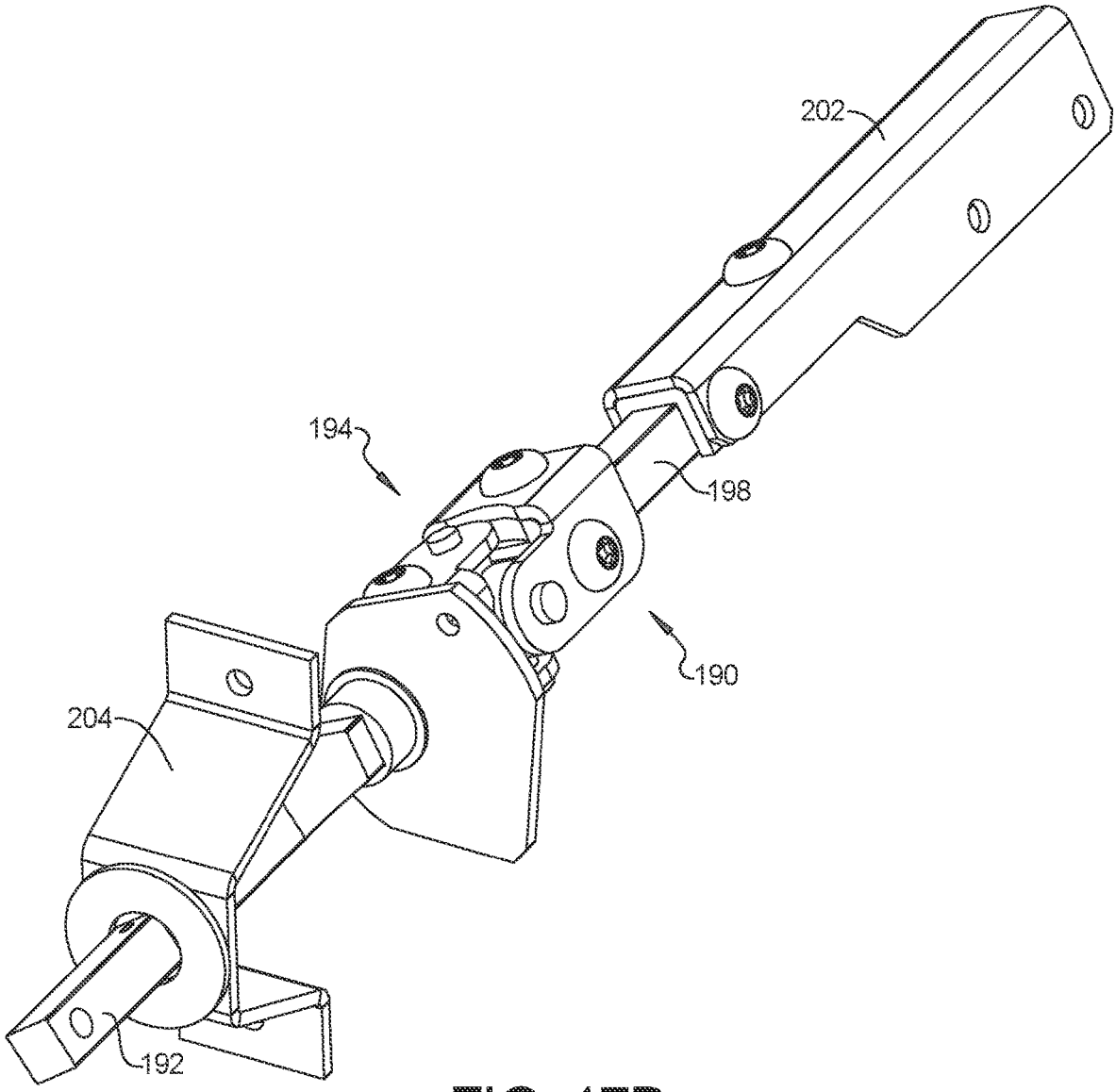
FIG. 17B is a perspective view of a body drive rod assembly according to the principles of the present disclosure.

With continued reference to FIG. 10B, a handle 194 is connected to a body drive rod assembly 190 extends through an aperture in the side rail (not shown). With reference to FIGS. 17A and 17B, the seat drive rod assembly 190 includes a drive rod shaft 192 that is connected to the handle 194 (shown in FIG. 10B) at one end and to a U-joint yoke 196 at another end. The U-joint yoke 196 is connected to a drive rod 198 that is received in a yoke spacer 200 and a yoke slide 202. The drive rod shaft 192 is rotatably supported within a drive rod mount 204 by a bearing 206.

Figure 16:
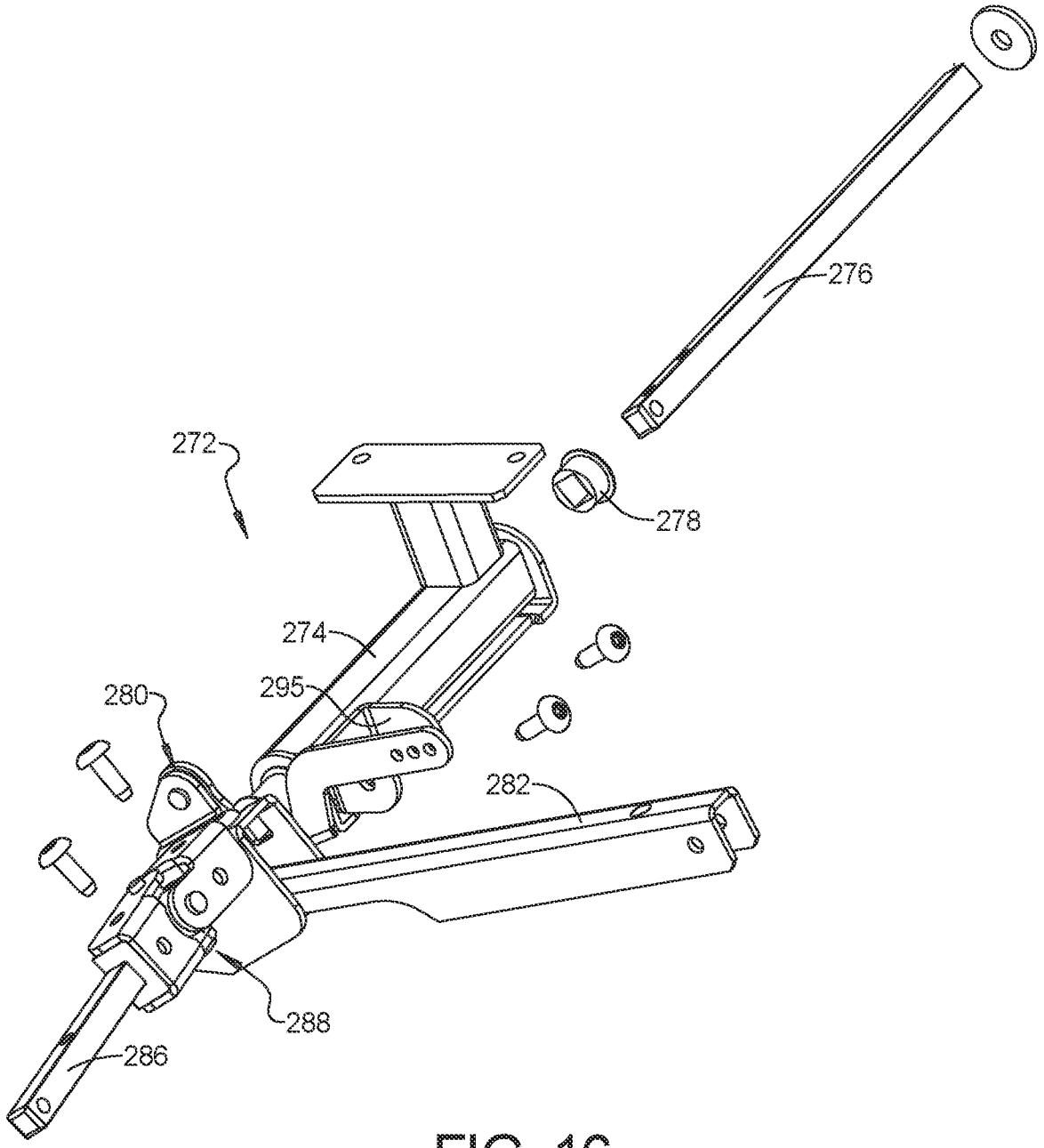
FIG. 16 is a perspective view of a seat drive rod assembly according to the principles of the present disclosure.

With reference to FIG. 10B, a seat drive rod assembly 272 is shown drivingly connected to the yoke slide 202 of the body drive rod assembly 190. As shown in FIG. 16, the seat drive rod assembly 272 includes a seat drive mount assembly 274 that connects to the side seat tube 148*d* of the tube seat sub assembly 148 of FIG. 10B. A seat assembly drive rod 276 is supported by the seat drive mount assembly 274 and extends through a square hole bearing 278 and is connected to a leg rest lever toggle assembly 280. The leg rest lever toggle assembly 280 is supported by a nylon bearing. The leg rest lever toggle assembly 280 is connected to a link arm 282 that is connected to a draw bar 296 that is connected to the pair of leg rest arm assemblies 144*a*, 144*b*. The leg rest lever toggle assembly 280 further include a leg rest spring arm 283 that is connected to an over-center toggle spring 285 that is connected to a bracket on the front tube 148*b* of the tube seat subassembly 148. A spacing link 284 further supports the seat drive rod assembly 272 to a front tube of the 148*b* of the tube seat sub assembly 148. The seat assembly drive rod 276 is connected to a drive rod shaft 286 by a U-joint yoke 288 and yoke spacer 290. The seat assembly drive rod shaft 286 is connected to the yoke slide 202 of the body drive rod assembly 190 as shown in FIG. 10B.

Figure 18A:
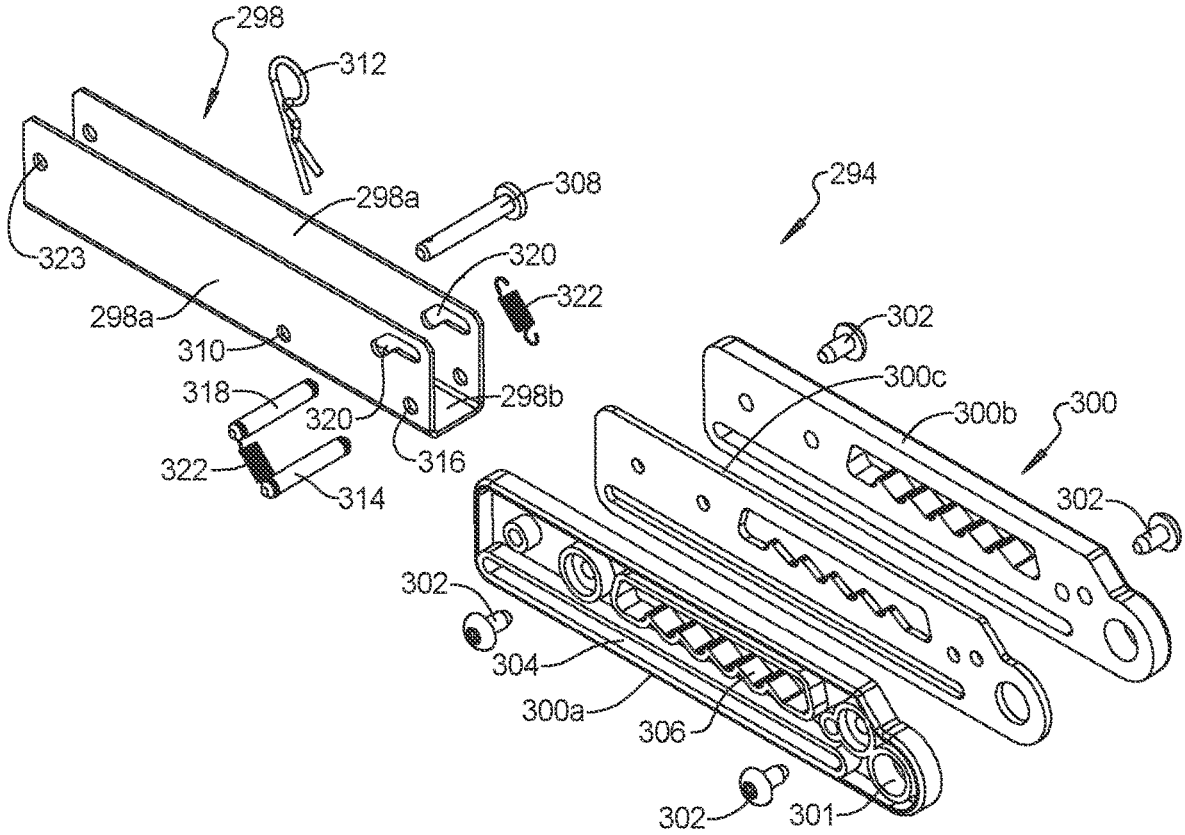
FIG. 18A is an exploded perspective view of a leg rest slide notch mechanism according to the principles of the present disclosure.
Figure 18B:
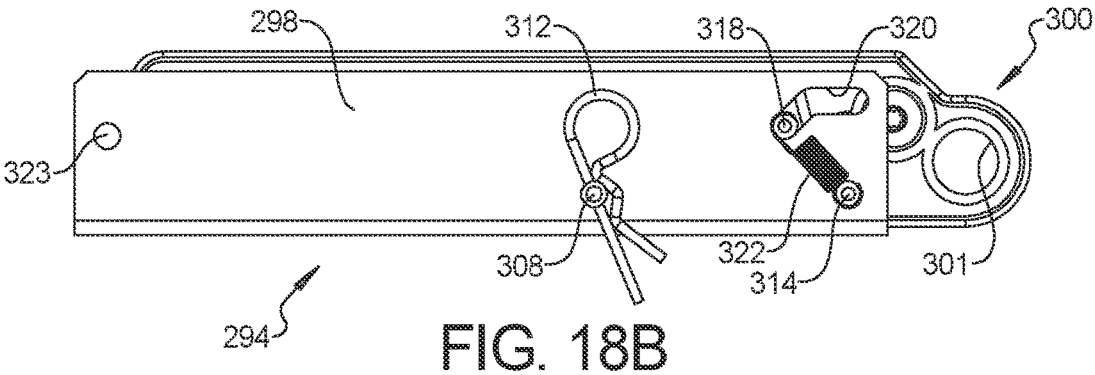
FIG. 18B is a perspective view of the leg rest slide notch mechanism according to the principles of the present disclosure.

With reference to FIGS. 18A and 18B, an exploded perspective view of a leg rest slide notch mechanism 294 is shown. As shown in FIG. 10B, the leg rest slide notch mechanism 294 extends between a draw bar 296 connected to the two leg rest assemblies 144*a*, 144*b* at a forward end and to a mounting bracket 295 of the seat drive rod assembly 272 at a rearward end. The leg rest slide notch mechanism 294 includes a leg rest slide yoke 298 that has a U-shaped cross-section including a pair of sidewalls 298*a* and a connecting web 298*b*. A leg rest notch slide assembly 300 includes a first leg rest notch slide 300*a*, a second leg rest notch slide 300*b* and a third leg rest notch slide plate 300*c* sandwiched between the first leg rest notch slide 300*a* and the second leg rest notch slide 300*b*. The leg rest notch slide assembly 300 can be secured together with screws 302 and includes a forward aperture 301 connected to the drawbar 296. The leg rest notch slide assembly 300 includes an elongated slot 304 and a notched slot 306. An actuator pin 308 is received through a first pair of apertures 310 in the sidewalls 298*a* and through the elongated slot 304 in the leg rest notch slide assembly 300. A hairpin clip 312 can be used to secure the actuator pin 308 in the first pair of apertures 310. A first spring pin 314 is received through a second pair of apertures 316 in the sidewalls 298*a* and through the elongated slot 304 in the leg rest notch slide assembly 300. A second spring pin 318 is received through a pair of cam slots 320 in the sidewalls 298*a* and through the notched slot 306 in the leg rest notch slide assembly 300. A pair of springs 322 can engage opposite ends of the each of the first and second spring pins 314, 318 to bias them toward one another. A pair of rear apertures 323 extend through a rear portion of the leg rest slide yoke 298 for connection to the leg rest toggle assembly 280.

Figure 13:
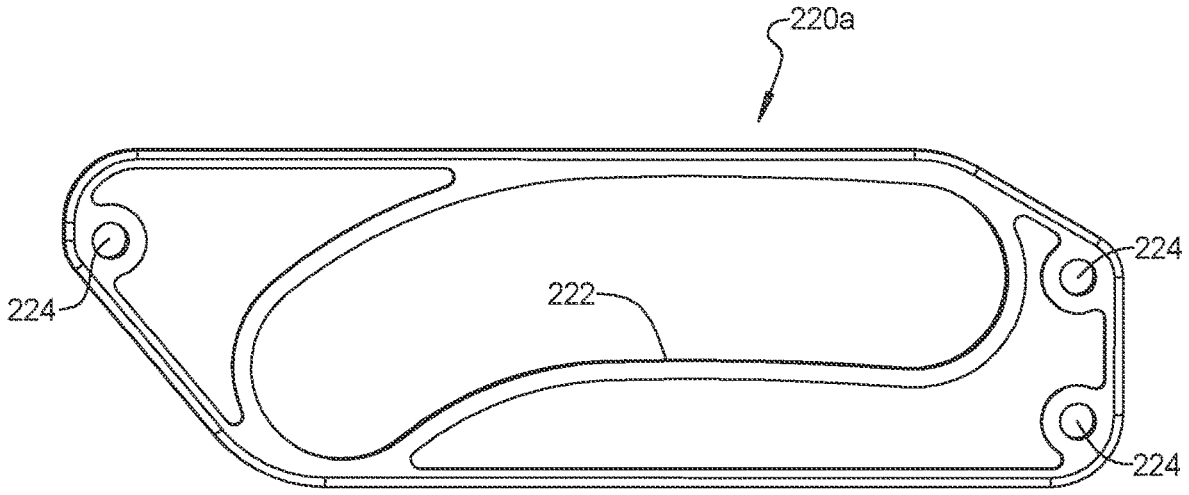
FIG. 13 is a side plan view of a seat ramp according to the principles of the present disclosure.

With reference to FIG. 10C, a pair of seat ramps 220*a*, 220*b* are mounted to respective side rails 90 (removed for clarity). As shown in FIG. 13, the seat ramp 220*a* is shown including an elongated curved slot 222 and a plurality of mounting apertures 224 for receiving fasteners for mounting the seat ramps 220*a*, 220*b* to the side rails 90.

Figure 12:
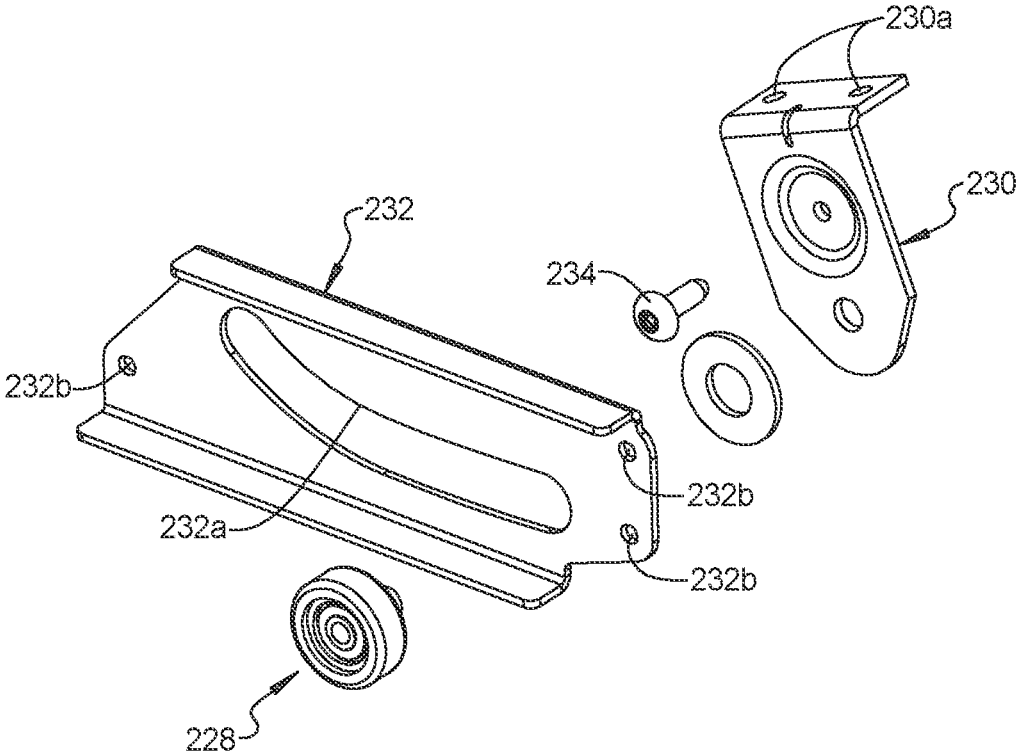
FIG. 12 is an exploded perspective view of a front roller guide according to the principles of the present disclosure.

With reference to FIGS. 10C, a pair of roller guides 226 support a radial bearing 228 in engagement with the elongated curved slot 222 of the seat ramps 220*a*, 220*b*. With reference to FIG. 12, the radial bearing 228 is rotatably supported on a front slide mount bracket 230. The front slide mount bracket 230 is mounted to the seat frame 148 by upper flange mounting holes 230*a*. The radial bearing 228 extends through an elongated curved groove 232*a* in a seat ramp mount 232 that is mounted to the seat ramp 220*a* via mounting apertures 232*b* which align with mounting holes 224 of the seat ramp 220*a*. Accordingly, the front slide mount bracket 230 and bearing 228 engage with the seat ramps 220*a*, 220*b* and the seat ramp mounts 232 to guide the seat tube 148 relative to the side rails 90 when the seat chassis is reclined.

Figure 15:
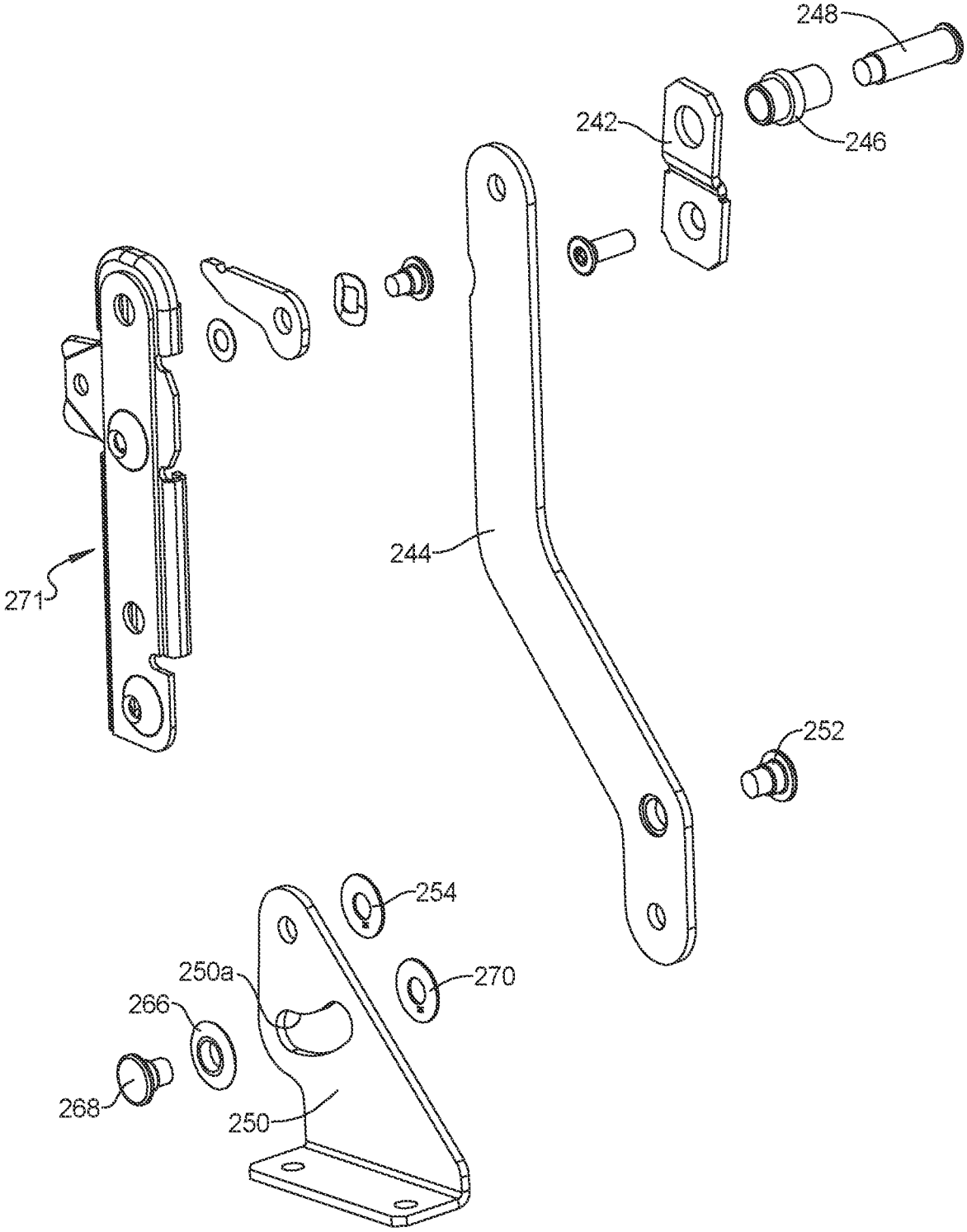
FIG. 15 is an exploded perspective view of a rear seat swing assembly according to the principles of the present disclosure.

With reference to FIG. 10C, a rear seat swing assembly 240 is shown supporting a rear end of the seat tube 148 to the side rails 90 (not shown). As shown in FIG. 15, the rear seat swing assembly 240 includes a back support bracket 242 connected to a rear seat swing 244 by a swing bushing 246 and a rivet 248. The rear seat swing 244 is connected to a rear seat bracket 250 by a rivet 252 and a washer 254. The rear seat bracket 250 is configured to be connected to the tube seal frame 148. A lower end of the rear seat swing 244 is engaged with a curved slot 250*a* of the rear seat bracket 250 by a shoulder bushing 266, a rivet 268 and a spring washer 270. An upper end of the rear seat swing is received in an upper bracket 271 that is mounted to the seat back 18. As the seat back 18 is pivoted rearwardly, the seat frame 16 is pushed forward by the rear seat swing assembly 240 so that a forward end of the seat frame 16 moves forward and upward along the seat ramps 220*a*, 220*b*. The spring washer 270 provides a controlled friction as the seat back 18 is pivoted rearward.

Figure 23A:
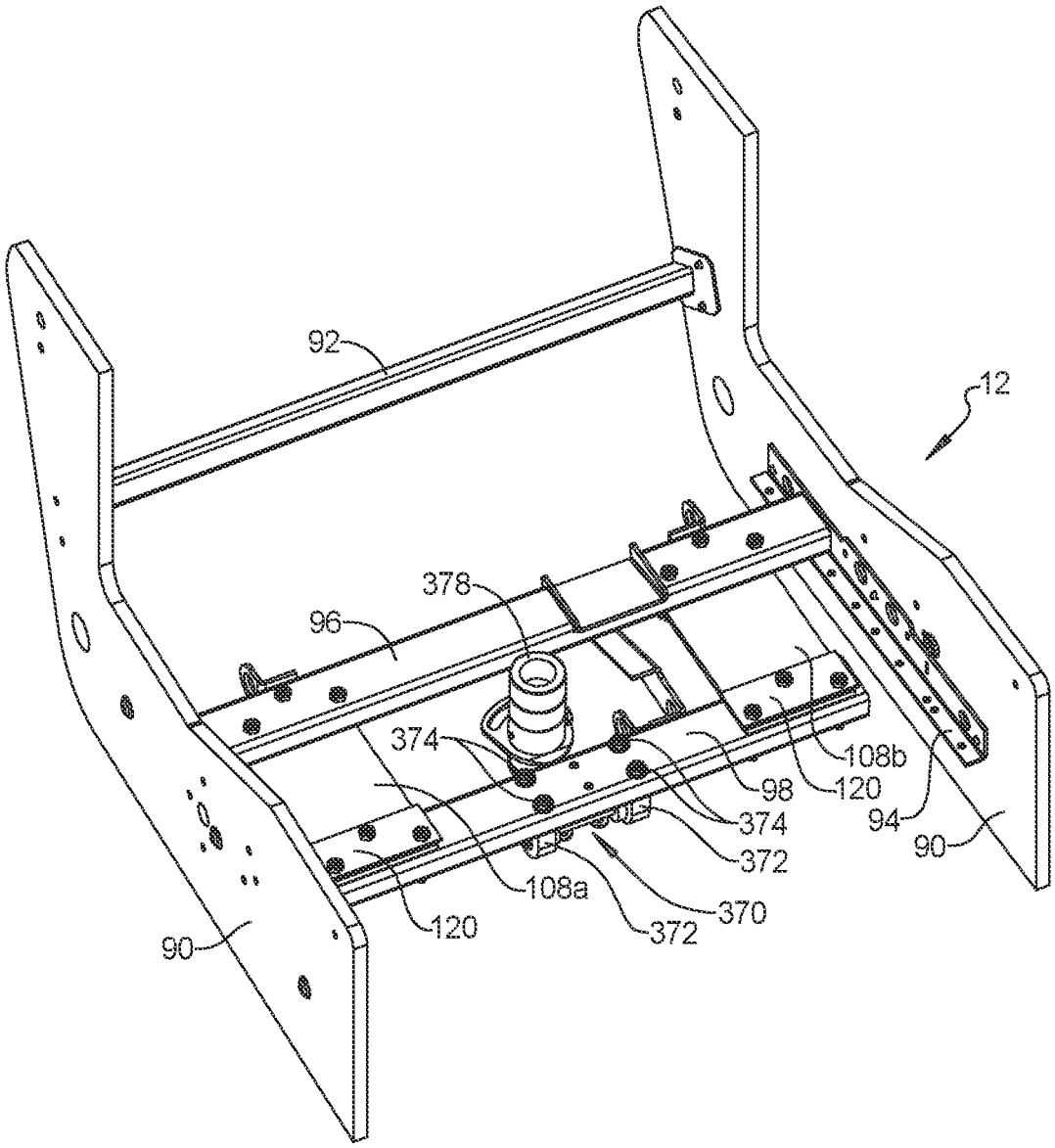
FIG. 23A is a front right perspective view of the support structure of the power chair mechanism according to the principles of the present disclosure.

With reference to FIGS. 23A-23D, the power chair chassis 12 will now be described. The power chair chassis 12 includes several common elements to the manual chair chassis 312 described above with reference to FIGS. 10A-10D. Accordingly, the same reference numerals designating the same or similar elements in the manual chair chassis 312 are used in describing the power chair chassis 12. As shown in FIG. 23A, the power chair chassis 12 includes a frame including a pair of siderails 90 and a cross brace structure including a tube rail 92 extending between a rear portion of the side rails 90, a pair of side brackets 94 mounted to a respective one of the side rails and a center cross tube 96 extending between the pair of side brackets 94. A rocker mount tube 98 also extends between the pair of side brackets 94 forward of the center cross tube 96. The rocker mount tube 98 is connected to the center cross tube 96 by a pair of spring plates 108*a*, 108*b* that are each connected to the respective rocker mount tube 98 and center cross tube 96 by a plurality of clamp plates 120 and a plurality of fasteners.

Figure 23B:
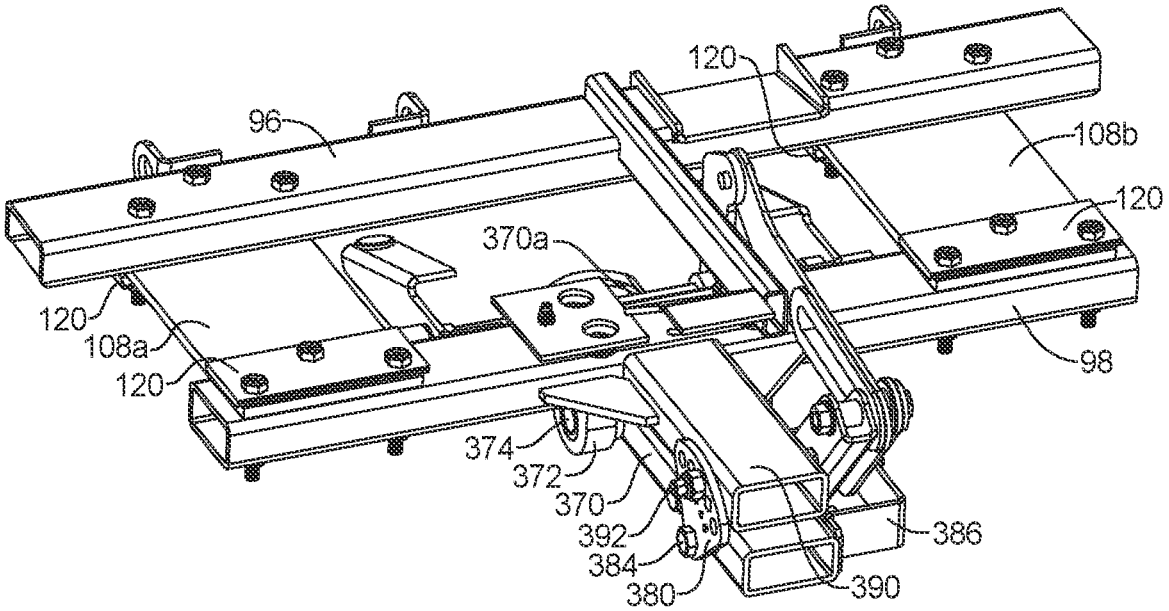
FIG. 23B is a front right perspective view of the tilt adjustment components of the power chair mechanism according to the principles of the present disclosure.
Figure 23C:
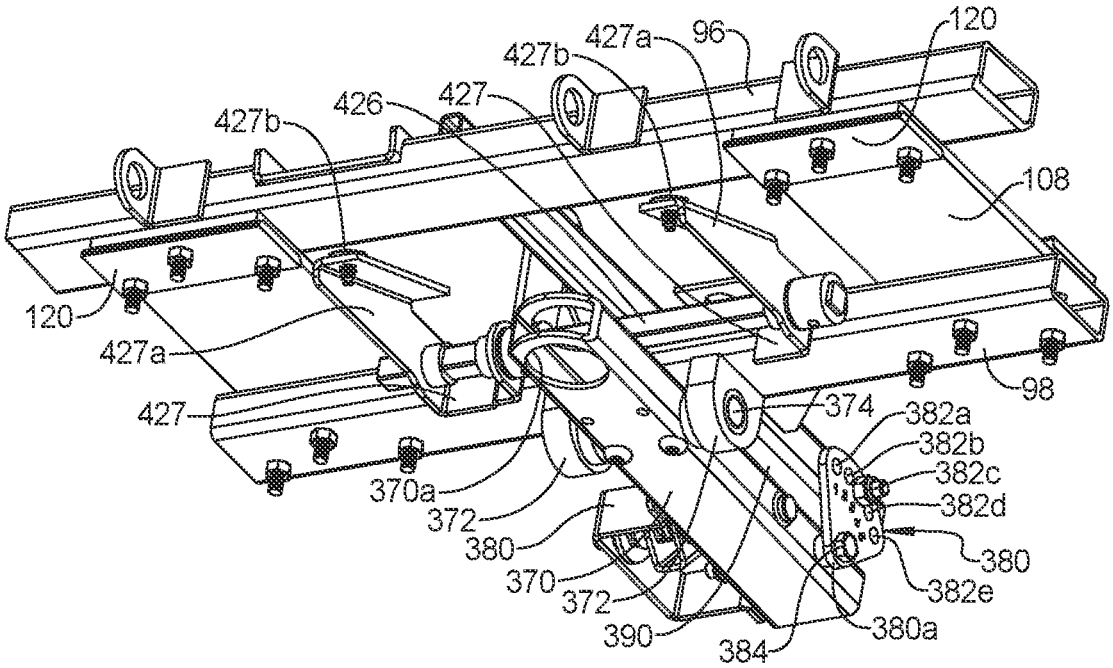
FIG. 23C is a bottom rear perspective view of the tilt adjustment components of the power chair mechanism according to the principles of the present disclosure.

With reference to FIGS. 23B and 23C, a pedestal rocker mount 370 is pivotally connected to the rocker mount tube 98 by a pair of brackets 372 and a pivot pin 374. A rear end of the pedestal rocker mount 370 includes an opening 370*a* that supports a cylindrical slide bushing 378 (shown in FIG. 23A). The spindles 40, 72, 84 of the different pedestal bases 14, 114, 214 are selectively received in the slide bushing 378 to support the power chair chassis 12 to the different bases. With continued reference to FIGS. 23B-23C, a forward end of the pedestal rocker mount 370 pivotally supports a tilt adjustment plate 380. The tilt adjustment plate 380 includes a pivot hole 380*a* and a plurality of tilt adjustment holes 382*a-e* each being located at a varying distance from the pivot hole 380*a*. The pivot hole 380*a* receives a bolt 384 that pivotally supports the tilt adjustment plate 380. A support bracket 386 is fixed to and extends from a side of the pedestal rocker mount 370. A support arm 390 is fixedly secured to and extends perpendicular from a front face of the rocker mount tube 98 above the pedestal rocker mount 370. The tilt adjustment plate 380 is secured to the support arm 390 by a fastener 392 that engages the support arm 390 and a selected one of the tilt adjustment holes 382*a-e* for adjusting a distance between the support arm 390 and the pedestal rocker mount 370 and thereby adjusting a tilt position of the slide bushing 378 relative to the rocker mount tube 98. By way of example, the angular orientation of the slide bushing 378 can be tilted forward or rearward over a range of about 3 degrees depending upon which of the tilt adjustment holes 382*a-e* of the tilt adjustment plate 380 is engaged with the fastener 392. The components of the rocking feature are all separate from and mounted above the base.

Figure 14A:
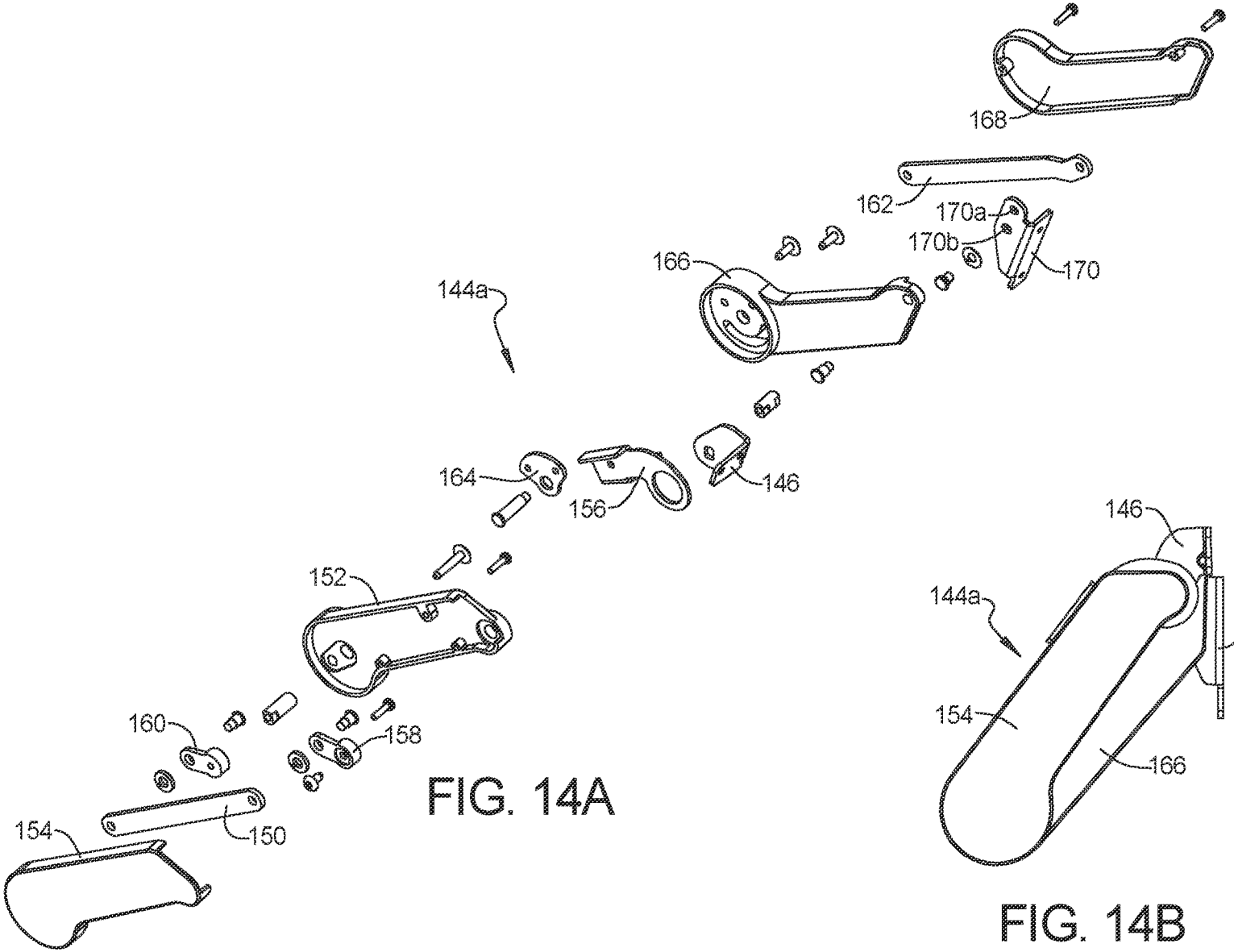
FIG. 14A is an exploded perspective view of a leg rest arm assembly according to the principles of the present disclosure.
Figure 14B:
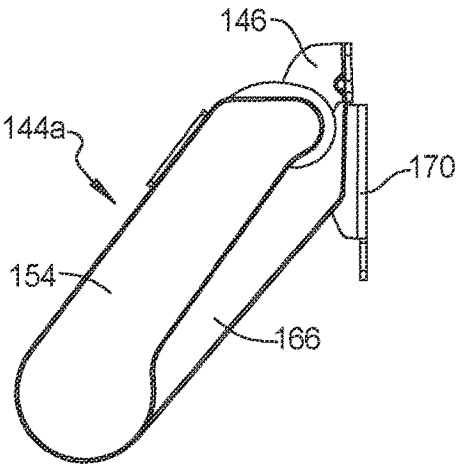
Figure 23D:
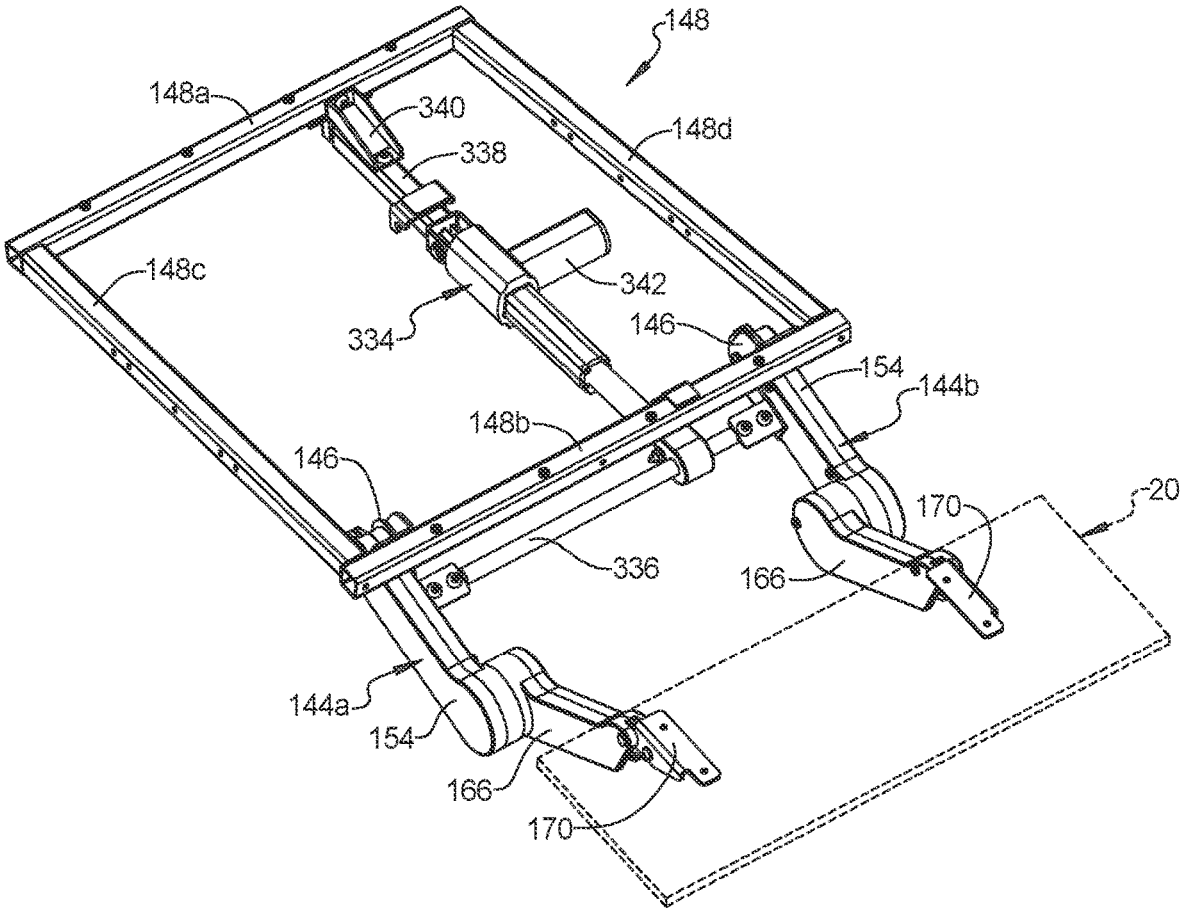
FIG. 23D is a top front right perspective view of the leg rest components of the power chair mechanism according to the principles of the present disclosure.

With reference to FIG. 23D, the leg rest 20 is supported by a pair of leg rest arm assemblies 144*a*, 144*b*. With reference to FIGS. 14A and 14B, a leg rest arm assembly 144*a* includes a leg rest mount pivot 146 that is connected to a seat frame 148 (best shown in FIG. 23D) and pivotally supports an upper lever 150, an upper arm housing 152 and an upper housing cover 154 via an upper housing drive link 156 and a first drive hub 158. A second drive hub 160 is supported at a second end of the lever arm 150 and is connected to a lower lever 162 via a drive plate stud 164. The lower lever 162 supports a lower housing 166 and a lower housing cover 168 that are connected to a leg rest deck mount 170 by one or more rivets. The upper housing cover 154 can be connected to the upper housing 152 by a plurality of fasteners and the lower cover 168 can be connected to the lower housing 166 by a plurality of fasteners. As the leg rest arm assemblies 144*a*, 144*b* are articulated in a forward direction, the leg rest deck mount 170 is pivoted to a generally horizontal position by pivoting about an upper pivot point 170*a* and being driven by a lower connection point 170*b* to the upper lever 162. It is noted that the leg rest arm assembly 144*b* is a mirror image of the leg rest arm assembly 144*a*.

With continued reference to FIG. 23D, a motor actuator rod 334 is connected between the rear tube 148*a* of the tube seat frame 148 and a draw bar 336 that is connected to the pair of leg rest assemblies 144*a*, 144*b*. The motor actuator rod 334 is connected to a tube guide 338 which is mounted to the rear tube 148*a* of the tube seat frame 148 by a motor attachment mount 340. The motor actuator rod 334 is further attached to an actuator motor 342 that extends the actuator rod 334 for pushing out and retracting in the draw bar 336 for extending and retracting the leg rest 20.

Figure 23E:
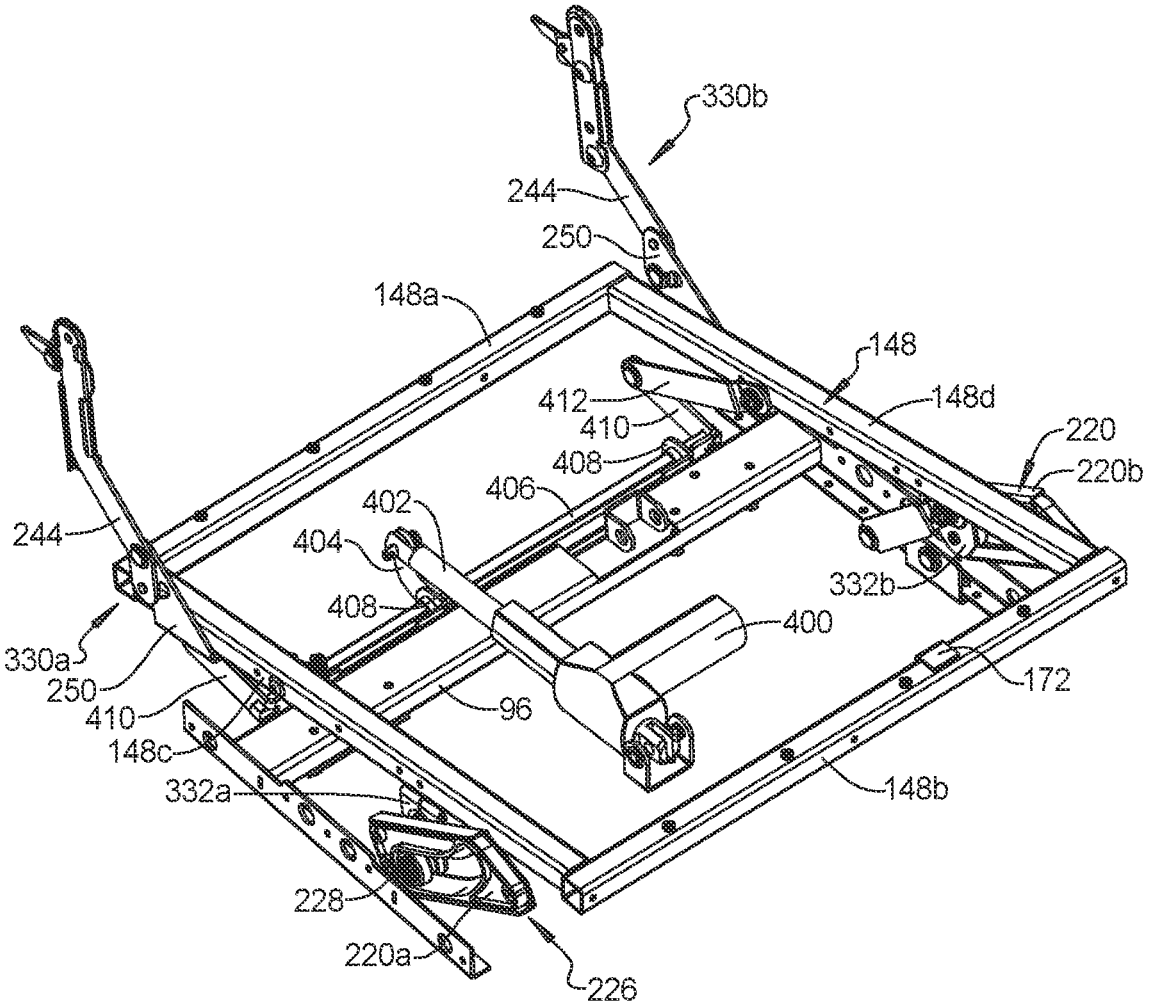
FIG. 23E is a front right perspective view of the recline components of the power chair mechanism according to the principles of the present disclosure.

With reference to FIG. 23E, the tube seat frame 148 includes a rear seat tube 148*a*, a front seat tube 148*b* and a pair of side seat tubes 148*c*, 148*d*. A plurality of anchor clips 172 are mounted to the rear seat tube 148*a* and the front seat tube 148*b*. The tube seat frame 148 is supported at a rear end by a pair of power rear swing arms 330*a*, 330*b*. The tube seat frame 148 is supported at a forward end by a pair of support brackets 332*a*, 332*b* that support roller bearings 228 that are engaged with a pair of front roller guides 226 and seat ramps 220*a*, 220*b* that are secured to the side rails 90. A recline actuator motor 400 is connected to an extendable actuator arm 402 that is connected to a lever 404 of a rotatable actuator shaft 406. The actuator shaft 406 is rotatably supported by a pair of support brackets 408 that are connected to a rear of the center cross tube 96. The actuator shaft 406 includes a pair of lever arms 410 that are connected to the side rails 148*c*, 148*d* of the tube seat frame 148 by linkages 412. As the recline actuator 400 is activated, the actuator arm pulls the lever 404 forward and rotates the actuator shaft 406 and lever arms 410. The rotating lever arms 410 push forward on the linkages 412 which push the tube seat frame 148 forward and upward along the seat ramps 220*a*, 220*b*. As the tube seat frame 148 moves forward, the rear seat brackets 250 are moved forward, pulling forward on the lower end of the rear seat swing 244 causing the rear seat swing 244 to pivot toward a horizontal position, thus reclining the seat back 18.

Figure 23F:
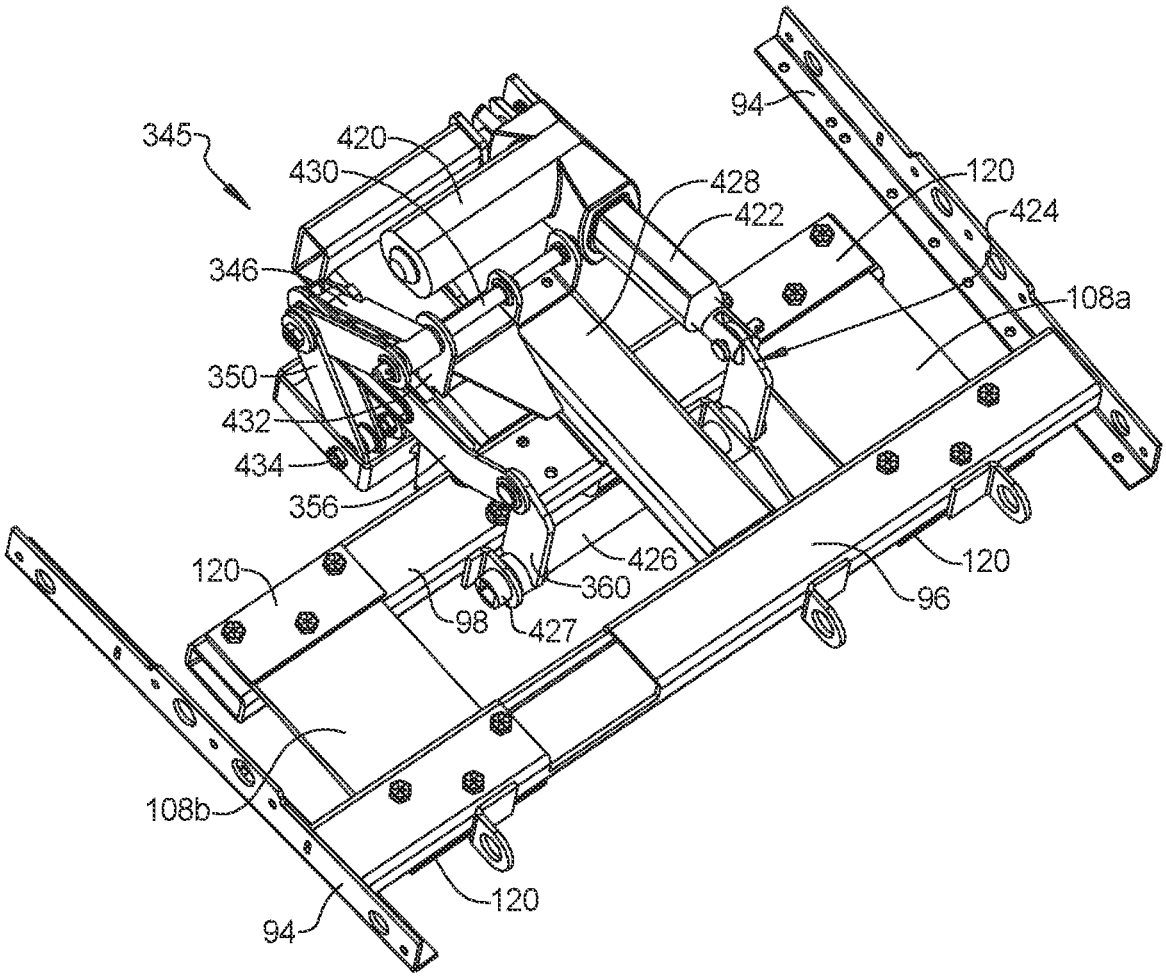
FIG. 23F is a left rear perspective view of the tilt components of the power chair mechanism according to the principles of the present disclosure.
Figure 24A:
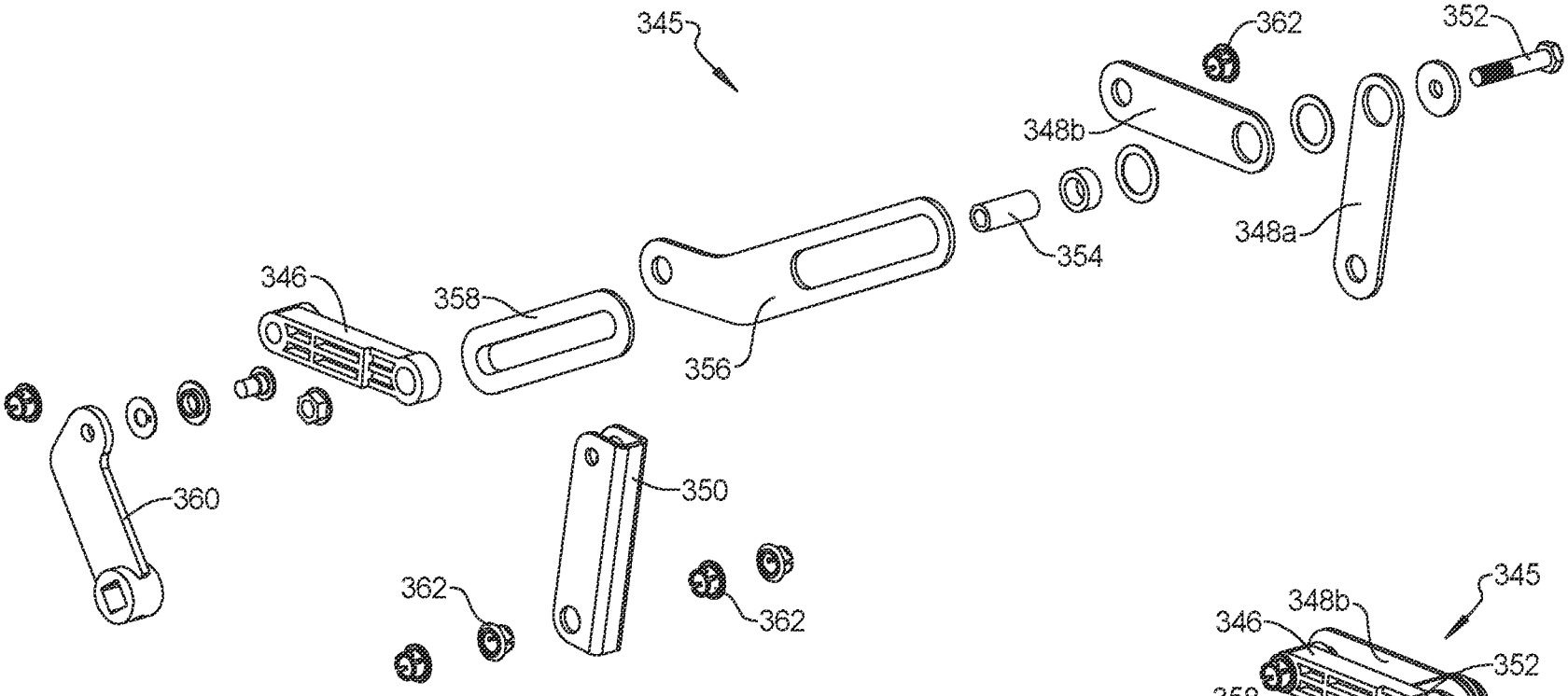
FIG. 24A is an exploded perspective view of the power tilt mechanism according to the principles of the present disclosure.
Figure 24B:
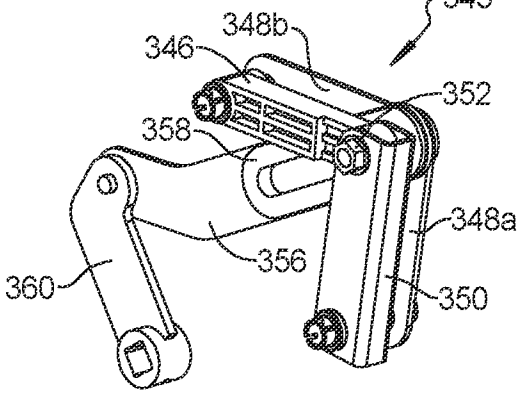
FIG. 24B is a perspective view of the power tilt mechanism according to the principles of the present disclosure.

With reference to FIG. 23F, a tilt actuator motor 420 and actuator arm 422 are connected to lever arm 424 on a tilt shaft 426. The tilt shaft 426 is rotatably supported by a pair of brackets 427 that are mounted to a rear surface of the rocker mount tube 98. As best shown in FIG. 23C, the pair of brackets 427 each include a limit arm 427*a* and a stop pad 427*b* that oppose the center cross tube 96 to limit movement of the rocker mount tube 98 relative to the center cross tube 96. With continued reference to FIG. 23F, the tilt shaft 426 is further connected to a power tilt mechanism 345 that is connected between the support arm 390 that extends forward of the rocker mount tube 98 and the support bracket connected to the pedestal rocker mount 370. With reference to FIGS. 24A and 24B, the power tilt mechanism 345 includes an upper tilt swing link 346 and a pair of outer tilt link swings 348 connected to a lower tilt swing link 350 by a joint defined by a bolt 352 and bushing 354. A tilt connector link 356 and a slide insert 358 are connected to the joint between the upper tilt swing link 346 and the lower wing link 350. In particular, the tilt connector link 356 and the slide insert 358 include an elongated slot 356*a*, 358*a* that slidably receive the bushing 354. A tilt lever assembly 360 is connected to a second end of the tilt connector link 356. With returning reference to FIG. 23F, the tilt lever assembly 360 is further connected to the tilt shaft 426. The upper tilt swing link 346 is further connected to a drive pin 430 which is mounted to the support arm 390 that extends forward of the rocker mount tube 98 by bracket system 432. The lower tilt swing link 350 is further connected to a drive pin 434 that is connected to the support bracket 386 that is connected to the pedestal rocker mount 370. Clevis bushings 362 are connected to the lower tilt swing link 350 and the second of the pair of outer tilt link swings 348. When the actuator arm 422 is extended, the lever arm 424 and the tilt shaft 426 are rotated, thus causing rotation of the tilt lever assembly 360. As the tilt lever assembly 360 is rotated, the tilt connector link 356 causes expansion of the upper tilt swing link 346 and the lower tilt swing link 350, thus causing the pedestal rocker mount 370 to tilt relative to the support arm 390, thus causing the slide bushing 378 and the back of the seat 16 to tilt downward (See for example, FIG. 1D). When the tilt mechanism is not activated to hold the chassis 12 in a tilted position, the rocking feature is fully enabled.

Figure 25:
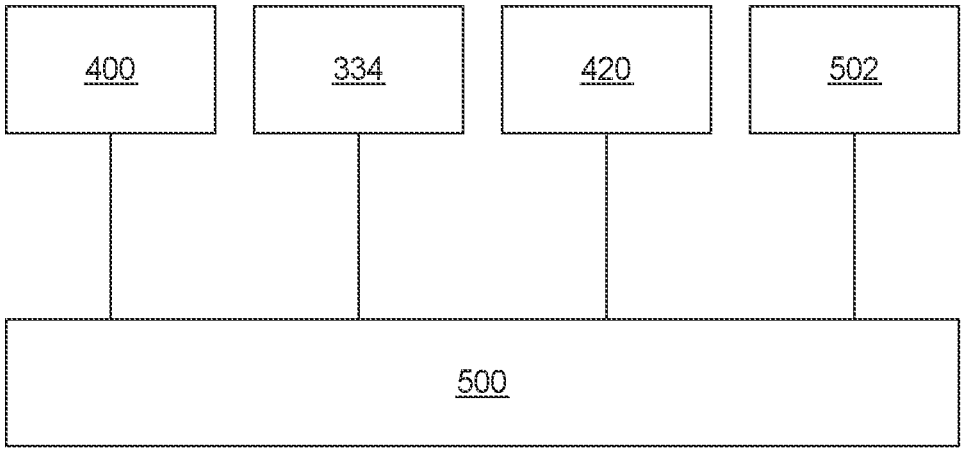
FIG. 25 is a schematic view of a control system for controlling operation of the motors of the power chair mechanism.

With reference to FIG. 25, the recline actuator motor 400 of the power recline mechanism, the motor actuator rod 334 of the power leg rest mechanism and the tilt actuator motor 420 of the power tilt mechanism can each be activated independently of one another so that the recline feature, the leg rest feature and the tilt feature can each be utilized with or without the other features being implemented. In addition, the recline actuator motor 400 of the power recline mechanism, the motor actuator rod 334 of the power leg rest mechanism and the tilt actuator motor 420 of the power tilt mechanism can be controlled by a controller 500 that stores a pre-arranged activation sequence based upon occupant preferences using memory 502.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer, or section. Terms such as "first," "second," and other numerical terms when used herein do not imply a sequence or order unless clearly indicated by the context. Thus, a first element, component, region, layer, or section discussed below could be termed a second element, component, region, layer, or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A chair mechanism, comprising:

a frame structure;

a seat bottom supported by the frame structure;

a seat back supported by the frame structure and pivotable to a reclined position relative to the seat bottom;

a leg rest assembly supported by the seat bottom and movable between a stowed position and an extended position; and a rocking support structure connecting the seat frame to a base structure, wherein the frame structure includes a cross tube connected to a pair of side rails, the rocking support structure including a rocker mount tube connected to the cross tube of the frame structure by a pair of spring plates, and wherein the chair mechanism further comprises a pedestal rocker mount assembly connected to the rocker mount tube and including a cylindrical sleeve that is engaged with a spindle of the base structure.

2. The chair mechanism according to claim 1, wherein the seat bottom is supported at a front end by a pair of radial bearings that are supported by the seat bottom and the pair of radial bearings engage a pair of seat ramps that are secured to the frame structure.

3. The chair mechanism according to claim 2, wherein the seat bottom is supported at a rear end by a pair of rear seat swing assemblies that are attached to the frame structure, the seat bottom, and the seat back.

4. The chair mechanism according to claim 1, further comprising an actuator motor that is drivingly connected to an actuator arm that is connected to a first lever of an actuator shaft that include a pair of lever arms that are each connected to a linkage that are each connected to a frame of the seat bottom, wherein the seat bottom is supported at a front end by a pair of radial bearings that are supported by the seat bottom and the pair of radial bearings engage a pair of seat ramps that are secured to the frame structure, and wherein the seat bottom is supported at a rear end by a pair of rear seat swing assemblies that are attached to the frame structure, the seat bottom, and the seat back.

5. The chair mechanism according to claim 1, wherein the leg rest assembly includes a pair of leg rest arm assemblies that are connected to a frame of the seat bottom and to a leg rest panel, the leg rest assembly including a draw bar connected between the pair of leg rest arm assemblies, the leg rest assembly including an actuator motor that is drivingly connected to an actuator arm that is connected to a rear of a frame of the seat bottom and to the draw bar.

6. The chair mechanism according to claim 5, wherein the seat bottom is supported at a front end by a pair of radial bearings that are supported by the seat bottom and the pair of radial bearings engage a pair of seat ramps that are secured to the frame structure.

7. The chair mechanism according to claim 6, wherein the seat bottom is supported at a rear end by a pair of rear seat swing assemblies that are attached to the frame structure, the seat bottom, and the seat back.

8. The chair mechanism according to claim 1, further comprising a pawl rack assembly that is mounted to the cross tube and has a rack releasably engaged by a pawl and a rack connector connected to the rack and to the pedestal rocker mount assembly for securing the frame structure in a tilted position.

9. The chair mechanism according to claim 8, wherein the seat frame is able to balance and rock on the rocking support structure when the pawl rack assembly is not securing the frame structure in a tilted position.

10. The chair mechanism according to claim 8, further comprising a tilt activation lever drivingly connected to the pawl and being movable from a first position that allows the pawl to engage the rack and a second position that disengages the pawl from the rack, wherein the tilt activation lever is connected to an over-center toggle spring.

11. A chair mechanism, comprising:

a frame structure;

a seat bottom supported by the frame structure;

a seat back supported by the frame structure and pivotable to a reclined position relative to the seat bottom;

a leg rest assembly supported by the seat bottom and movable between a stowed position and an extended position; and a rocking support structure connecting the seat frame to a base structure, wherein the frame structure includes a cross tube connected to a pair of side rails, the rocking support structure including a rocker mount tube connected to the cross tube of the frame structure by a pair of spring plates, wherein the chair mechanism further comprises a pedestal rocker mount arm pivotally connected to the rocker mount tube and including a cylindrical sleeve that is engaged with a spindle of the base structure.

12. The chair mechanism according to claim 11, further comprising a tilt adjustment mechanism connected between the rocker mount tube and the pedestal rocker mount tube, wherein the tilt adjustment mechanism includes a tilt adjustment plate having a pivot hole and a plurality of adjustment holes spaced at different distance from the pivot hole.

13. The chair mechanism according to claim 11, further comprising a power tilt mechanism that is connected between the rocker mount tube and the pedestal rocker mount arm, the power tilt mechanism tilting the pedestal rocker mount arm relative to the rocker mount tube.

14. The chair mechanism according to claim 13, wherein the power tilt mechanism includes an actuator motor connected to an actuator arm that engages a tilt lever attached to a tilt shaft, the tilt shaft connected to a linkage that is connected to upper and lower swing links that are connected to the rocker mount tube and the pedestal rocker mount arm, respectively.

15. The chair mechanism according to claim 13, wherein the seat frame is able to balance and rock on the rocking support structure when the power tilt mechanism is not tilting the pedestal rocker mount arm relative to the rocker mount tube.

16. The chair mechanism according to claim 13, wherein the power tilt mechanism is operable to secure the frame structure in a tilted position when the leg rest assembly is in any one of a stowed position, an extended position and a partially extended position.

17. The chair mechanism according to claim 13, wherein the power tilt mechanism is operable to secure the frame structure in a tilted position when the seat back is in any one of an upright position, a reclined position and a partially reclined position.

* * * * *